US007357002B2

(12) United States Patent
Yoshimi et al.

(10) Patent No.: US 7,357,002 B2
(45) Date of Patent: Apr. 15, 2008

(54) METHOD FOR INSTALLING REFRIGERATION DEVICE, AND REFRIGERATION DEVICE

(75) Inventors: Manabu Yoshimi, Sakai (JP); Nobuki Matsui, Sakai (JP); Hiromume Matsuoka, Sakai (JP); Kazuhide Mizutani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 238 days.

(21) Appl. No.: 10/573,984

(22) PCT Filed: Oct. 21, 2004

(86) PCT No.: PCT/JP2004/015593

§ 371 (c)(1),
(2), (4) Date: Mar. 30, 2006

(87) PCT Pub. No.: WO2005/038360

PCT Pub. Date: Apr. 28, 2005

(65) Prior Publication Data

US 2007/0113581 A1 May 24, 2007

(30) Foreign Application Priority Data

Oct. 22, 2003 (JP) ..... 2003-361827

(51) Int. Cl.
*F25B 43/04* (2006.01)

(52) U.S. Cl. ..... 62/475; 62/513

(58) Field of Classification Search ..... 62/475, 62/513

See application file for complete search history.

(56) References Cited

U.S. PATENT DOCUMENTS

| | | | | |
|---|---|---|---|---|
| 5,062,273 | A * | 11/1991 | Lee et al. | 62/85 |
| 2002/0026800 | A1* | 3/2002 | Kasai et al. | 62/85 |
| 2005/0252236 | A1* | 11/2005 | Matsuoka et al. | 62/498 |

FOREIGN PATENT DOCUMENTS

| | | | |
|---|---|---|---|
| JP | 55-164480 | U | 5/1979 |
| JP | 01-109761 | U | 7/1989 |
| JP | 05-060430 | A | 3/1993 |
| JP | H5-69571 | U | 9/1993 |
| JP | H10-197112 | A | 7/1998 |
| JP | H10-213363 | A | 8/1998 |
| JP | H11-23115 | A | 1/1999 |
| JP | H11-248298 | A | 9/1999 |
| JP | 2000-18737 | A | 1/2000 |
| JP | 2003-279169 | A | 10/2003 |

* cited by examiner

*Primary Examiner*—Melvin Jones
(74) *Attorney, Agent, or Firm*—Global IP Counselors

(57) ABSTRACT

An air conditioning device has a heat source unit and a utilization unit connected via a refrigerant connection pipe to form a refrigerant circuit, and has a cooler, a secondary receiver, and a separation membrane device. The cooler cools at least a portion of the refrigerant that flows through the liquid-side refrigerant circuit as the compressor is operated and the refrigerant in the refrigerant circuit is recirculated. The secondary receiver separates the refrigerant cooled by the cooler into a liquid refrigerant and a gas refrigerant that includes non-condensable gas. The separation membrane device has a separation membrane for separating the non-condensable gas from the gas refrigerant obtained by gas-liquid separation, and discharges the non-condensable gas thus separated to the outside of the refrigerant circuit.

20 Claims, 29 Drawing Sheets

METHOD FOR INSTALLING REFRIGERATION DEVICE, AND REFRIGERATION DEVICE

CROSS-REFERENCE TO RELATED APPLICATIONS

This U.S. National Stage application claims priority under 35 U.S.C. §119(a) to Japanese Patent Application No. 2003-361827 filed in Japan on Oct. 22, 2003, the entire contents of which are hereby incorporated herein by reference.

TECHNICAL FIELD

The present invention relates to a method for installing a refrigeration device and to a refrigeration device. The present invention particularly relates to a refrigeration device provided with a heat source unit having a compressor and a heat-source-side heat exchanger, a utilization unit having a utilization-side heat exchanger, and a refrigerant connection pipe for connecting the heat source unit and the utilization unit; and to a method for installing the same.

BACKGROUND ART

A separation-type air conditioning device is one type of conventional refrigeration device. This type of air conditioning device is mainly provided with a heat source unit having a compressor and a heat-source-side heat exchanger, a utilization unit having a utilization-side heat exchanger, and a liquid refrigerant connection pipe and gas refrigerant connection pipe for connecting the units to each other.

In this type of air conditioning device, the sequence of implementation from the work of device installation, piping, and wiring until the start of operation mainly includes the four steps below.

(1) Device installation, piping, and wiring (2) Evacuation of the refrigerant connection pipe (3) Loading of additional refrigerant (performed as needed)

(4) Start of operation

Installation of the type of air conditioning device described above has drawbacks in that the process of evacuating the refrigerant connection pipe necessitates the complex operations of connecting a vacuum pump to the liquid refrigerant connection pipe and the gas refrigerant connection pipe, and performing other operations that are important for preventing release of refrigerant into the atmosphere; degradation of the refrigerant and refrigerator oil due to residual oxygen gas; an increase in operating pressure due to non-condensable gases primarily composed of oxygen gas, nitrogen gas, and other atmospheric components; and other effects.

In order to overcome these drawbacks, an air conditioning device is proposed whereby the non-condensable gas retained in the refrigerant connection pipe after device installation, piping, and wiring is removed by adsorption by connecting a gas separation device filled with an adsorbent agent to the refrigerant circuit, and recirculating the refrigerant. Evacuation using a vacuum pump can thereby be omitted, and implementation of the air conditioning device can be simplified (see Japanese Laid Open Patent Publication No. 5-69571, for example). However, since a large quantity of the adsorbent agent must be used in order to adsorb all of the non-condensable gas included in the refrigerant in this air conditioning device, the device as a whole is enlarged, and is difficult to actually mount in a refrigeration device.

An air conditioning device is also proposed in which a fixture having a separation membrane is connected to the refrigerant circuit, refrigerant sealed into the heat source unit in advance is caused to fill the entire refrigerant circuit, and the non-condensable gas trapped in the refrigerant connection pipe after device installation, piping, and wiring is mixed with the refrigerant, after which the gas mixture of the refrigerant and the non-condensable gas is fed to the separation membrane without increasing the pressure thereof, and the non-condensable gas is separated and removed from the refrigerant. Evacuation using a vacuum pump can thereby be omitted, and implementation of the air conditioning device can be simplified (see Japanese Laid Open Patent Publication No. 10-213363, for example). However, this air conditioning device has drawbacks in that the separation efficiency of the non-condensable gas in the separation membrane is low because it is impossible to increase the pressure difference between the primary side (specifically, the inside of the refrigerant circuit) of the separation membrane and the secondary side (specifically, the outside of the refrigerant circuit).

SUMMARY OF THE INVENTION

In order to obviate the evacuation operation, an object of the present invention is to enhance the separation efficiency of non-condensable gas in the separation membrane in a refrigeration device provided with a constitution capable of separating and removing non-condensable gas remaining inside the refrigerant connection pipe in a state of mixture with the refrigerant in the refrigeration circuit at the time of on-site installation.

A method for installing a refrigeration device according to a first aspect of the present invention is a method for installing a refrigeration device provided with a heat source unit having a compressor and a heat-source-side heat exchanger, a utilization unit having a utilization-side heat exchanger, and a refrigerant connection pipe for connecting the heat source unit and the utilization unit; and is provided with a refrigerant circuit formation step and a non-condensable gas discharge step. In the refrigerant circuit formation step, a refrigeration circuit is formed by connecting the heat source unit to the utilization unit via the refrigerant connection pipe. In the non-condensable gas discharge step, the compressor is operated, the refrigerant is recirculated in the refrigerant circuit, at least a portion of the refrigerant that flows between the heat-source-side heat exchanger and the utilization-side heat exchanger is cooled and separated into a liquid refrigerant and a gas refrigerant that includes the non-condensable gas remaining in the refrigerant connection pipe, the non-condensable gas is separated using a separation membrane from the gas refrigerant obtained by gas-liquid separation, and the non-condensable gas is discharged to the outside of the refrigerant circuit.

In this method for installing a refrigeration device, the compressor is operated and the non-condensable gas primarily composed of oxygen gas, nitrogen gas, or another atmospheric component remaining in the refrigerant connection pipe is recirculated together with the refrigerant in the refrigerant circuit in the non-condensable gas discharge step after the heat source unit is connected to the utilization unit via the refrigerant connection pipe in the refrigerant circuit formation step. By this configuration, the pressure of the refrigerant and non-condensable gas that flows between the heat-source-side heat exchanger and the utilization-side heat exchanger is increased, the non-condensable gas is separated from the refrigerant that includes this highly pressurized non-condensable gas using a separation membrane, and the non-condensable gas is discharged to the outside of the refrigerant circuit. By thus operating the compressor and recirculating the refrigerant, the pressure difference between the primary side (specifically, the inside of the refrigerant circuit) and the secondary side (specifically, the outside of the refrigerant circuit) of the separation membrane can be increased, and the separation efficiency of the non-condensable gas in the separation membrane can therefore be enhanced.

In the non-condensable gas discharge step in this method for installing a refrigeration device, at least a portion of the refrigerant that flows between the heat-source-side heat exchanger and the utilization-side heat exchanger is cooled and separated into a liquid refrigerant and a gas refrigerant that includes the non-condensable gas, and the non-condensable gas is separated using a separation membrane from the gas refrigerant obtained by gas-liquid separation. By this configuration, the quantity of refrigerant including the non-condensable gas that is processed in the separation membrane can be reduced by performing gas-liquid separation, the quantity of gas refrigerant included in the gas phase during gas-liquid separation can be reduced by cooling the refrigerant, and the concentration of the non-condensable gas can be increased. Therefore, the separation efficiency of the non-condensable gas in the separation membrane can be further enhanced.

A method for installing a refrigeration device according to a second aspect of the present invention is the method for installing a refrigeration device according to the first aspect, wherein in the non-condensable gas discharge step, the refrigerant that flows between the heat-source-side heat exchanger and the utilization-side heat exchanger is separated into a liquid refrigerant and a gas refrigerant that includes the non-condensable gas, and the gas refrigerant obtained by gas-liquid separation is cooled.

In the non-condensable gas discharge step in this method for installing a refrigeration device, the refrigerant that flows between the heat-source-side heat exchanger and the utilization-side heat exchanger is separated into a liquid refrigerant and a gas refrigerant that includes the non-condensable gas before being cooled, and the gas refrigerant (specifically, the quantity of refrigerant cooled in the cooler is only a portion of the refrigerant that flows between the heat-source-side heat exchanger and the utilization-side heat exchanger) obtained by gas-liquid separation is cooled. Therefore, the quantity thus cooled of the refrigerant that includes the non-condensable gas can be reduced. The amount of thermal energy necessary for cooling the refrigerant can thereby be reduced.

A method for installing a refrigeration device according to a third aspect of the present invention is the method for installing a refrigeration device according to the first or second aspect, further having an airtightness testing step for testing the airtightness of the refrigerant connection pipe prior to the non-condensable gas discharge step; and an seal gas releasing step for releasing into the atmosphere the seal gas to reduce the pressure thereof inside the refrigerant connection pipe after the airtightness testing step.

In this method for installing a refrigeration device, the refrigerant connection pipe is tested for airtightness using nitrogen gas and other seal gas, and the seal gas is released into the atmosphere. Therefore, the quantity of oxygen gas remaining in the refrigerant connection pipe after these steps is reduced. It thereby becomes possible to reduce the amount of oxygen gas that is recirculated with the refrigerant in the refrigerant circuit, and the risk of degradation and other defects in the refrigerant or refrigerator oil can be eliminated.

A refrigeration device according to a fourth aspect of the present invention is a refrigeration device wherein a heat source unit having a compressor and a heat-source-side heat exchanger, and a utilization unit having a utilization-side heat exchanger are connected via a refrigerant connection pipe to form a refrigeration circuit, and is provided with a cooler, a gas-liquid separator, and a separation membrane device. The cooler cools at least a portion of the refrigerant that flows between the heat-source-side heat exchanger and the utilization-side heat exchanger as the compressor is operated and the refrigerant in the refrigerant circuit is recirculated, and is connected to the liquid-side refrigerant circuit for connecting the heat-source-side heat exchanger to the utilization-side heat exchanger. The gas-liquid separator separates the refrigerant cooled by the cooler, into a liquid refrigerant and a gas refrigerant that includes the non-condensable gas remaining in the refrigerant connection pipe. The separation membrane device has a separation membrane for separating the non-condensable gas from the gas refrigerant obtained by gas-liquid separation using the gas-liquid separator, and discharges to the outside of the refrigerant circuit the non-condensable gas separated by the separation membrane.

In this refrigeration device, the compressor is operated, and the non-condensable gas primarily composed of oxygen gas, nitrogen gas, or another atmospheric component remaining in the refrigerant connection pipe is recirculated together with the refrigerant in the refrigerant circuit, whereby the pressure of the non-condensable gas and the refrigerant that flows between the heat-source-side heat exchanger and the utilization-side heat exchanger is increased, the non-condensable gas is separated from the refrigerant that includes this highly pressurized non-condensable gas by the separation membrane of the separation membrane device, and the non-condensable gas is discharged to the outside of the refrigerant circuit. By thus operating the compressor and recirculating the refrigerant, the pressure difference between the primary side (specifically, the inside of the refrigerant circuit) and the secondary side (specifically, the outside of the refrigerant circuit) of the separation membrane can be increased, and the separation efficiency of the non-condensable gas in the separation membrane can therefore be enhanced.

In this refrigeration device, at least a portion of the refrigerant that flows between the heat-source-side heat exchanger and the utilization-side heat exchanger is cooled by the cooler and separated by a gas-liquid separator into a liquid refrigerant and a gas refrigerant that includes the non-condensable gas, and the non-condensable gas is separated using the separation membrane of the separation membrane device from the gas refrigerant obtained by gas-liquid separation. By this configuration, the quantity of refrigerant including the non-condensable gas that is processed in the separation membrane device is reduced by performing gas-liquid separation, the quantity of gas refrigerant included in the gas phase during gas-liquid separation is reduced by cooling the refrigerant, and the concentration of the non-condensable gas is increased. Therefore, the separation efficiency of the non-condensable gas in the separation membrane can be further enhanced.

A refrigeration device according to a fifth aspect of the present invention is the refrigeration device according to the fourth aspect, wherein the liquid-side refrigerant circuit further comprises a receiver capable of collecting the refrigerant that flows between the heat-source-side heat exchanger and the utilization-side heat exchanger. The cooler cools the gas refrigerant including the non-condensable gas that is separated into gas and liquid inside the receiver.

In this refrigeration device, since the cooler is connected to the receiver provided to the liquid-side refrigerant circuit, the refrigerant that flows through the liquid-side refrigerant circuit is separated into a liquid refrigerant and a gas refrigerant that includes the non-condensable gas, and the quantity of refrigerant including the non-condensable gas that is cooled in the cooler can be reduced. Specifically, the quantity of refrigerant cooled in the cooler is only a portion of the refrigerant that flows between the heat-source-side heat exchanger and the utilization-side heat exchanger. The amount of thermal energy necessary for cooling the refrigerant in the cooler can thereby be reduced.

A refrigeration device according to a sixth aspect of the present invention is the refrigeration device according to the fourth or fifth aspects, wherein the cooler is a heat exchanger that uses as a cooling source the refrigerant that flows through the refrigerant circuit.

Since the refrigerant that flows through the refrigerant circuit is used as the cooling source of the cooler in this refrigeration device, another cooling source is unnecessary.

A refrigeration device according to a seventh aspect of the present invention is the refrigeration device according to any one of the fourth through sixth aspects, wherein the cooler is a coiled heat transfer tube disposed inside the gas-liquid separator.

Since the gas-liquid separator and the cooler are integrally formed in this refrigeration device, the number of separate components is reduced, and the structure of the device is simplified.

A refrigeration device according to an eighth aspect of the present invention is the refrigeration device according to any one of the fourth through seventh aspects, wherein the gas-liquid separator is connected so that the liquid refrigerant that is separated into gas and liquid in the gas-liquid separator is returned to the receiver.

Since this refrigeration device is designed so that the liquid refrigerant cooled in the cooler and separated into gas and liquid in the gas-liquid separator is returned to the receiver, the refrigerant in the receiver is cooled, and the concentration of the non-condensable gas in the gas phase of the receiver can be increased.

A refrigeration device according to a ninth aspect of the present invention is the refrigeration device according to the eight aspect, wherein the gas-liquid separator is integrally formed with the receiver.

The gas-liquid separator is integrally formed with the receiver in this refrigeration device. Therefore, the number of separate components is reduced, and the structure of the device is simplified.

A refrigeration device according to a tenth aspect of the present invention is the refrigeration device according to any one of the fourth through ninth aspects, wherein the separation membrane device is integrally formed with the gas-liquid separator.

The separation membrane device is integrally formed with the gas-liquid separator in this refrigeration device. Therefore, the number of separate components is reduced, and the structure of the device is simplified.

DETAILED DESCRIPTION OF THE PREFERRED EMBODIMENTS

Embodiments of the refrigeration device and method for installing the refrigeration device according to the present invention will be described hereinafter based on the drawings.

First Embodiment

1 Structure of the Air Conditioning Device

Figure 1:
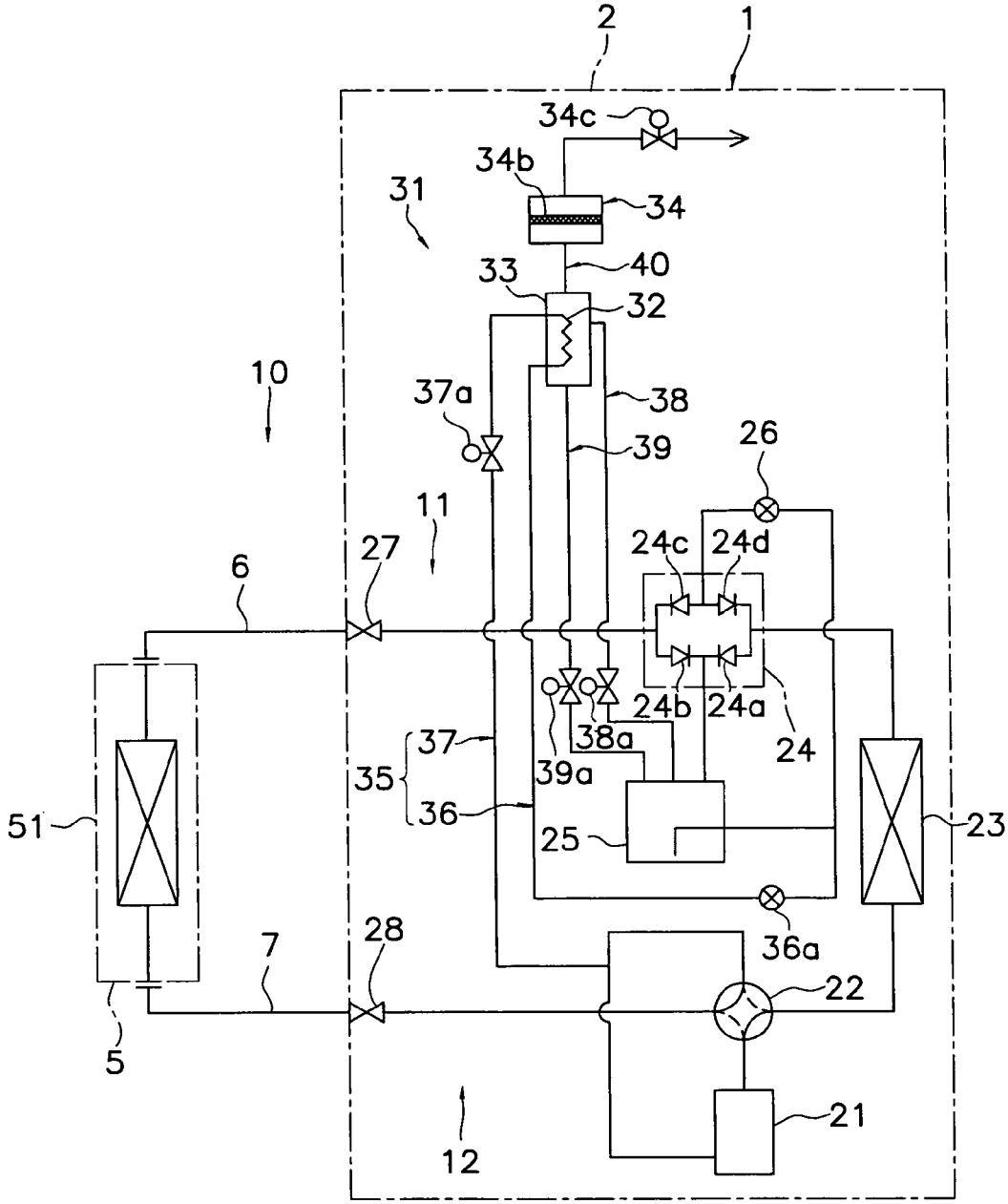
FIG. 1 is a schematic diagram of the refrigerant circuit of an air conditioning device as an example of a refrigeration device according to a first embodiment of the present invention.

FIG. 1 is a schematic diagram of a refrigerant circuit of an air conditioning device 1 as an example of a refrigeration device according to a first embodiment of the present invention. The air conditioning device 1 in the present embodiment is an air conditioning device capable of cooling operation and heating operation, and is provided with a heat source unit 2, a utilization unit 5, and a liquid refrigerant connection pipe 6 and gas refrigerant connection pipe 7 for connecting the heat source unit 2 with the utilization unit 5.

The utilization unit 5 mainly comprises a utilization-side heat exchanger 51.

The utilization-side heat exchanger 51 is a heat exchanger that is capable of cooling or heating the air inside a room by evaporating or condensing the refrigerant that flows therethrough.

The heat source unit 2 mainly comprises a compressor 21, a four-way directional valve 22, a heat-source-side heat exchanger 23, a bridge circuit 24, a main receiver 25 (receiver), a heat-source side expansion valve 26, a liquid-side gate valve 27, and a gas-side gate valve 28.

The compressor 21 is a device for drawing in and compressing the gas refrigerant.

The four-way directional valve 22 is a valve for switching the direction of flow of the refrigerant during switching between cooling operation and heating operation, and is capable of connecting the discharge side of the compressor 21 to the gas side of the heat-source-side heat exchanger 23, and connecting the intake side of the compressor 21 to the gas-side gate valve 28 during cooling operation. The four-way directional valve is also capable of connecting the discharge side of the compressor 21 to the gas-side gate valve 28, and connecting the intake side of the compressor 21 to the gas side of the heat-source-side heat exchanger 23 during heating operation.

The heat-source-side heat exchanger 23 is a heat exchanger capable of condensing or heating the refrigerant that flows therethrough using air or water as a heat source.

The bridge circuit 24 is composed of four non-return valves 24*a* through 24*d*, and is connected between the heat-source-side heat exchanger 23 and the liquid-side gate valve 27. The non-return valve 24*a* in this arrangement is a valve for allowing refrigerant to pass only from the heat-source-side heat exchanger 23 to the main receiver 25. The non-return valve 24*b* is a valve for allowing refrigerant to pass only from the liquid-side gate valve 27 to the main receiver 25. The non-return valve 24*c* is a valve for allowing refrigerant to pass only from the main receiver 25 to the liquid-side gate valve 27. The non-return valve 24*d* is a valve for allowing refrigerant to pass only from the main receiver 25 to the heat-source-side heat exchanger 23. This configuration makes it possible to cause refrigerant to flow into the main receiver 25 through the entrance port of the main receiver 25, and to cause the refrigerant flowing out of the exit port of the main receiver 25 to flow towards the utilization-side heat exchanger 51 after being expanded in the heat-source side expansion valve 26 when refrigerant flows towards the utilization-side heat exchanger 51 from the heat-source-side heat exchanger 23, such as during cooling operation. This configuration also makes it possible to cause refrigerant to flow into the main receiver 25 through the entrance port of the main receiver 25, and to cause the refrigerant flowing out of the exit port of the main receiver 25 to flow towards the heat-source-side heat exchanger 23 after being expanded in the heat-source side expansion valve 26 when the refrigerant flows towards the heat-source-side heat exchanger 23 from the utilization-side heat exchanger 51, such as during heating operation.

Figure 2:
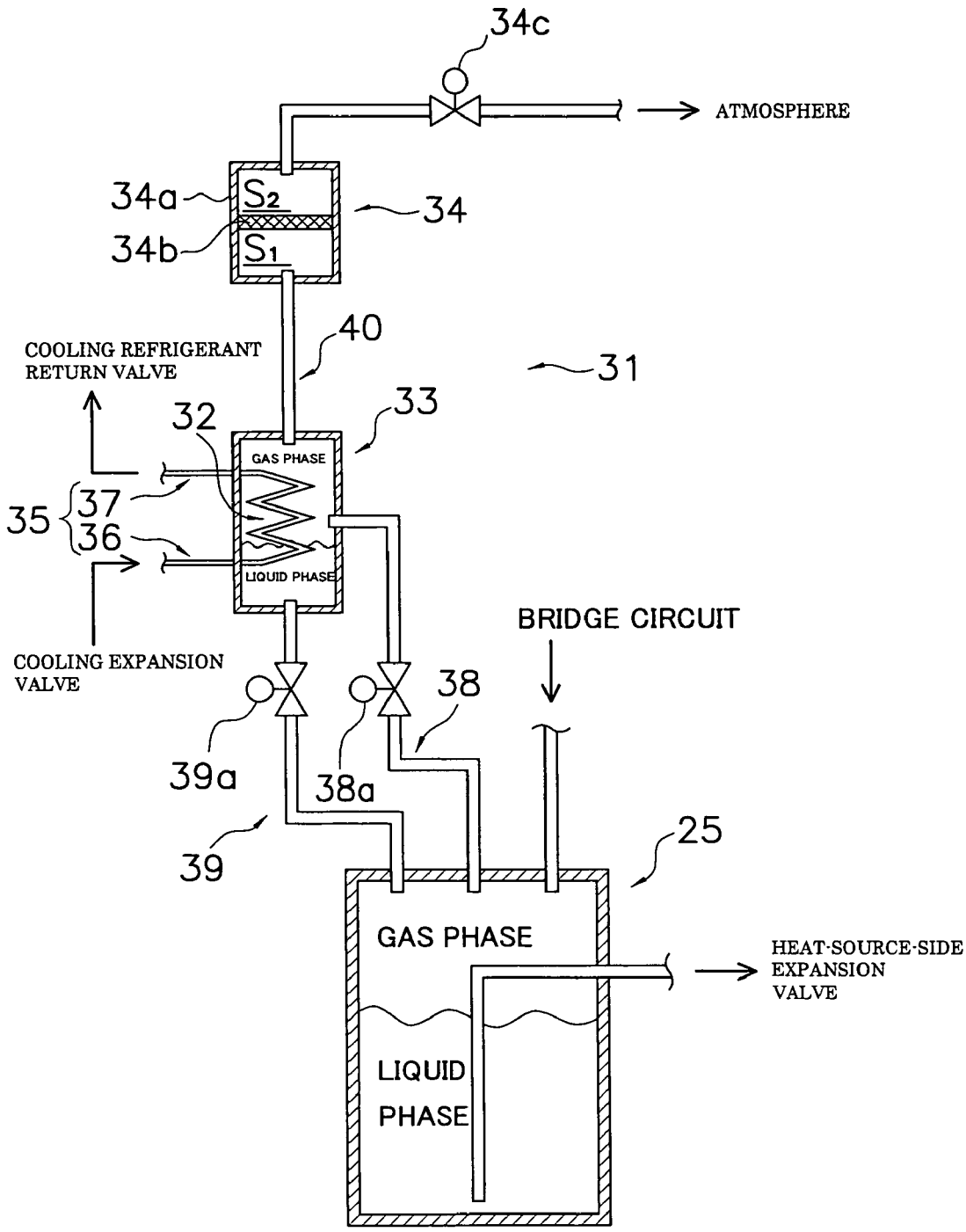
FIG. 2 is a diagram showing the overall structure of a main receiver and a gas separation device of the air conditioning device according to a first embodiment.

The main receiver 25 is a device capable of collecting the refrigerant condensed in the heat-source-side heat exchanger 23 or utilization-side heat exchanger 51. The refrigerant that flows into the main receiver 25 always flows in from an entrance port provided to the top (gas phase) of the main receiver 25 via the bridge circuit 24. The liquid refrigerant collected at the bottom (liquid phase) of the main receiver 25 also flows out from the exit port of the main receiver 25, provided to the bottom of the main receiver 25, and is transferred to the heat-source side expansion valve 26. Therefore, the gas refrigerant that flows into the main receiver 25 together with the liquid refrigerant is separated into gas and liquid inside the main receiver 25 and collected at the top of the main receiver 25 (see FIG. 2).

The heat-source side expansion valve 26 is a valve for adjusting the refrigerant pressure or refrigerant flow rate, and is connected between the bridge circuit 24 and the exit port of the main receiver 25. The heat-source side expansion valve 26 in the present embodiment is capable of expanding the refrigerant both during cooling operation and during heating operation.

The liquid-side gate valve 27 and the gas-side gate valve 28 are connected to the liquid refrigerant connection pipe 6 and the gas refrigerant connection pipe 7, respectively.

The liquid refrigerant connection pipe 6 connects the liquid side of the utilization-side heat exchanger 51 of the utilization unit 5 and the liquid-side gate valve 27 of the heat source unit 2. The gas refrigerant connection pipe 7 connects the gas side of the utilization-side heat exchanger 51 of the utilization unit 5 and the gas-side gate valve 28 of the heat source unit 2. The liquid refrigerant connection pipe 6 and the gas refrigerant connection pipe 7 are refrigerant connection pipes installed on site when the air conditioning device 1 is newly installed, and are refrigerant connection pipes that are diverted from an existing air conditioning device when either one or both of the heat source unit 2 and the utilization unit 5 are upgraded.

Here, the portion of the refrigerant circuit that extends from the utilization-side heat exchanger 51 to the heat-source-side heat exchanger 23 having the liquid refrigerant connection pipe 6, the liquid-side gate valve 27, the bridge circuit 24, the main receiver 25, and the heat-source side expansion valve 26 constitutes the liquid-side refrigerant circuit 11. The portion of the refrigerant circuit that extends from the utilization-side heat exchanger 51 to the heat-source-side heat exchanger 23 having the gas refrigerant connection pipe 7, the gas-side gate valve 28, the four-way directional valve 22, and the compressor 21 constitutes the gas-side refrigerant circuit 12. Specifically, the refrigerant circuit 10 of the air conditioning device 1 is composed of the liquid-side refrigerant circuit 11 and the gas-side refrigerant circuit 12.

The air conditioning device 1 is further provided with a gas separation device 31 connected to the liquid-side refrigerant circuit 11. The gas separation device 31 is a device capable of separating from the refrigerant the non-condensable gas remaining in the liquid refrigerant connection pipe 6 and gas refrigerant connection pipe 7, and discharging the non-condensable gas to the outside of the refrigerant circuit 10 by operating the compressor 21 and recirculating the refrigerant in the refrigerant circuit 10, and is incorporated into the heat source unit 2 in the present embodiment. The term "non-condensable gas" used herein refers to gas that is primarily composed of oxygen gas, nitrogen gas, or another air component. Therefore, even when the compressor 21 is operated and the refrigerant in the refrigerant circuit 10 is recirculated, this refrigerant flows through the liquid-side refrigerant circuit 11 without being condensed in the heat-source-side heat exchanger 23 or utilization-side heat exchanger 51. When the liquid-side refrigerant circuit 11 has a main receiver 25, such as in the present embodiment, this refrigerant is collected at the top of the main receiver 25 together with the uncondensed gas refrigerant in the heat-source-side heat exchanger 23 or utilization-side heat exchanger 51 (see FIG. 2).

The gas separation device 31 in the present embodiment primarily comprises a cooler 32, a secondary receiver 33 (gas-liquid separator), and a separation membrane device 34.

The cooler 32 is a heat exchanger for cooling at least a portion of the refrigerant that flows between the heat-source-side heat exchanger 23 and the utilization-side heat exchanger 51. The cooler 32 in the present embodiment is a coiled heat transfer tube disposed inside the secondary receiver 33, and the gas refrigerant including non-condensable gas collected in the top of the main receiver 25 is cooled in the secondary receiver 33 by the cooler. The refrigerant that flows inside the refrigerant circuit 10 is used as the cooling source of the cooler 32 in the present embodiment. More specifically, the material obtained by expanding a portion of the refrigerant that has flowed out of the exit port of the main receiver 25 is used as the cooling source of the cooler 32. This refrigerant is fed to the cooler 32 by a cooling refrigerant circuit 35. The cooling refrigerant circuit 35 is composed of a cooling refrigerant inflow circuit 36 for expanding a portion of the refrigerant that flows out from the exit port of the main receiver 25 and feeding the product to the cooler 32; and a cooling refrigerant outflow circuit 37 for returning the refrigerant that flows out from the cooler 32 to the intake side of the compressor 21. The cooling refrigerant inflow circuit 36 has a cooling expansion valve **36*a* for expanding a portion of the refrigerant that flows out from the exit port of the main receiver 25. The cooling refrigerant outflow circuit 37 has a cooling refrigerant return valve 37*a* for circulating/blocking the refrigerant that is passed through the cooler 32 and returned to the intake side of the compressor 21. In this arrangement, the refrigerant that flows into the cooler 32 via the cooling refrigerant inflow circuit 36 is at about the same temperature as the gas refrigerant including the non-condensable gas collected at the top of the main receiver 25, but a portion thereof evaporates and decreases in temperature due to expansion by the cooling expansion valve 36*a*. Therefore, when this refrigerant passes through the cooler 32, the gas refrigerant that includes the non-condensable gas inside the secondary receiver 33 is cooled, and a portion of the gas refrigerant that includes the non-condensable gas can be condensed. Since the non-condensable gas at this time has a low condensation temperature (specifically, boiling point) compared to the gas refrigerant, the non-condensable gas is collected at the top (gas phase) of the secondary receiver 33 as a result of the virtual lack of condensation thereof, and the concentration of the non-condensable gas in the gas refrigerant collected in the top of the secondary receiver 33** increases.

The secondary receiver 33 is a device for separating the refrigerant cooled by the cooler 32 into a liquid refrigerant and a gas refrigerant that includes non-condensable gas. The secondary receiver 33 is connected to the main receiver 25 via a gas refrigerant introduction circuit 38 and a liquid refrigerant outflow circuit 39. The gas refrigerant introduction circuit 38 is a conduit for introducing to the secondary receiver 33 the gas refrigerant including the non-condensable gas that is collected at the top of the main receiver 25, and has a gas refrigerant introduction valve **38*a* for circulating/blocking the gas refrigerant including the non-condensable gas that is introduced to the secondary receiver 33 from the top of the main receiver 25. In this arrangement, the gas refrigerant introduction circuit 38 is preferably formed so that the conduit resistance is reduced by increasing the diameter of the pipe, reducing the length of the pipe, or adopting other configurations so that the refrigerant pressure inside the secondary receiver 33 is as close as possible to the refrigerant pressure in the top of the main receiver 25. It thereby becomes possible to perform condensation at a higher condensation temperature, and to increase the quantity of refrigerant condensed in the cooler 32 when a portion of the gas refrigerant including the non-condensable gas is condensed by the cooler 32. The liquid refrigerant outflow circuit 39 is a conduit for returning the liquid refrigerant condensed by the cooler 32 and collected in the bottom (liquid phase) of the secondary receiver 33 to the main receiver 25, and has a liquid refrigerant outflow valve 39*a*** for circulating/blocking the liquid refrigerant returned to the main receiver 25 from the bottom of the secondary receiver 33. The secondary receiver 33 in this arrangement is preferably disposed above the main receiver 25. This configuration makes it possible to connect the liquid refrigerant outflow circuit 39 at a downward inclination towards the main receiver 25 from the secondary receiver 33, and the liquid refrigerant returned from the secondary receiver 33 to the main receiver 25 is thereby automatically returned by the force of gravity.

The separation membrane device 34 is a device for separating the non-condensable gas from the gas refrigerant obtained by gas-liquid separation using the secondary receiver 33, and discharging the separated non-condensable gas to the outside of the refrigerant circuit 10. The separation membrane device 34 is configured so that the gas refrigerant including the non-condensable gas collected in the top of the secondary receiver 33 is introduced via a separation membrane introduction circuit 40 connected to the top of the secondary receiver 33.

The separation membrane device 34 in the present embodiment has a device main body 34*a*, a separation membrane 34*b* disposed so as to divide the space inside the device main body 34*a* into a space $S_2$ (secondary side) and a space $S_1$ (primary side) communicated with the separation membrane introduction circuit 40, and a discharge valve 34*c* connected to the space $S_2$. In the present embodiment, a membrane is used for the separation membrane 34*b* that is capable of selectively transmitting the non-condensable gas from the gas refrigerant that includes the non-condensable gas. This type of separation membrane uses a porous membrane composed of a polyimide membrane, a cellulose acetate membrane, a polysulfone membrane, a carbon membrane, or the like. The term "porous membrane" used herein refers to a membrane having a large number of extremely minute micropores that performs separation according to the difference in the rate at which gas passes through these micropores; specifically, a membrane that is permeable to components having a small molecular diameter, and impermeable to components having a large molecular diameter. In this arrangement, the R22 or R134a used as the refrigerant of the air conditioning device, and the R32 or R125 included in the mixed refrigerant R407C or R410A, each have a larger molecular diameter than water vapor, oxygen gas, or nitrogen gas, and can therefore be separated by this porous membrane. The separation membrane 34*b* therefore selectively transmits the non-condensable gas from the gas refrigerant that includes the non-condensable gas (specifically, the fed gas that is a gas mixture of the gas refrigerant and non-condensable gas collected in the top of the secondary receiver 33), and the non-condensable gas can be caused to flow from the space $S_1$ to the space $S_2$. The discharge valve 34*c* is a valve for opening the space $S_2$ to the atmosphere, and the valve is capable of releasing the non-condensable gas separated by the separation membrane 34*b* and influxed to the space $S_2$ into the atmosphere from the space $S_2$, and discharging the non-condensable gas to the outside of the refrigerant circuit 10.

2 Method for Installing the Air Conditioning Device

The method for installing the air conditioning device 1 will next be described.

Device Installation Step (Refrigerant Circuit Formation Step)

First, a newly created utilization unit 5 and heat source unit 2 are installed, the liquid refrigerant connection pipe 6 and gas refrigerant connection pipe 7 are mounted and connected to the utilization unit 5 and heat source unit 2, respectively, and the refrigerant circuit 10 of the air conditioning device 1 is formed. In this arrangement, the liquid-side gate valve 27 and gas-side gate valve 28 of the newly created heat source unit 2 are closed, and a prescribed quantity of refrigerant is charged in advance into the refrigerant circuit of the heat source unit 2. The discharge valve 34*c* of the separation membrane device 34 constituting the gas separation device 31 is then closed.

When the liquid refrigerant connection pipe 6 and gas refrigerant connection pipe 7 constituting an existing air conditioning device are diverted, and either one or both of the heat source unit 2 and utilization unit 5 are upgraded, only one or both of the heat source unit 2 and utilization unit 5 in the above description are newly installed.

Airtightness Testing Step

After the refrigerant circuit 10 of the air conditioning device 1 is formed, the liquid refrigerant connection pipe 6 and gas refrigerant connection pipe 7 are tested for airtightness. When the liquid refrigerant connection pipe 6 and gas refrigerant connection pipe 7, gate valves, and other components are not provided to the utilization unit 5, the liquid refrigerant connection pipe 6 and gas refrigerant connection pipe 7 are tested for airtightness while connected to the utilization unit 5.

First, nitrogen gas as the gas used for airtightness testing is fed to the airtightness-tested portion that includes the liquid refrigerant connection pipe 6 and gas refrigerant connection pipe 7 from a feeding vent (not shown in the drawing) provided to the liquid refrigerant connection pipe 6, the gas refrigerant connection pipe 7, or another component, and the pressure of the portion tested for airtightness is increased to the airtightness testing pressure. After feeding of the nitrogen gas is stopped, maintenance of the airtightness testing pressure for a prescribed test period is confirmed for the portion tested for airtightness.

Seal Gas Releasing Step

After airtightness testing is completed, the ambient gas (seal gas) in the portion tested for airtightness is released into the atmosphere in order to reduce the pressure of the portion tested for airtightness. Since a large quantity of nitrogen gas used in airtightness testing is included in the ambient gas of the portion tested for airtightness, most of the ambient gas in the airtightness-tested portion after release into the atmosphere is substituted with nitrogen gas, and the quantity of oxygen gas is reduced. In this atmospheric discharge operation, the pressure of the airtightness-tested portion that includes the liquid refrigerant connection pipe 6 and gas refrigerant connection pipe 7 is reduced to a pressure slightly greater than atmospheric pressure in order to prevent ingress of air from outside the refrigerant circuit 10.

The ambient gas in the portion tested for airtightness may be substituted with nitrogen gas during the abovementioned airtightness testing step, or during the seal gas releasing step. The oxygen gas included in the ambient gas in the airtightness-tested portion can thereby be reliably removed.

Non-Condensable Gas Discharge Step

After the seal gas is released, the liquid-side gate valve 27 and gas-side gate valve 28 of the heat source unit 2 are opened, and a state is established in which the refrigerant circuit of the utilization unit 5 and the refrigerant circuit of the heat source unit 2 are connected. The refrigerant charged in advance into the heat source unit 2 is thereby fed to the entire refrigerant circuit 10. When the necessary refrigerant charge quantity is not obtained using only the quantity of refrigerant charged in advance into the heat source unit 2, such as when the refrigerant connection pipes 6 and 7 are long, additional refrigerant is charged from the outside as needed. The entire necessary quantity of refrigerant is charged from the outside when refrigerant is not charged in advance into the heat source unit 2. The seal gas (also including non-condensable gas remaining in the utilization unit 5 when the utilization unit 5 is also tested for airtightness at the same time) as the non-condensable gas remaining in the refrigerant connection pipes 6 and 7 following the seal gas releasing step is thereby mixed with the refrigerant inside the refrigerant circuit 10.

In this circuit structure, the compressor 21 is activated, and operation is performed for recirculating the refrigerant in the refrigerant circuit 10.

(Case in which the Non-Condensable Gas is Discharged During Cooling Operation)

A case will first be described in which the operation for recirculating refrigerant in the refrigerant circuit 10 is performed by the cooling operation. At this time, the four-way directional valve 22 is in the state indicated by the solid line in FIG. 1; specifically, a state in which the discharge side of the compressor 21 is connected to the gas side of the heat-source-side heat exchanger 23, and the intake side of the compressor 21 is connected to the gas-side gate valve 28. The heat-source side expansion valve 26 is in a state in which the degree of opening thereof is adjusted. A state is also established in which the cooling expansion valve 36*a*, cooling refrigerant return valve 37*a*, gas refrigerant introduction valve 38*a*, liquid refrigerant outflow valve 39*a*, and discharge valve 34*c* constituting the gas separation device 31 are all closed, and the gas separation device 31 is not in use.

When the compressor 21 is activated in this state of the refrigerant circuit 10 and gas separation device 31, the gas refrigerant is drawn into the compressor 21 and compressed, after which the gas refrigerant is conducted through the four-way directional valve 22 to the heat-source-side heat exchanger 23, caused to exchange heat with air or water as the heat source, and condensed. This condensed liquid refrigerant flows into the main receiver 25 through the non-return valve 24*a* of the bridge circuit 24. The heat-source side expansion valve 26 connected to the downstream side of the main receiver 25 herein is in a state in which the degree of opening thereof is adjusted, and the refrigerant pressure in the range from the discharge side of the compressor 21 to the heat-source side expansion valve 26 of the liquid-side refrigerant circuit 11 is increased to the condensation pressure of the refrigerant. Specifically, the refrigerant pressure in the main receiver 25 is increased to the condensation pressure of the refrigerant. The saturated gas-liquid multiphase refrigerant that includes the non-condensable gas (specifically, seal gas) remaining in the liquid refrigerant connection pipe 6 and gas refrigerant connection pipe 7 following the release of the seal gas therefore flows into the main receiver 25. The refrigerant that has flowed into the main receiver 25 is separated into a liquid refrigerant and a gas refrigerant that includes non-condensable gas. The gas refrigerant that includes non-condensable gas then collects in the top of the main receiver 25, and the liquid refrigerant is temporarily collected in the main receiver 25 and then discharged from the bottom of the main receiver 25 and transferred to the heat-source side expansion valve 26. This liquid refrigerant transferred to the heat-source side expansion valve 26 is expanded into a two-phase state of gas and liquid, and is transferred to the utilization unit 5 via the non-return valve 24*c* of the bridge circuit 24, the liquid-side gate valve 27, and the liquid refrigerant connection pipe 6. The refrigerant transferred to the utilization unit 5 is caused to exchange heat with the air in the room and evaporated in the utilization-side heat exchanger 51. This evaporated gas refrigerant is again drawn into the compressor 21 via the gas refrigerant connection pipe 7, the gas-side gate valve 28, and the four-way directional valve 22.

During the cooling operation, the discharge of the seal gas as the non-condensable gas from within the refrigerant circuit 10 is performed using the gas separation device 31 according to the following type of procedure. First, the gas refrigerant introduction valve 38*a* is opened, and the gas refrigerant including the non-condensable gas collected in the top of the main receiver 25 is introduced into the secondary receiver 33. The cooling refrigerant return valve 37*a* and the cooling expansion valve 36*a* are then opened, and refrigerant as a cooling source is circulated into the cooler 32 in order to cool the gas refrigerant including the non-condensable gas introduced into the secondary receiver 33. The gas refrigerant including the non-condensable gas thus introduced into the secondary receiver 33 is then cooled by the refrigerant flowing through the cooler 32, a portion thereof is condensed, and the refrigerant flowing through the cooler 32 is evaporated. At this time, since the non-condensable gas has a low condensation temperature (specifically, boiling point) compared to the gas refrigerant, the non-condensable gas is collected at the top of the secondary receiver 33 as a result of the virtual lack of condensation thereof, and the concentration of the non-condensable gas in the gas refrigerant collected in the top of the secondary receiver 33 increases. On the other hand, the refrigerant condensed in the secondary receiver 33 collects in the bottom of the secondary receiver 33, but is again returned to the main receiver 25 by opening the liquid refrigerant outflow valve 39*a*. Due to cooling by the cooler 32, the temperature of the liquid refrigerant returned to the main receiver 25 from the secondary receiver 33 herein is lower than the refrigerant temperature in the main receiver 25. Therefore, this contributes to cooling the refrigerant in the main receiver 25 and increasing the concentration of the non-condensable gas in the top of the main receiver 25. The evaporated refrigerant as a cooling source caused to exchange heat with the gas refrigerant that includes the non-condensable gas is returned to the intake side of the compressor 21.

The discharge valve 34*c* of the separation membrane device 34 is then opened, and the space $S_2$ of the separation membrane device 34 is opened to the outside. Since the space $S_1$ of the separation membrane device 34 is then communicated with the top of the secondary receiver 33, the gas refrigerant (fed gas) including the non-condensable gas collected in the top of the secondary receiver 33 is introduced into the space $S_1$, and a pressure difference corresponding to the difference between the condensation pressure of the refrigerant and the atmospheric pressure is established between the space $S_1$ and the space $S_2$. The non-condensable gas included in the fed gas inside the space $S_1$ is therefore forced through the separation membrane 34*b* by this pressure difference, caused to flow toward the space $S_2$, and is released into the atmosphere through the discharge valve 34*c*. On the other hand, the gas refrigerant included in the fed gas collects in the space $S_1$ without passing through the separation membrane 34*b*. Once this operation has been performed for a prescribed time, the non-condensable gas remaining in the liquid refrigerant connection pipe 6 and gas refrigerant connection pipe 7 is discharged from the refrigerant circuit 10. The non-condensable gas is discharged from the refrigerant circuit 10, and the cooling expansion valve 36*a*, cooling refrigerant return valve 37*a*, gas refrigerant introduction valve 38*a*, liquid refrigerant outflow valve 39*a*, and discharge valve 34*c* constituting the gas separation device 31 are then closed.

(Case in which the Non-Condensable Gas is Discharged During Heating Operation)

A case will next be described in which the operation for recirculating refrigerant in the refrigerant circuit 10 is performed by the heating operation. At this time, the four-way directional valve 22 is in the state indicated by the dashed line in FIG. 1; specifically, a state in which the discharge side of the compressor 21 is connected to the gas-side gate valve 28, and the intake side of the compressor 21 is connected to the gas side of the heat-source-side heat exchanger 23. The heat-source side expansion valve 26 is in a state in which the degree of opening thereof is adjusted. A state is also established in which the cooling expansion valve 36*a*, cooling refrigerant return valve 37*a*, gas refrigerant introduction valve 38*a*, liquid refrigerant outflow valve 39*a*, and discharge valve 34*c* constituting the gas separation device 31 are all closed, and the gas separation device 31 is not in use.

When the compressor 21 is activated in this state of the refrigerant circuit 10 and gas separation device 31, the gas refrigerant is drawn into the compressor 21 and compressed, after which the gas refrigerant is conducted through the four-way directional valve 22 to the utilization unit 5 via the gas-side gate valve 28 and the gas refrigerant connection pipe 7. The refrigerant transferred to the utilization unit 5 is caused to exchange heat with the air in the room and condensed by the utilization-side heat exchanger 51. This condensed liquid refrigerant flows into the main receiver 25 through the liquid refrigerant connection pipe 6, the liquid-side gate valve 27, and the non-return valve 24*b* of the bridge circuit 24. The heat-source side expansion valve 26 connected to the downstream side of the main receiver 25 herein is in a state in which the degree of opening thereof is adjusted, the same as during cooling operation, and the refrigerant pressure in the section from the discharge side of the compressor 21 to the heat-source side expansion valve 26 of the liquid-side refrigerant circuit 11 is increased to the condensation pressure of the refrigerant. Specifically, the refrigerant pressure in the main receiver 25 is increased to the condensation pressure of the refrigerant. The saturated gas-liquid multiphase refrigerant including the non-condensable gas (specifically, seal gas) remaining in the liquid refrigerant connection pipe 6 and gas refrigerant connection pipe 7 following the release of the seal gas therefore flows into the main receiver 25, the same as during cooling operation. The refrigerant that has flowed into the main receiver 25 is separated into a liquid refrigerant and a gas refrigerant that includes non-condensable gas. After the gas refrigerant that includes non-condensable gas is collected in the top of the main receiver 25, and the liquid refrigerant is temporarily collected in the main receiver 25, the liquid refrigerant is discharged from the bottom of the main receiver 25 and transferred to the heat-source side expansion valve 26. This liquid refrigerant thus transferred to the heat-source side expansion valve 26 is expanded into a two-phase state of gas and liquid, and is transferred to the heat-source-side heat exchanger 23 via the non-return valve 24*d* of the bridge circuit 24. The refrigerant transferred to the heat-source-side heat exchanger 23 is caused to exchange heat with air or water as the heat source and evaporated. This evaporated gas refrigerant is again drawn into the compressor 21 via the four-way directional valve 22.

The same operation for discharging non-condensable gas as the one performed during cooling operation can also be performed during heating operation. Since the procedure for this operation is the same as that of the operation described above for discharging non-condensable gas during cooling operation, description thereof is omitted.

3 Features of the Air Conditioning Device and Installation Method Thereof

The air conditioning device 1 and the method for installing the device according to the present embodiment have such characteristics as the following.

A

In the air conditioning device 1, the gas separation device 31 having the separation membrane device 34 is connected to the liquid-side refrigerant circuit 11, and non-condensable gas (specifically, seal gas) remaining in the liquid refrigerant connection pipe 6 and gas refrigerant connection pipe 7 can be discharged to the outside of the refrigerant circuit 10 after the device installation step (refrigerant circuit formation step). Therefore, the size of the gas separation device 31 can be reduced in comparison to the use of a conventional type of gas separation device that requires a large quantity of adsorbent agent. The size of the heat source unit 2 is therefore not increased, and the evacuation operation during on-site installation can be omitted.

B

In the air conditioning device 1, the compressor 21 is operated (specifically, cooling operation or heating operation is performed), and the non-condensable gas remaining in the refrigerant connection pipes 6 and 7 is recirculated together with the refrigerant in the refrigerant circuit 10 in the non-condensable gas discharge step after the heat source unit 2 is connected to the utilization unit 5 via the refrigerant connection pipes 6 and 7 in the device installation step (refrigerant circuit formation step). By this configuration, the pressure of the refrigerant and non-condensable gas that flow between the heat-source-side heat exchanger 23 and the utilization-side heat exchanger 51 is increased, the non-condensable gas is separated from the refrigerant that includes this highly pressurized non-condensable gas using the gas separation device 31 having the separation membrane device 34, and the non-condensable gas is discharged to the outside of the refrigerant circuit 10. By this configuration, the pressure difference between the primary side (specifically, the space $S_1$ side) and the secondary side (specifically, the space $S_2$ side) of the separation membrane 34*b* of the separation membrane device 34 can be increased, and the separation efficiency of the non-condensable gas in the separation membrane 34*b* can therefore be enhanced.

In the non-condensable gas discharge step in the air conditioning device 1, at least a portion of the refrigerant that flows between the heat-source-side heat exchanger 23 and the utilization-side heat exchanger 51 (specifically, the gas refrigerant including non-condensable gas collected in the top of the main receiver 25) is cooled by the cooler 32 disposed in the secondary receiver 33 and separated into a liquid refrigerant and a gas refrigerant that includes the non-condensable gas in the secondary receiver 33, and the non-condensable gas is separated using the separation membrane 34*b* of the separation membrane device 34 from the gas refrigerant obtained by gas-liquid separation. By this configuration, the quantity of refrigerant including the non-condensable gas that is processed in the separation membrane 34*b* of the separation membrane device 34 can be reduced by performing gas-liquid separation in the secondary receiver 33, the quantity of gas refrigerant included in the gas phase of the secondary receiver 33 during gas-liquid separation can be reduced by cooling the refrigerant in the cooler 32, and the concentration of the non-condensable gas can be increased. Therefore, the separation efficiency of the non-condensable gas in the separation membrane 34*b* of the separation membrane device 34 can be further enhanced.

C

In the air conditioning device 1, the gas separation device 31 is connected to the main receiver 25 provided to the liquid-side refrigerant circuit 11, and the non-condensable gas can be separated/discharged by the gas separation device 31 after the refrigerant flowing through the liquid-side refrigerant circuit 11 is separated into a liquid refrigerant and a gas refrigerant that includes non-condensable gas, and the amount of gas processed in the gas separation device 31 is reduced. The size of the gas separation device 31 can therefore be reduced.

By reducing the amount of refrigerant including non-condensable gas that is cooled in the cooler 32 constituting the gas separation device 31, the amount of thermal energy needed for cooling the refrigerant in the cooler can also be reduced.

D

Another cooling source is unnecessary in the air conditioning device 1, because the cooler 32 constituting the gas separation device 31 is the heat exchanger which uses as the cooling source the refrigerant (specifically, a portion of the refrigerant temporarily collected in the main receiver 25) that flows through the refrigerant circuit 10.

Since the cooler 32 is a coiled heat transfer tube disposed inside the secondary receiver 33, and is integrally formed with the secondary receiver 33, the number of separate components is reduced, and the structure of the device is simplified.

E

In the air conditioning device 1, the secondary receiver 33 is connected so that the liquid refrigerant that is separated into gas and liquid in the secondary receiver 33 is returned to the main receiver 25. Therefore, the refrigerant in the main receiver 25 is cooled, and the concentration of the non-condensable gas in the top (gas phase) of the main receiver 25 can be increased.

F

In the method for installing the air conditioning device 1, the liquid refrigerant connection pipe 6 and gas refrigerant connection pipe 7 are tested for airtightness using nitrogen gas or another seal gas, and the seal gas is released into the atmosphere. Therefore, the amount of oxygen gas that remains in the liquid refrigerant connection pipe 6 and gas refrigerant connection pipe 7 after these steps can be reduced. The amount of oxygen gas recirculated through the refrigerant circuit 10 together with the refrigerant can thereby be reduced, and the risk of degradation and other adverse effects in the refrigerant or refrigerator oil can be eliminated.

Oxygen gas included in the ambient gas in the airtightness-tested portion can be reliably removed by substituting the ambient gas of the airtightness-tested portion with seal gas during the airtightness testing step or the seal gas releasing step.

4 Modification 1

Figure 3:
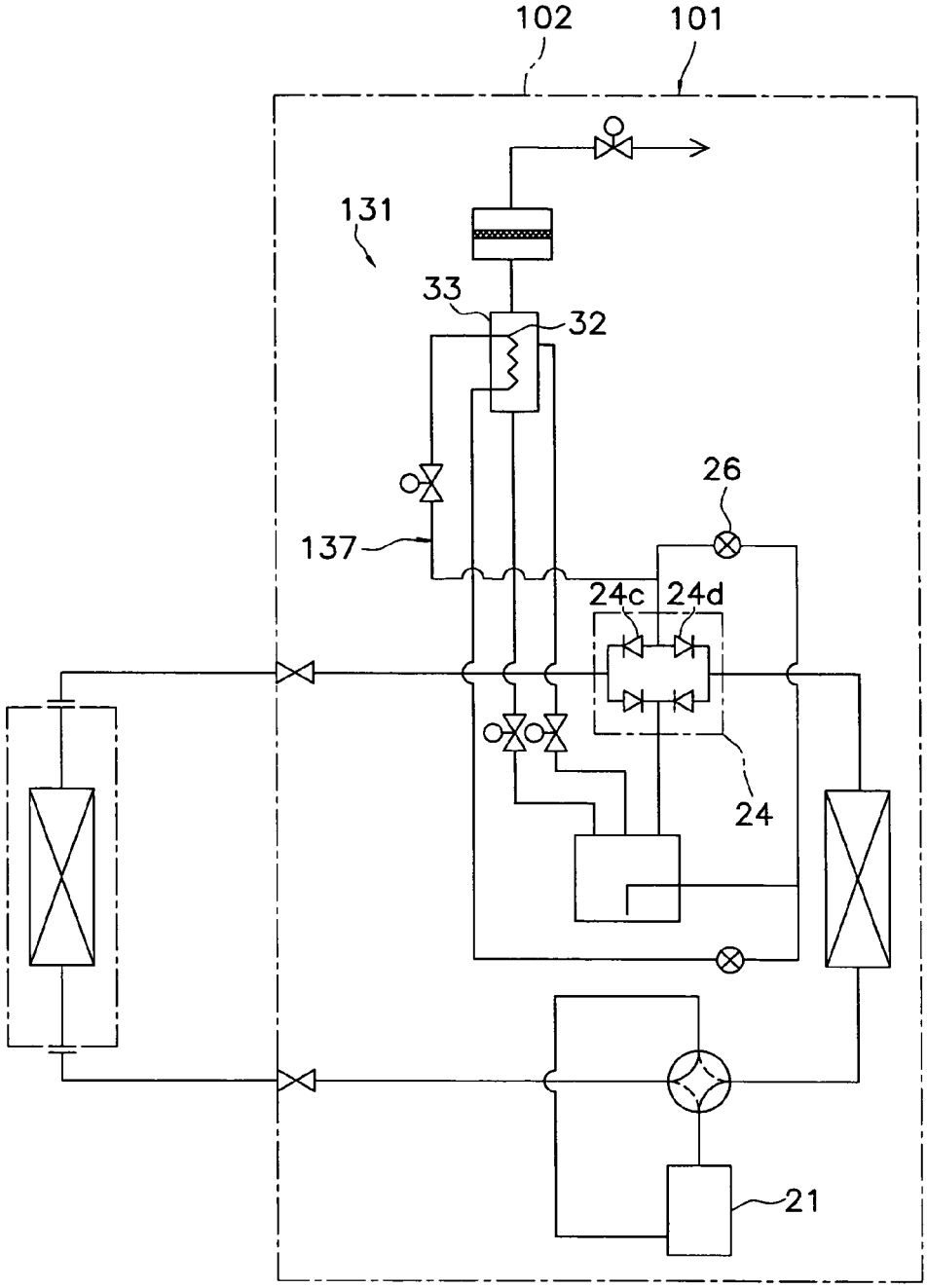
FIG. 3 is a schematic diagram of the refrigerant circuit of an air conditioning device according to modification 1 of the first embodiment.

In the abovementioned gas separation device 31, the cooling refrigerant used to cool the gas refrigerant including non-condensable gas introduced into the secondary receiver 33 in the cooler 32 is returned to the intake side of the compressor 21 via the cooling refrigerant outflow circuit 37 connected between the cooler 32 and the intake side of the compressor 21. However, a cooling refrigerant outflow circuit 137 may also be provided so as to form a connection between the cooler 32 and the downstream side of the heat-source side expansion valve 26 (specifically, between the downstream side of the heat-source side expansion valve 26 and the non-return valves 24*c* and 24*d* of the bridge circuit 24), as in the gas separation device 131 incorporated into the heat source unit 102 of the air conditioning device 101 of the present modification shown in FIG. 3.

5 Modification 2

Figure 4:
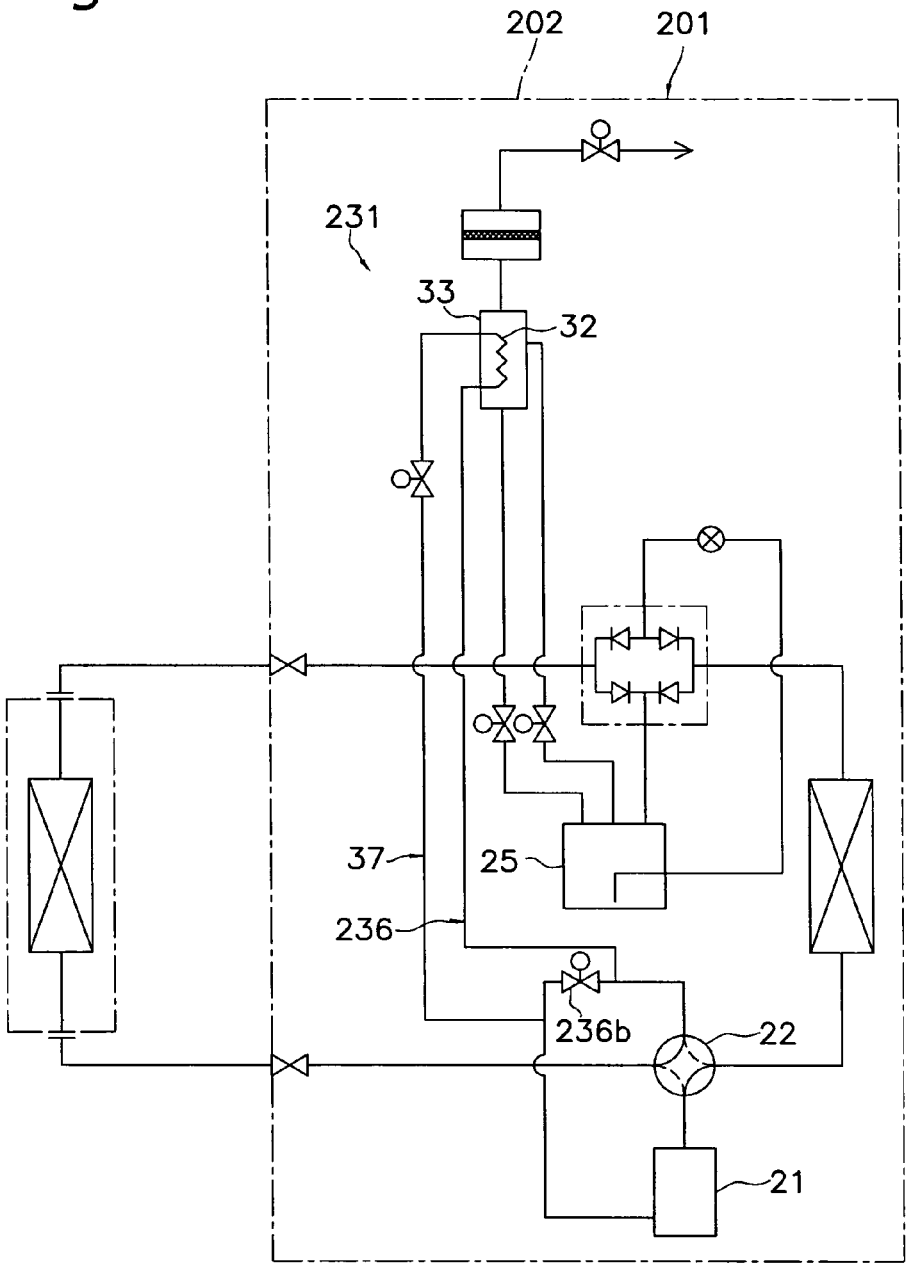
FIG. 4 is a schematic diagram of the refrigerant circuit of an air conditioning device according to modification 2 of the first embodiment.

In the abovementioned gas separation device 31, the liquid refrigerant introduced into the cooler 32 via the cooling refrigerant inflow circuit 36 that connects the exit port of the main receiver 25 and the cooler 32 is used as the cooling refrigerant to cool the gas refrigerant including non-condensable gas introduced into the secondary receiver 33 in the cooler 32. However, a cooling refrigerant inflow circuit 236 may be provided so as to introduce to the cooler 32 the low-pressure gas refrigerant that flows through the intake side of the compressor 21, as in the gas separation device 231 incorporated into the heat source unit 202 of the air conditioning device 201 of the present modification shown in FIG. 4. In these circumstances, a configuration may be adopted whereby the flow rate of the low-pressure gas refrigerant directly returned to the intake side of the compressor 21 from the four-way directional valve 22 is limited during the non-condensable gas discharge step, and the flow rate of the low-pressure gas refrigerant returned to the intake side of the compressor 21 after being introduced into the cooler 32 can be maintained by providing a bypass valve 236*b* for circulating/blocking the low-pressure gas refrigerant flowing through the intake side of the compressor 21 to/from the intake side of the compressor 21. The valve is mounted between the junction with the cooling refrigerant inflow circuit 236 of the intake side conduit of the compressor 21 and the junction with the cooling refrigerant outflow circuit 37.

6 Modification 3

Figure 5:
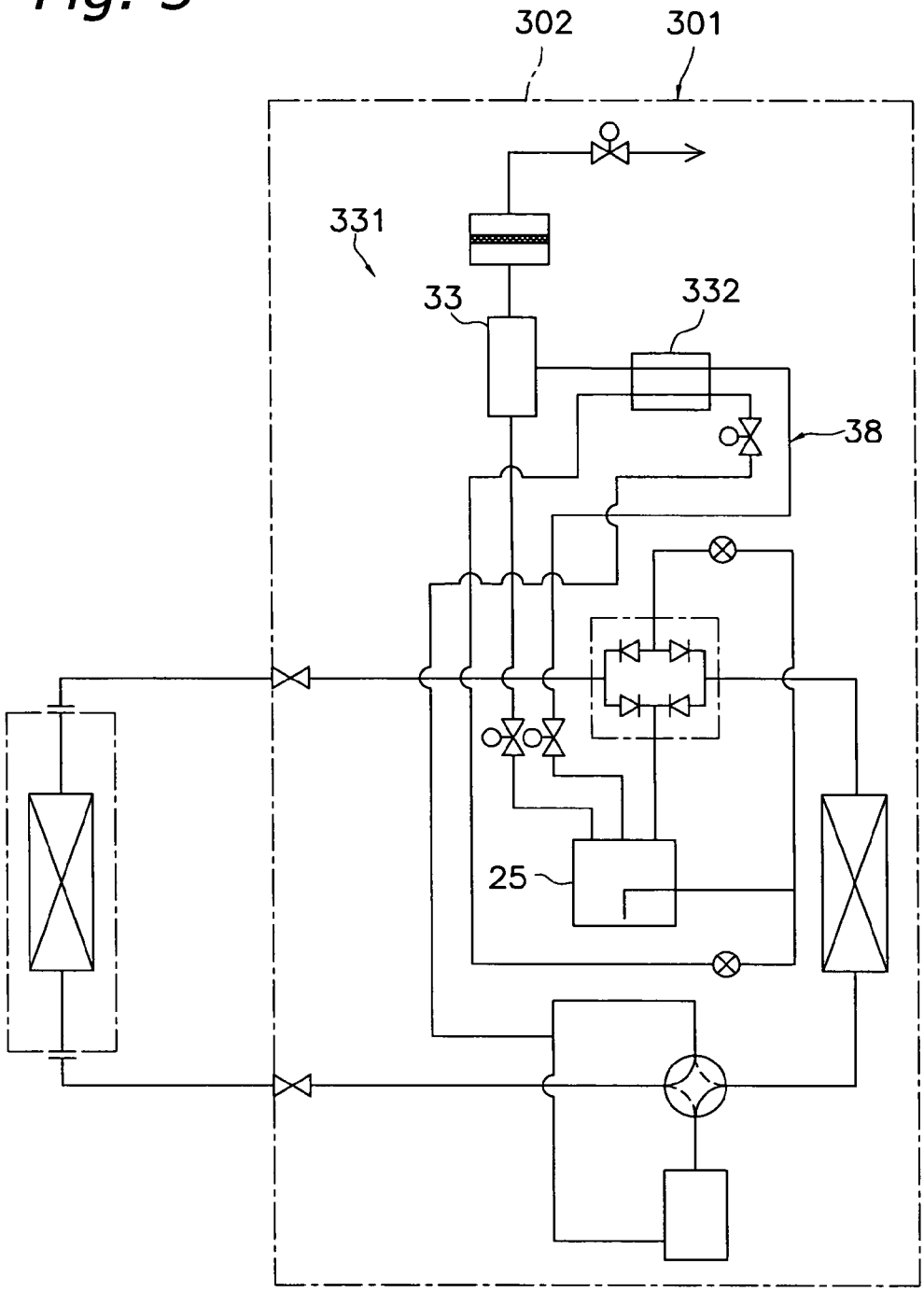
FIG. 5 is a schematic diagram of the refrigerant circuit of an air conditioning device according to modification 3 of the first embodiment.

In the abovementioned gas separation devices 31, 131, and 231, the cooler 32 is a coiled heat transfer tube disposed inside the secondary receiver 33. However, a cooler 332 that is separate from the secondary receiver 33 may also be connected to the gas refrigerant introduction circuit 38 for connecting the secondary receiver 33 to the top of the main receiver 25, as in the gas separation device 331 incorporated into the heat source unit 302 of the air conditioning device 301 of the present modification shown in FIG. 5.

7 Modification 4

Figure 6:
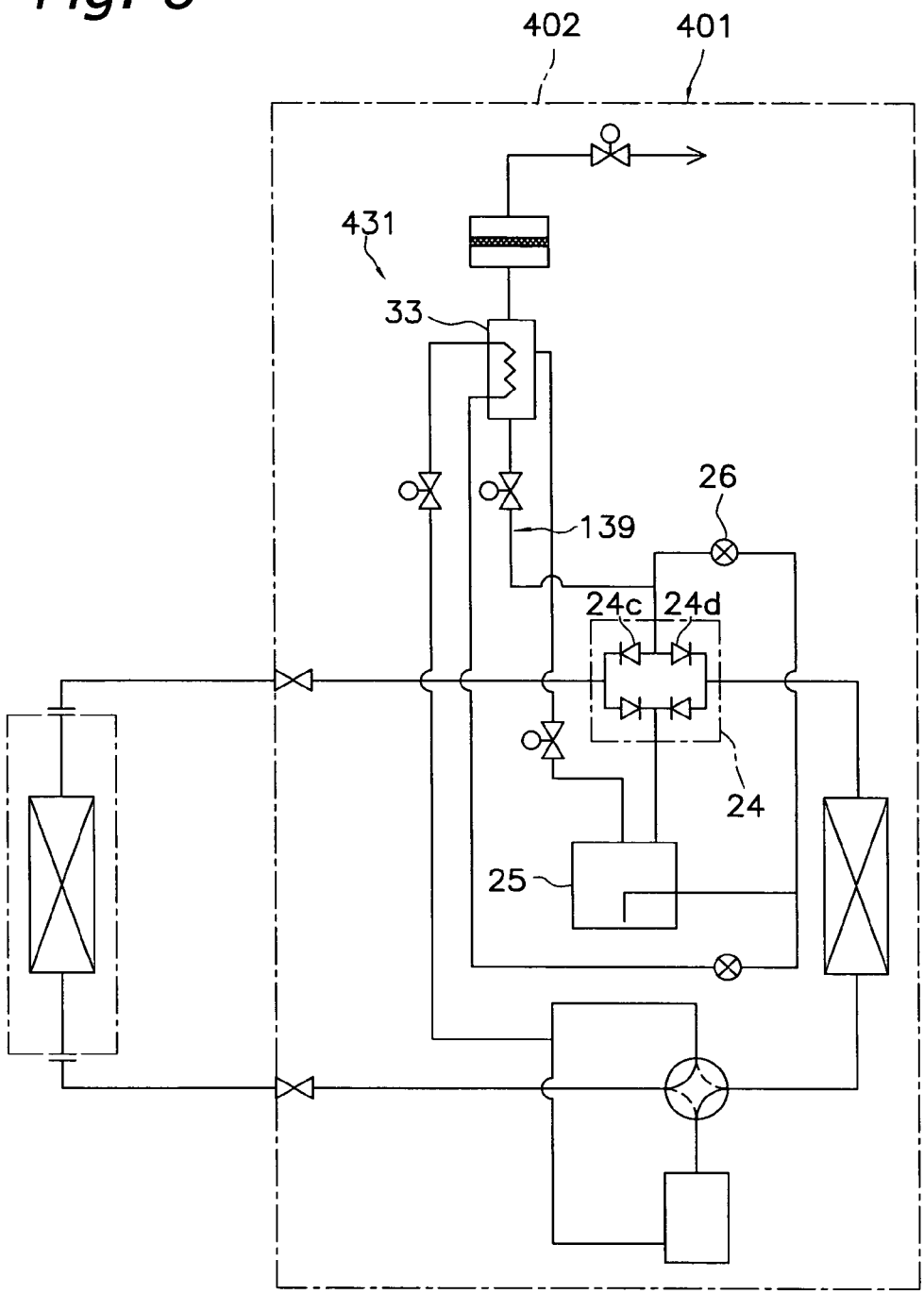
FIG. 6 is a schematic diagram of the refrigerant circuit of an air conditioning device according to modification 4 of the first embodiment.

In the abovementioned gas separation devices 31, 131, 231, and 331, the liquid refrigerant outflow circuit 39 for discharging to the outside of the secondary receiver 33 the liquid refrigerant condensed by the cooler 32 and collected in the bottom of the secondary receiver 33 is connected so as to return the liquid refrigerant to the main receiver 25. However, a liquid refrigerant outflow circuit 439 may also be provided so as to form a connection between the secondary receiver 33 and the downstream side of the heat-source side expansion valve 26 (specifically, between the downstream side of the heat-source side expansion valve 26 and the non-return valves 24*c* and 24*d* of the bridge circuit 24), as in the gas separation device 431 incorporated into the heat source unit 402 of the air conditioning device 401 of the present modification shown in FIG. 6.

8 Modification 5

Figure 7:
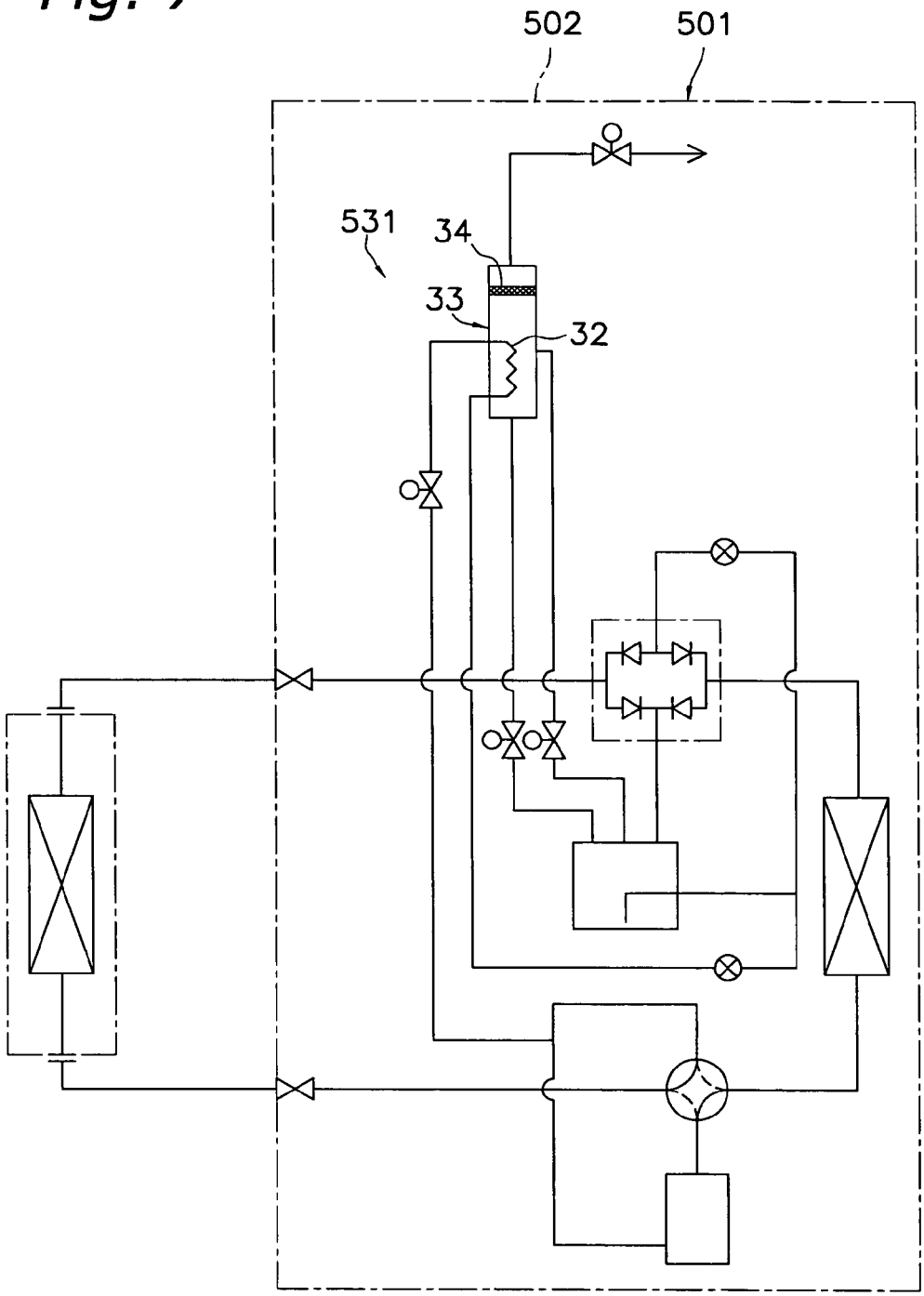
FIG. 7 is a schematic diagram of the refrigerant circuit of an air conditioning device according to modification 5 of the first embodiment.

In the abovementioned gas separation devices 31, 131, 231, and 431, the secondary receiver 33 having the cooler 32 disposed in the interior thereof is connected to the separation membrane device 34 via the separation membrane introduction circuit 40. However, the separation membrane device 34 may also be integrally formed with the secondary receiver 33 having the cooler 32 disposed in the interior thereof, as in the gas separation device 531 incorporated into the heat source unit 502 of the air conditioning device 501 of the present modification shown in FIG. 7. The number of separate components constituting the gas separation device 531 is thereby reduced, and the structure of the device is simplified.

9 Modification 6

Figure 8:
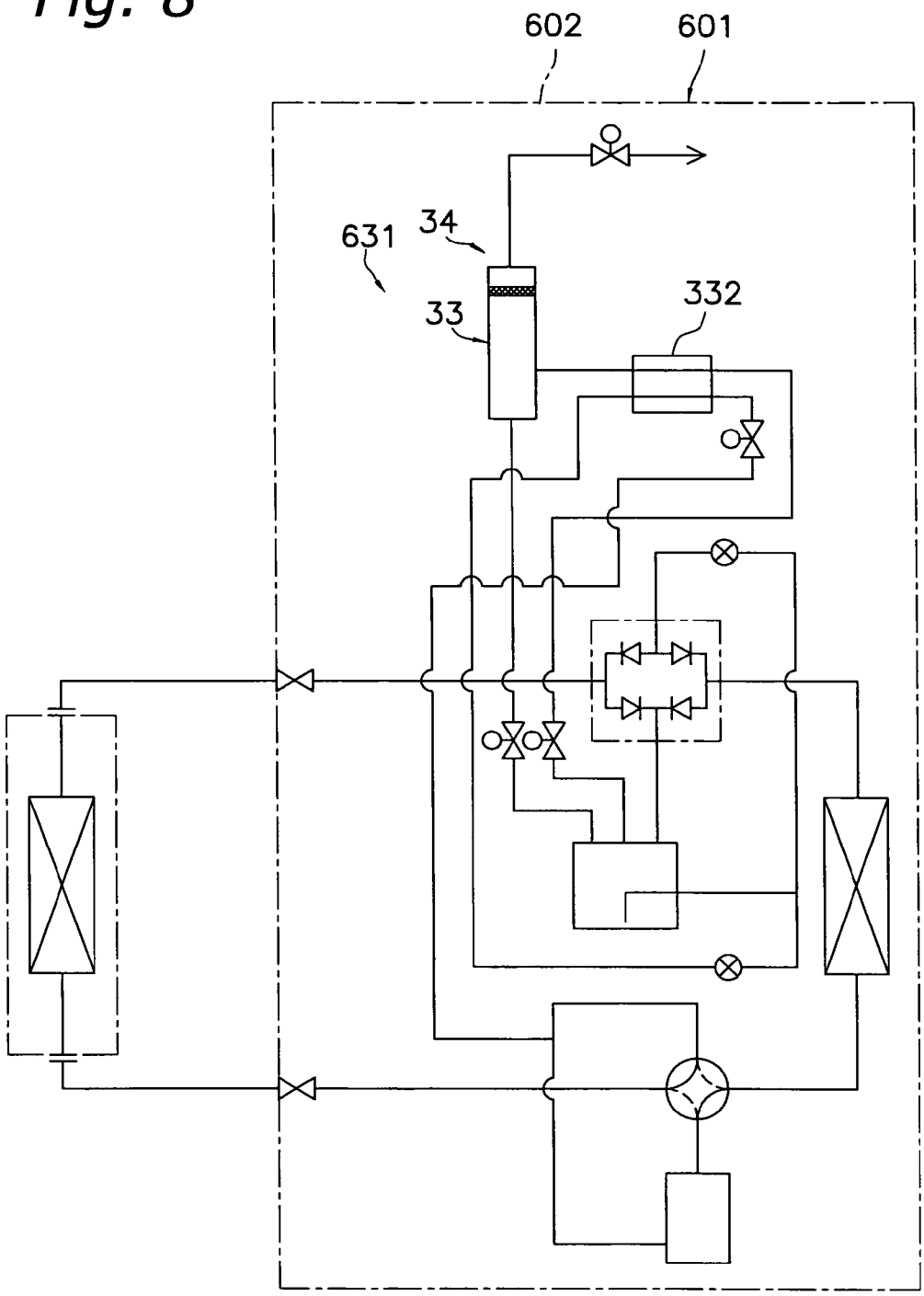
FIG. 8 is a schematic diagram of the refrigerant circuit of an air conditioning device according to modification 6 of the first embodiment.

In a gas separation device in which a cooler 332 is provided to the outside of the secondary receiver 33 as in the abovementioned gas separation device 331, the separation membrane device 34 and the secondary receiver 33 may also be integrally formed as in the gas separation device 631 incorporated into the heat source unit 602 of the air conditioning device 601 of the present modification shown in FIG. 8. The number of separate components constituting the gas separation device 631 is thereby reduced, and the structure of the device is simplified.

10 Modification 7

Figure 9:
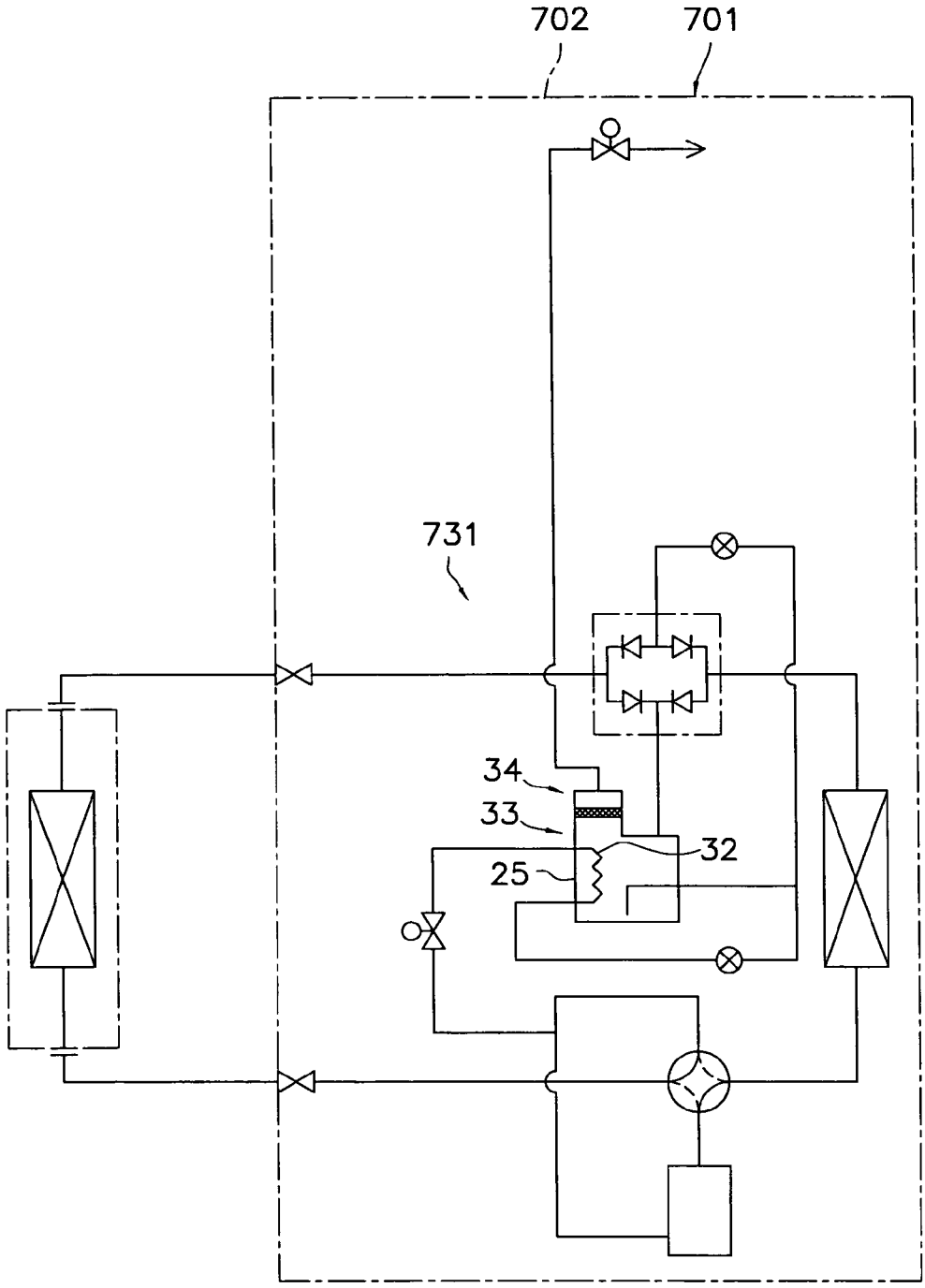
FIG. 9 is a schematic diagram of the refrigerant circuit of an air conditioning device according to modification 7 of the first embodiment.

In the abovementioned gas separation devices 31, 131, 231, 331, 431, 531, and 631, the secondary receiver 33 is connected to the main receiver 25 via the gas refrigerant introduction circuit 38, but the secondary receiver 33 may also be integrally formed with the main receiver 25, as in the gas separation device 731 incorporated into the heat source unit 702 of the air conditioning device 701 of the present modification shown in FIG. 9. Under these circumstances, the cooler 32 may be disposed inside the secondary receiver 33 and main receiver 25, as shown in FIG. 9. The number of separate components constituting the gas separation device 731 is thereby reduced, and the structure of the device is simplified.

11 Modification 8

Figure 10:
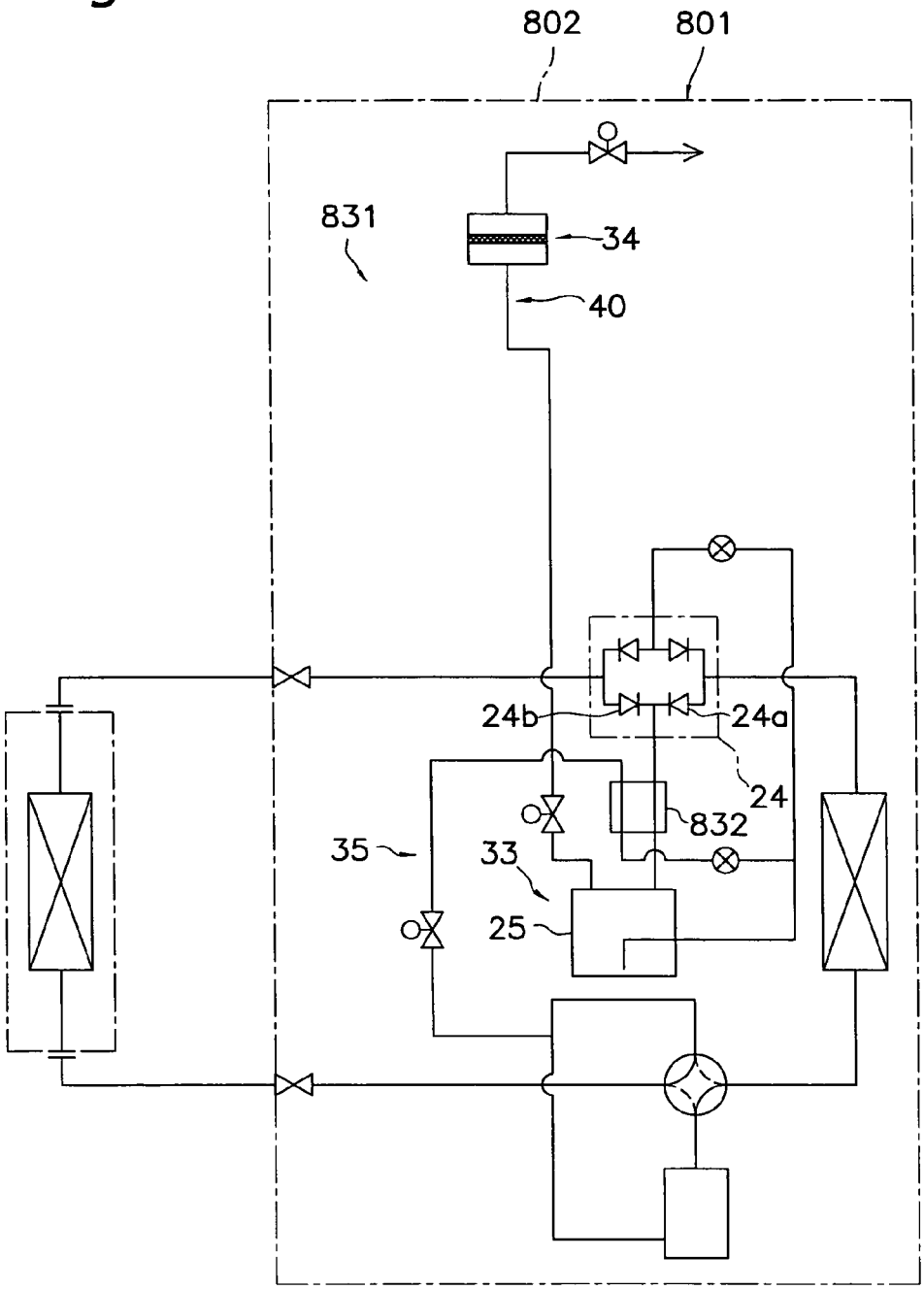
FIG. 10 is a schematic diagram of the refrigerant circuit of an air conditioning device according to modification 8 of the first embodiment.

In the abovementioned gas separation devices 31, 131, 231, 331, 431, 531, 631, and 731, the coolers 32 and 332 are mainly provided so as to cool the gas refrigerant including the non-condensable gas collected in the top of the main receiver 25. However, a cooler 832 for supercooling the liquid refrigerant that flows into the main receiver 25 may be connected between the non-return valves 24*a* and 24*b* of the bridge circuit 24 and the entrance port of the main receiver 25, as in the gas separation device 831 housed in the heat source unit 802 of the air conditioning device 801 of the present modification shown in FIG. 10. In this case, since all of the refrigerant flowing through the liquid-side refrigerant circuit 11 is cooled rather than a portion thereof, the amount of cooling refrigerant flowing through the cooling refrigerant circuit 35 as the cooling source increases. However, since the concentration of the non-condensable gas included in the gas refrigerant can be increased by separating the refrigerant into a liquid refrigerant and a gas refrigerant that includes non-condensable gas in the main receiver 25, the effect obtained is the same as if the secondary receiver 33 were integrally formed with the main receiver 25, and gas refrigerant having an increased concentration of non-condensable gas can be fed to the separation membrane device 34 from the top of the main receiver 25 via the separation membrane introduction circuit 40.

The separation membrane device 34 and the main receiver 25 may be integrally formed in the gas separation device 831 of the present modification, the same as in the gas separation device 731 described above.

12 Other Modifications

In the abovementioned gas separation devices 31, 131, 331, 431, 531, 631, 731, and 831, a configuration may be adopted whereby a capillary tube is used instead of the cooling expansion valve 36*a* provided to the cooling refrigerant inflow circuit 36 of the cooling refrigerant circuit 35 as the cooling source, and a portion of the refrigerant that flows out from the exit port of the main receiver 25 is expanded.

Second Embodiment

1 Structure of the Air Conditioning Device

Figure 11:
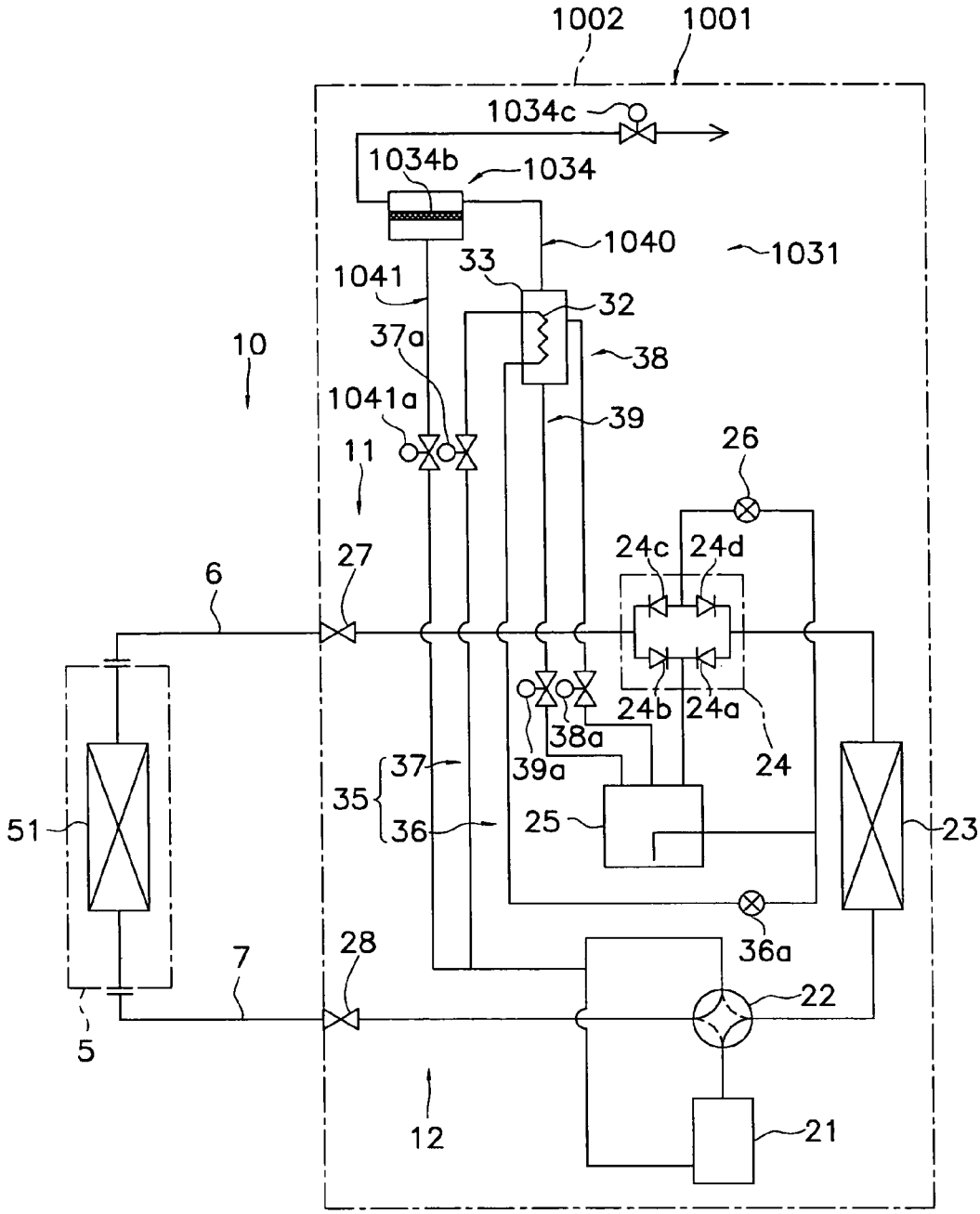
FIG. 11 is a schematic diagram of the refrigerant circuit of an air conditioning device as an example of a refrigeration device according to a second embodiment of the present invention.

FIG. 11 is a schematic diagram of the refrigerant circuit of the air conditioning device 1001 as an example of the refrigeration device according to a second embodiment of the present invention. The air conditioning device 1001 in the present embodiment is an air conditioning device capable of cooling operation and heating operation, the same as the air conditioning device 1 of the first embodiment, and is provided with a heat source unit 1002, a utilization unit 5, and a liquid refrigerant connection pipe 6 and gas refrigerant connection pipe 7 for connecting the heat source unit 1002 with the utilization unit 1005. Since the structure of the air conditioning device 1001 of the present embodiment except for the gas separation device 1031 is the same as that of the air conditioning device 1 of the first embodiment, description thereof is omitted.

The gas separation device 1031 in the present embodiment is primarily composed of a cooler 32, a secondary receiver 33, and a separation membrane device 1034. Since the cooler 32 and the secondary receiver 33 herein are the same as the cooler 32 and secondary receiver 33 constituting the gas separation device of the first embodiment, description thereof is omitted.

Figure 12:
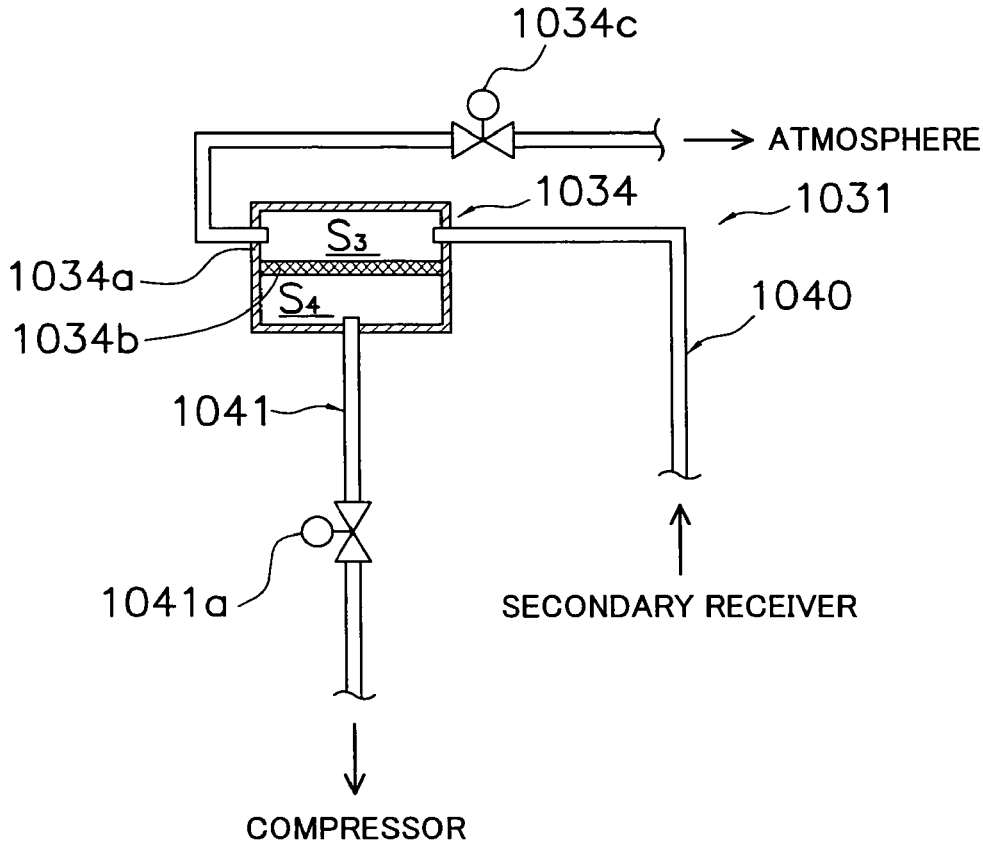
FIG. 12 is a diagram showing the overall structure of a separation membrane device of the air conditioning device according to the second embodiment.

The separation membrane device 1034 is a device for separating the non-condensable gas from the gas refrigerant obtained by gas-liquid separation using the secondary receiver 33, and discharging the separated non-condensable gas to the outside of the refrigerant circuit 10, the same as the separation membrane device 34 of the first embodiment. The separation membrane device 1034 is configured so that the gas refrigerant including the non-condensable gas collected in the top of the secondary receiver 33 is introduced via a separation membrane introduction circuit 1040 connected to the top of the secondary receiver 33, the same as the separation membrane device 34 of the first embodiment. As shown in FIG. 12, the separation membrane device 1034 in the present embodiment has a device main body 1034*a*, a separation membrane 1034*b* disposed so as to divide the space inside the device main body 1034*a* into a space $S_4$ (secondary side) and a space $S_3$ (primary side) communicated with the separation membrane introduction circuit 1040, a discharge valve 1034*c* connected to the space $S_3$, and a gas refrigerant outflow circuit 41 connected to the space $S_4$. In the present embodiment, a membrane that is capable of selectively transmitting the gas refrigerant from the gas refrigerant that includes the non-condensable gas is used for the separation membrane 1034*b*. This type of separation membrane uses a nonporous membrane composed of a polysulfone membrane, a silicone rubber membrane, or the like. The term "nonporous membrane" used herein refers to a homogenous membrane that does not have a large number of extremely minute micropores, such as those possessed by a porous membrane, and that performs separation according to the difference in the rate at which gas permeates the membrane via the process of dissolution, diffusion, and desolubilization. Specifically, the membrane is permeable to high-boiling components having high solubility in the membrane, and is impermeable to low-boiling components having little solubility in the membrane. In this arrangement, the R22 or R134a used as the refrigerant of the air conditioning device, and the R32 or R125 included in the mixed refrigerant R407C or R410A each have a higher boiling point than water vapor, oxygen gas, or nitrogen gas, and can therefore be separated by this nonporous membrane. The separation membrane 1034*b* therefore selectively transmits the gas refrigerant from the gas refrigerant that includes the non-condensable gas (specifically, the fed gas that is a gas mixture of the gas refrigerant and non-condensable gas collected in the top of the secondary receiver 33), and the gas refrigerant can be caused to flow from the space $S_3$ to the space $S_4$. A gas refrigerant outflow circuit 1041 is provided so as to connect the space $S_4$ of the separation membrane device 1034 and the intake side of the compressor 21, and has a gas refrigerant return valve 1041*a* for circulating/blocking the gas refrigerant transmitted through the separation membrane 1034*b* and returned to the refrigerant circuit 10. Since the gas refrigerant outflow circuit 1041 in this arrangement is provided so that the gas refrigerant is returned to the intake side of the compressor 21 having the lowest refrigerant pressure in the refrigerant circuit 10, the pressure difference between the space $S_3$ and the space $S_4$ can be increased. The discharge valve 1034*c* is capable of releasing into the atmosphere the non-condensable gas remaining in the space $S_3$ and discharging the non-condensable gas to the outside of the refrigerant circuit 10 by transmitting the gas refrigerant in the separation membrane 1034*b*.

2 Method for Installing the Air Conditioning Device

The method for installing the air conditioning device 1001 will next be described. Since the implementation procedure except for the non-condensable gas discharge step is the same as in the method for installing the air conditioning device 1 of the first embodiment, description thereof is omitted.

Non-Condensable Gas Discharge Step

After the seal gas is released, the liquid-side gate valve 27 and gas-side gate valve 28 of the heat source unit 1002 are opened, and a state is established in which the refrigerant circuit of the utilization unit 5 and the refrigerant circuit of the heat source unit 1002 are connected. The refrigerant charged in advance into the heat source unit 1002 is thereby fed to the entire refrigerant circuit 10. When the necessary refrigerant charge quantity is not obtained using only the quantity of refrigerant charged in advance into the heat source unit 1002, such as when the refrigerant connection pipes 6 and 7 are long, additional refrigerant is charged from the outside as needed. The entire necessary quantity of refrigerant is charged from the outside when refrigerant is not charged in advance into the heat source unit 1002. The seal gas (also including non-condensable gas remaining in the utilization unit 5 when the utilization unit 5 is tested for airtightness simultaneously) as the non-condensable gas remaining in the refrigerant connection pipes 6 and 7 following the seal gas releasing step is thereby mixed with the refrigerant inside the refrigerant circuit 10.

In this circuit structure, the compressor 21 is activated, and operation is performed for recirculating the refrigerant in the refrigerant circuit 10.

(Case in which the Non-Condensable Gas is Discharged During Cooling Operation)

A case will first be described in which the operation for recirculating refrigerant in the refrigerant circuit 10 is performed by the cooling operation. At this time, the four-way directional valve 22 is in the state indicated by the solid line in FIG. 11; specifically, a state in which the discharge side of the compressor 21 is connected to the gas side of the heat-source-side heat exchanger 23, and the intake side of the compressor 21 is connected to the gas-side gate valve 28. The heat-source side expansion valve 26 is in a state in which the degree of opening thereof is adjusted. A state is also established in which the cooling expansion valve 36*a*, cooling refrigerant return valve 37*a*, gas refrigerant introduction valve 38*a*, liquid refrigerant outflow valve 39*a*, gas refrigerant return valve 1041*a*, and discharge valve 1034*c* constituting the gas separation device 1031 are all closed, and the gas separation device 1031 is not in use.

When the compressor 21 is activated in this state of the refrigerant circuit 10 and gas separation device 1031, the same operation as the cooling operation is performed in the same manner as in the first embodiment. Since the operation of the refrigerant circuit 10 is the same as in the first embodiment, description thereof is omitted.

The operation for discharging the non-condensable gas from the refrigerant circuit 10 using the gas separation device 1031 will next be described. Since the operation for increasing the concentration of the non-condensable gas in the gas refrigerant in the top of the secondary receiver 33 is the same as in the first embodiment, description thereof is omitted. The operation in the separation membrane device 1034 is described below.

Following the operation described above, the gas refrigerant return valve 1041*a* of the separation membrane device 1034 is opened, and the refrigerant pressure inside the space $S_4$ of the separation membrane device 1034 is equalized with the pressure of the refrigerant flowing through the intake side of the compressor 21. Since the space $S_3$ of the separation membrane device 1034 is then communicated with the top of the secondary receiver 33, the gas refrigerant (fed gas) including the non-condensable gas collected in the top of the secondary receiver 33 is introduced into the space $S_3$, and a pressure difference corresponding to the difference between the condensation pressure of the refrigerant and the pressure of the intake side of the compressor 21 occurs between the space $S_3$ and the space $S_4$. The gas refrigerant included in the fed gas collected in the space $S_3$ is therefore forced through the separation membrane 1034*b* by this pressure difference, is caused to flow toward the space $S_4$, and is returned to the intake side of the compressor 21 through the gas refrigerant return valve 1041*a*. The non-condensable gas (impermeable gas) remaining in the space $S_3$ after passing through the separation membrane 1034*b* and flowing to the side of the space $S_4$ is released into the atmosphere by opening the discharge valve 1034*c*. Once this operation has been performed for a prescribed time, the non-condensable gas remaining in the liquid refrigerant connection pipe 6 and gas refrigerant connection pipe 7 is discharged from the refrigerant circuit 10. The non-condensable gas is discharged from the refrigerant circuit 10, and the cooling expansion valve 36*a*, cooling refrigerant return valve 37*a*, gas refrigerant introduction valve 38*a*, liquid refrigerant outflow valve 39*a*, gas refrigerant return valve

1041*a*, and discharge valve 1034*c* constituting the gas separation device 1031 are then closed.

(Case in which the Non-Condensable Gas is Discharged During Heating Operation)

A case will next be described in which the operation for recirculating refrigerant in the refrigerant circuit 10 is performed by the heating operation. At this time, the four-way directional valve 22 is in the state indicated by the dashed line in FIG. 11; specifically, a state in which the discharge side of the compressor 21 is connected to the gas-side gate valve 28, and the intake side of the compressor 21 is connected to the gas side of the heat-source-side heat exchanger 23. The heat-source side expansion valve 26 is in a state in which the degree of opening thereof is adjusted. A state is also established in which the cooling expansion valve 36*a*, cooling refrigerant return valve 37*a*, gas refrigerant introduction valve 38*a*, liquid refrigerant outflow valve 39*a*, gas refrigerant return valve 1041*a*, and discharge valve 1034*c* constituting the gas separation device 1031 are all closed, and the gas separation device 1031 is not in use.

When the compressor 21 is activated in this state of the refrigerant circuit 10 and gas separation device 1031, the heating operation is performed in the same manner as in the first embodiment. Since the operation of the gas separation device 1031 is the same as the operation for discharging the non-condensable gas in the cooling operation, description thereof is omitted.

3 Features of the Air Conditioning Device and Installation Method Thereof

The air conditioning device 1001 of the present embodiment differs in constitution from the air conditioning device 1 of the first embodiment in that a nonporous membrane is employed as the membrane for selectively transmitting refrigerant in the separation membrane 1034*b* constituting the separation membrane device 1034, but has the same characteristic features as those enumerated in the air conditioning device 1 and installation method thereof of the first embodiment.

4 Modification

Figure 13:
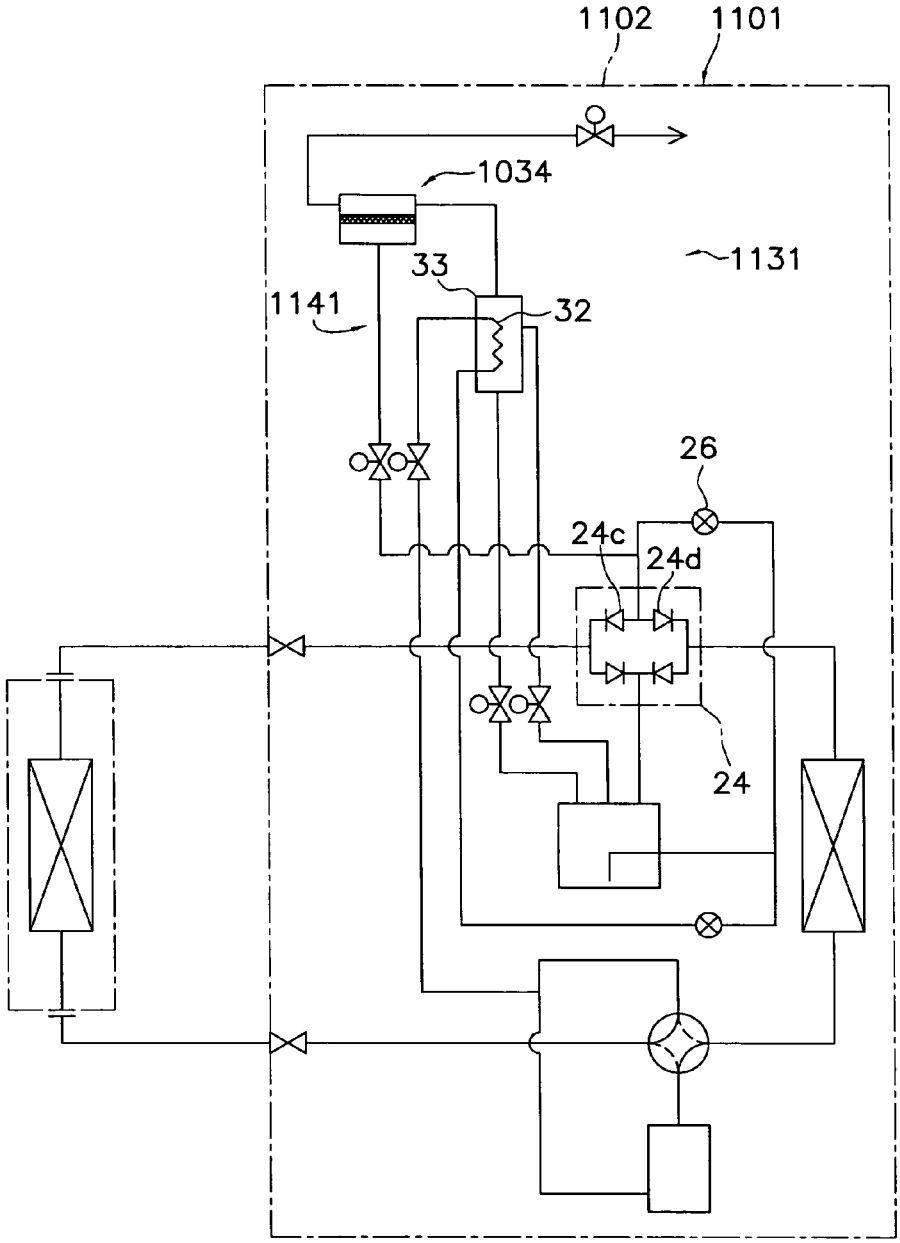
FIG. 13 is a schematic diagram of the refrigerant circuit of an air conditioning device according to a modification of the second embodiment.

The gas separation device 1031 described above is configured so that the gas refrigerant separated in the separation membrane device 1034 is returned to the intake side of the compressor 21 via the gas refrigerant outflow circuit 1041. However, a gas refrigerant outflow circuit 1141 may also be provided so as to form a connection between the separation membrane device 1034 and the downstream side of the heat-source side expansion valve 26 (specifically, between the downstream side of the heat-source side expansion valve 26 and the non-return valves 24*c* and 24*d* of the bridge circuit 24), as in the gas separation device 1131 incorporated into the heat source unit 1102 of the air conditioning device 1101 of the present modification shown in FIG. 13.

5 Other Modifications

The same configurations as those of the cooler, the secondary receiver, the primary receiver, and peripheral circuits used in the gas separation devices 131, 231, 331, 431, 531, 631, 731, and 831 in the modifications of the first embodiment may be employed in the abovementioned gas separation devices 1031 and 1131.

Third Embodiment

1 Structure and Features of the Air Conditioning Device

Figure 14:
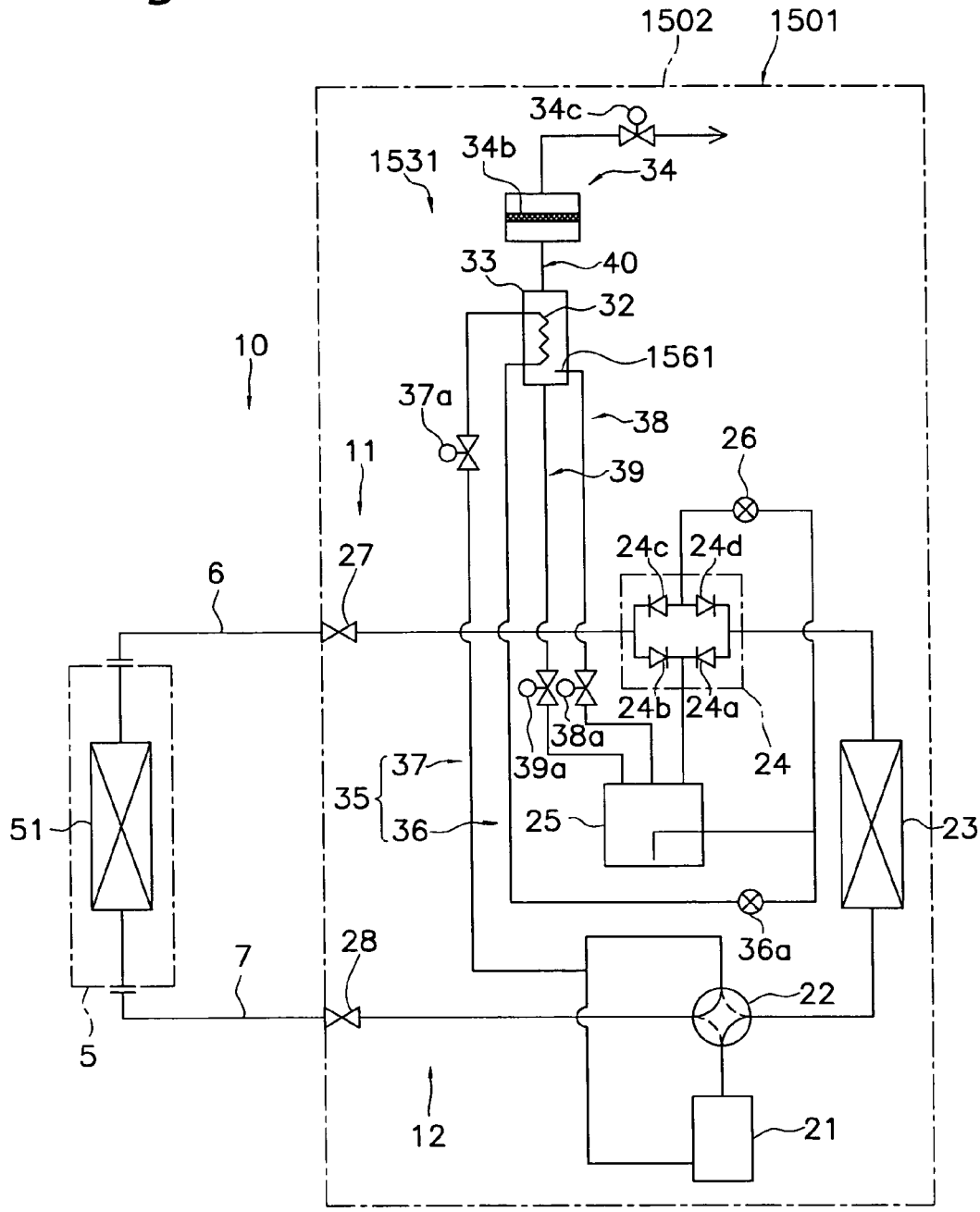
FIG. 14 is a schematic diagram of the refrigerant circuit of the air conditioning device as an example of a refrigeration device according to a third embodiment of the present invention.

FIG. 14 is a schematic diagram of the refrigerant circuit of the air conditioning device 1501 as an example of the refrigeration device according to a third embodiment of the present invention. The air conditioning device 1501 in the present embodiment is an air conditioning device capable of cooling operation and heating operation, the same as the air conditioning device 1 of the first embodiment, and is provided with a heat source unit 1502, a utilization unit 5, and a liquid refrigerant connection pipe 6 and gas refrigerant connection pipe 7 for connecting the heat source unit 1502 and the utilization unit 5. Since the structure of the air conditioning device 1501 of the present embodiment except for the gas separation device 1531 is the same as that of the air conditioning device 1 of the first embodiment, description thereof is omitted.

The gas separation device 1531 in the present embodiment is primarily composed of the cooler 32, the secondary receiver 33, the separation membrane device 34, and an oil scattering prevention device 1561. Since the cooler 32 and separation membrane device 34 herein are the same as the cooler 32, secondary receiver 33, and separation membrane device 34 constituting the gas separation device of the first embodiment, description thereof is omitted.

Figure 15:
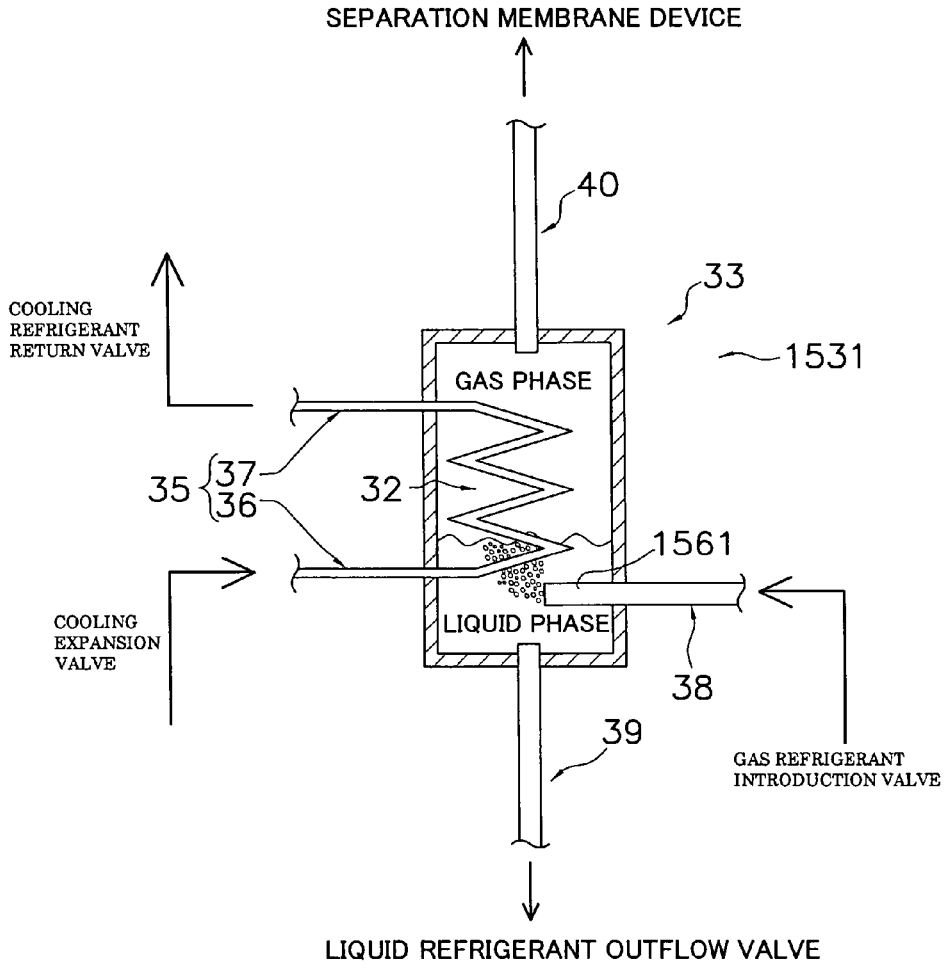
FIG. 15 is a diagram showing the overall structure of a secondary receiver of the air conditioning device according to the third embodiment.

The oil scattering prevention device 1561 is a device for preventing refrigerator oil from scattering into the gas refrigerant fed to the separation membrane device 34. The oil scattering prevention device 1561 in the present embodiment is an inflow pipe provided so as to cause the gas refrigerant including the non-condensable gas that flows into the secondary receiver 33 from the main receiver 25 via the gas refrigerant introduction circuit 38 to flow into the liquid refrigerant collected in the secondary receiver 33, as shown in FIG. 15.

By providing this type of oil scattering prevention device 1561, it becomes possible to perform bubbling of the mixed gas that includes the influxed gas refrigerant and the non-condensable gas so that the refrigerator oil included in the influxed gas mixture is trapped in the liquid refrigerant when the gas refrigerant including non-condensable gas is caused to flow into the secondary receiver 33 from the top of the main receiver 25, and to prevent the refrigerator oil from scattering into the gas refrigerant that includes non-condensable gas fed to the separation membrane device 34.

The air conditioning device 1501 of the present embodiment thereby has the same characteristics as the air conditioning device 1 and installation method thereof of the first embodiment. It becomes possible to prevent reduction of separation performance due to contamination of the separation membrane 34*b* of the separation membrane device 34, and inhibition of the separation operation and reduction in the separation performance of the separation membrane 34*b* can be minimized during the operation for recirculating the refrigerant in the refrigerant circuit 10.

2 Modification 1

Figure 16:
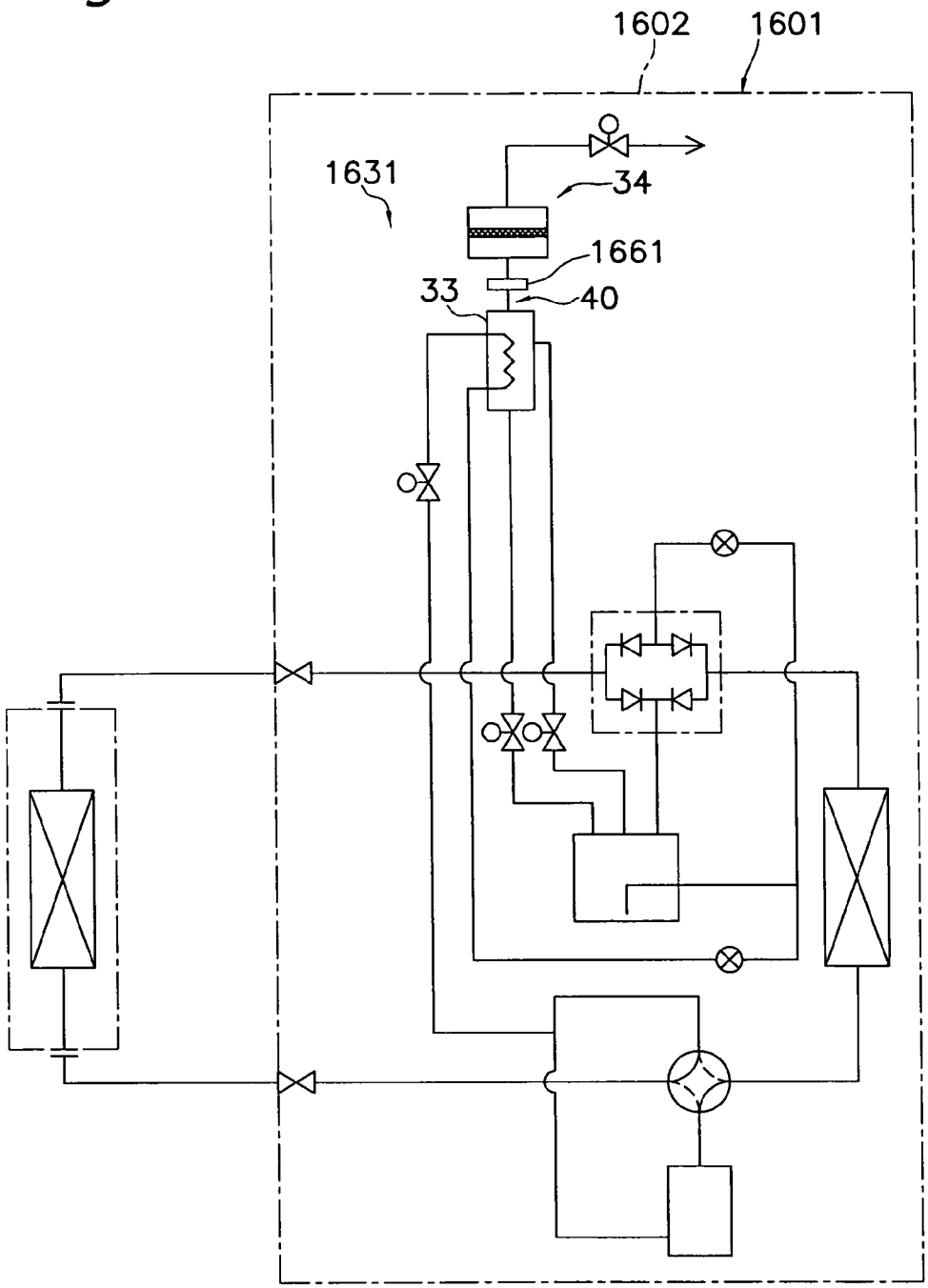
FIG. 16 is a schematic diagram of the refrigerant circuit of an air conditioning device according to modification 1 of the third embodiment.

In the gas separation device 1531 described above, an inflow pipe is employed as the oil scattering prevention device 1561 that is provided so as to cause the gas refrigerant including the non-condensable gas that flows into the secondary receiver 33 from the main receiver 25 via the gas refrigerant introduction circuit 38 to flow into the liquid refrigerant collected in the secondary receiver 33. However, a configuration may be adopted whereby a filter for removing refrigerator oil that accompanies the gas refrigerant including non-condensable gas that is subjected to gas-liquid separation by the secondary receiver 33 and fed to the separation membrane device 34 is provided as an oil scattering prevention device 1661 to the separation membrane introduction circuit 40, and the refrigerator oil in the gas refrigerant fed to the separation membrane device 34 is prevented from scattering, as in the gas separation device 1631 incorporated into the heat source unit 1602 of the air conditioning device 1601 of the present modification shown in FIG. 16.

3 Modification 2

Figure 17:
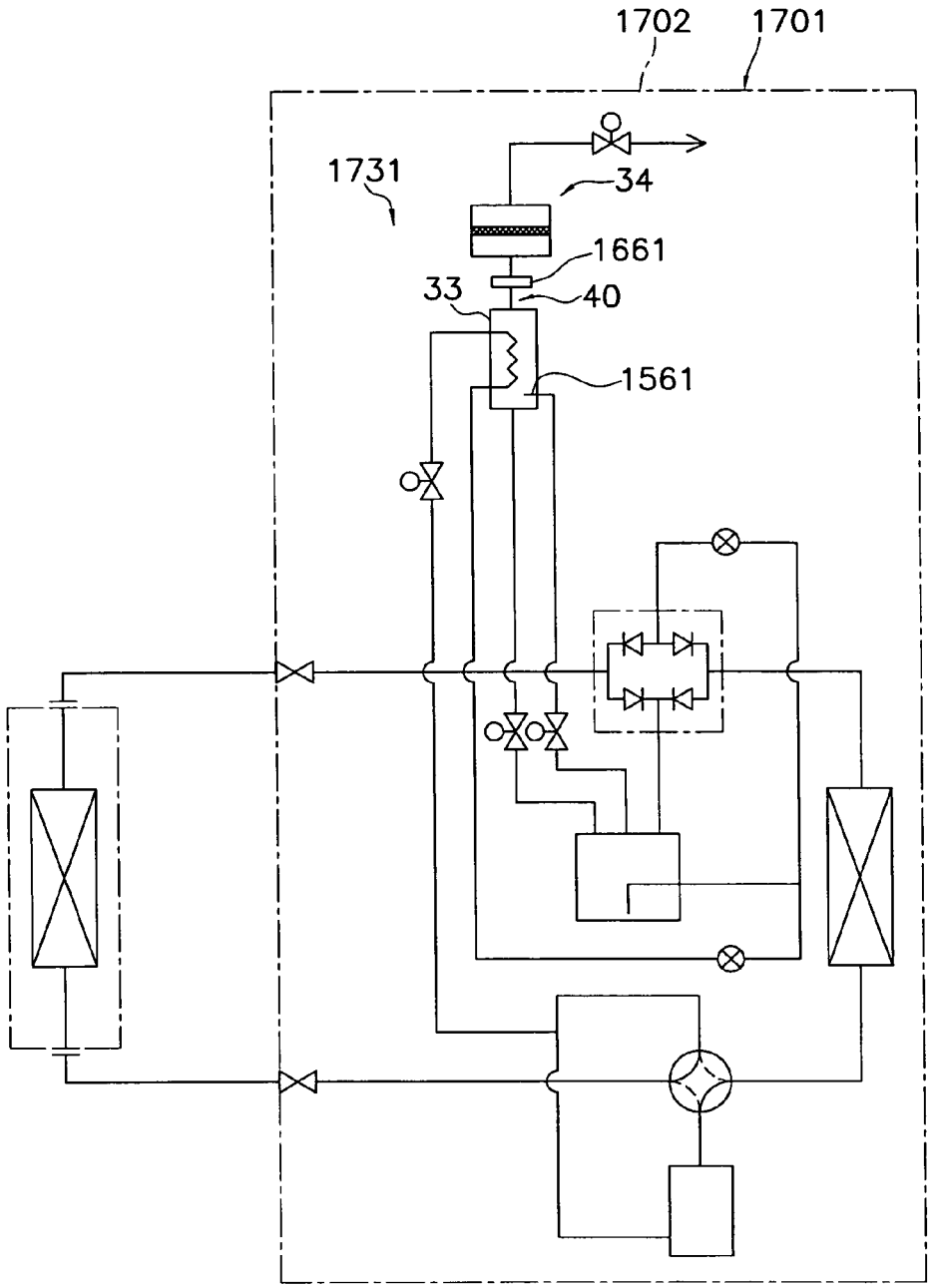
FIG. 17 is a schematic diagram of the refrigerant circuit of an air conditioning device according to modification 2 of the third embodiment.

The abovementioned gas separation device 1531 and gas separation device 1631 have an oil scattering prevention device 1561 composed of an inflow pipe, and an oil scattering prevention device 1661 composed of a filter, respectively. However, a first oil scattering prevention device 1561 composed of an inflow pipe may be provided so as to cause the gas refrigerant including non-condensable gas that flows from the main receiver 25 into the secondary receiver 33 via the gas refrigerant introduction circuit 38 to flow into the liquid refrigerant collected in the secondary receiver 33; and a second oil scattering prevention device 1661 composed of a filter may be provided to the separation membrane introduction circuit 40 in order to remove the refrigerator oil that accompanies the gas refrigerant including non-condensable gas obtained by gas-liquid separation using the secondary receiver 33 and fed to the separation membrane device 34, such as in the gas separation device 1731 incorporated into the heat source unit 1702 of the air conditioning device 1701 of the present modification shown in FIG. 17. The effects whereby refrigerator oil is prevented from scattering into the gas refrigerant including the non-condensable gas fed to the separation membrane device 34 can thereby be further enhanced.

4 Modification 3

Figure 18:
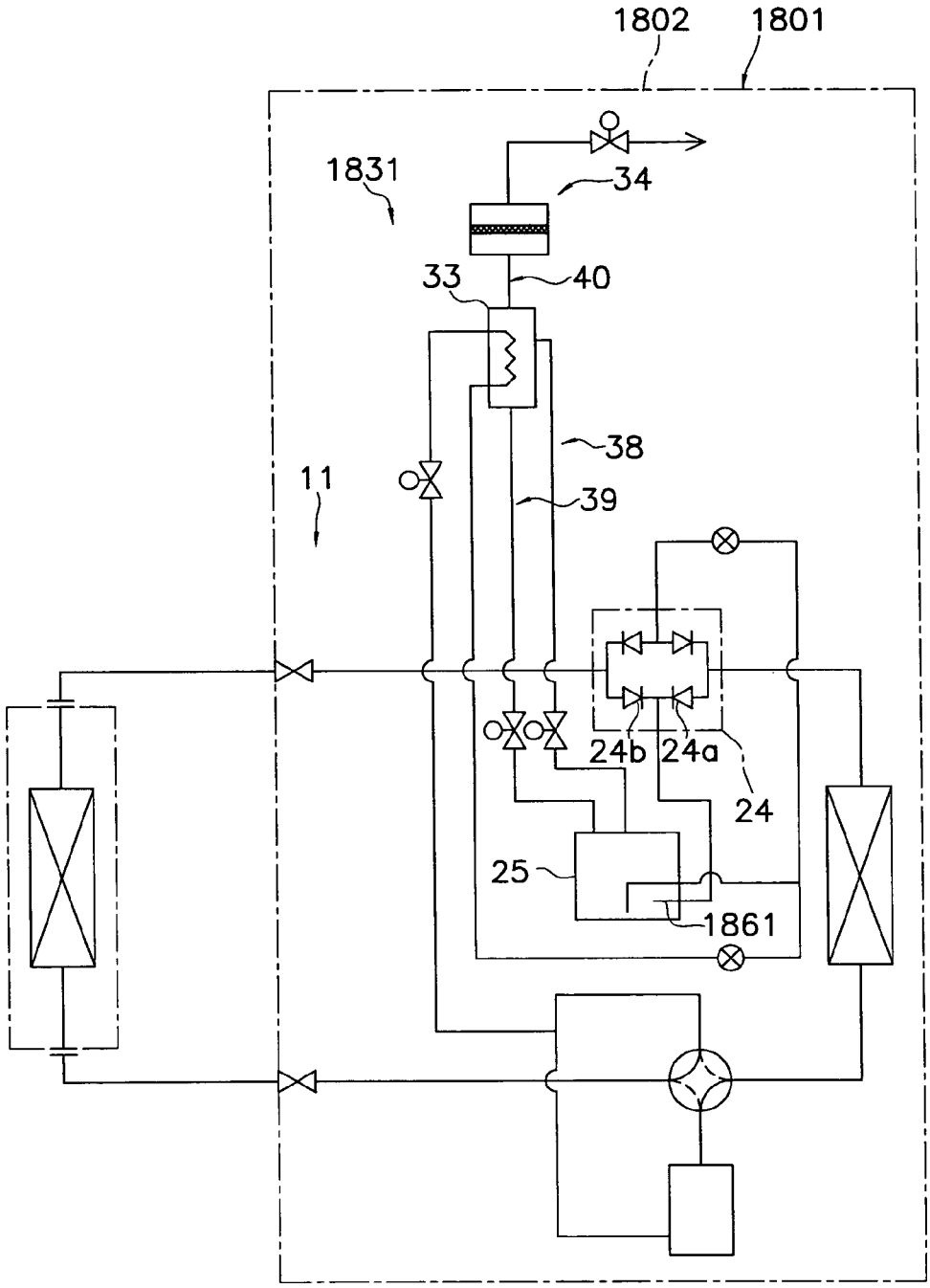
FIG. 18 is a schematic diagram of the refrigerant circuit of an air conditioning device according to modification 3 of the third embodiment.
Figure 19:
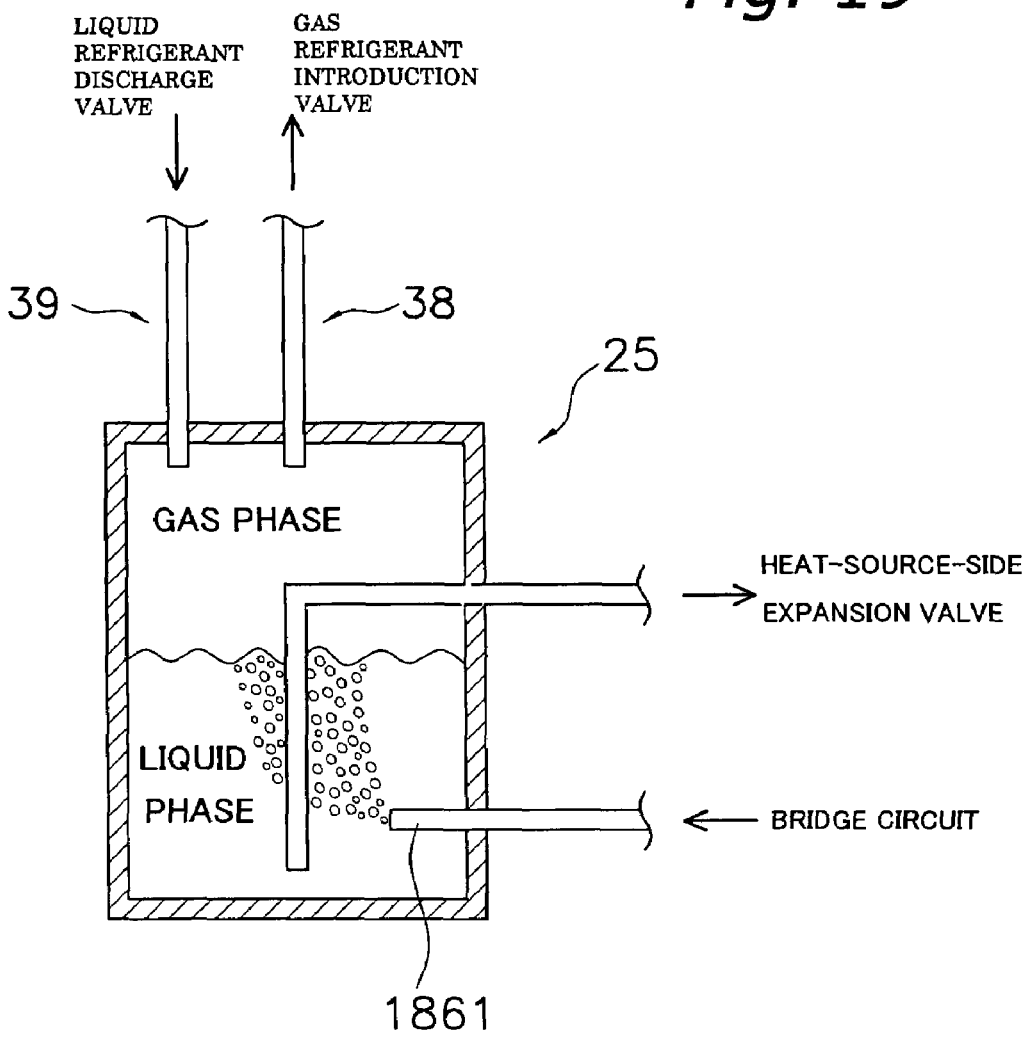
FIG. 19 is a diagram showing the overall structure of a main receiver of the air conditioning device according to modification 3 of the third embodiment.

In the gas separation device 1531 described above, the oil scattering prevention device 1561 composed of an inflow pipe is provided so as to cause the gas refrigerant including non-condensable gas that flows from the main receiver 25 into the secondary receiver 33 via the gas refrigerant introduction circuit 38 to flow into the liquid refrigerant collected in the secondary receiver 33. However, an oil scattering prevention device 1861 may also be provided so as to cause the refrigerant including non-condensable gas that flows from the liquid-side refrigerant circuit 11 (specifically, the non-return valves 24*a* and 24*b* of the bridge circuit 24) to the main receiver 25 to flow into the liquid refrigerant collected in the main receiver 25 (see FIG. 19), such as in the gas separation device 1831 incorporated into the heat source unit 1802 of the air conditioning device 1801 of the present modification shown in FIG. 18. This configuration makes it possible to prevent refrigerator oil from scattering into the gas refrigerant including non-condensable gas that flows into the secondary receiver 33, which results in the ability to prevent refrigerator oil from scattering into the gas refrigerant fed to the separation membrane device 34.

Although not shown in the drawing, a filter as a second oil scattering prevention device may be provided to the separation membrane introduction circuit 40 in conjunction with the oil scattering prevention device 1861 composed of an inflow pipe, the same as in the abovementioned gas separation device 1731.

5 Other Modifications

The oil scattering prevention devices 1561, 1661, and 1861 constituting the gas separation devices 1531, 1631, 1731, and 1831 described above may be applied to the gas separation devices 131, 231, 331, 431, 531, 631, 731, and 831 according to the modifications of the first embodiment, or to the gas separation devices 1031 and 1131 according to the second embodiment or modifications thereof.

Fourth Embodiment

1 Structure of the Air Conditioning Device

Figure 20:
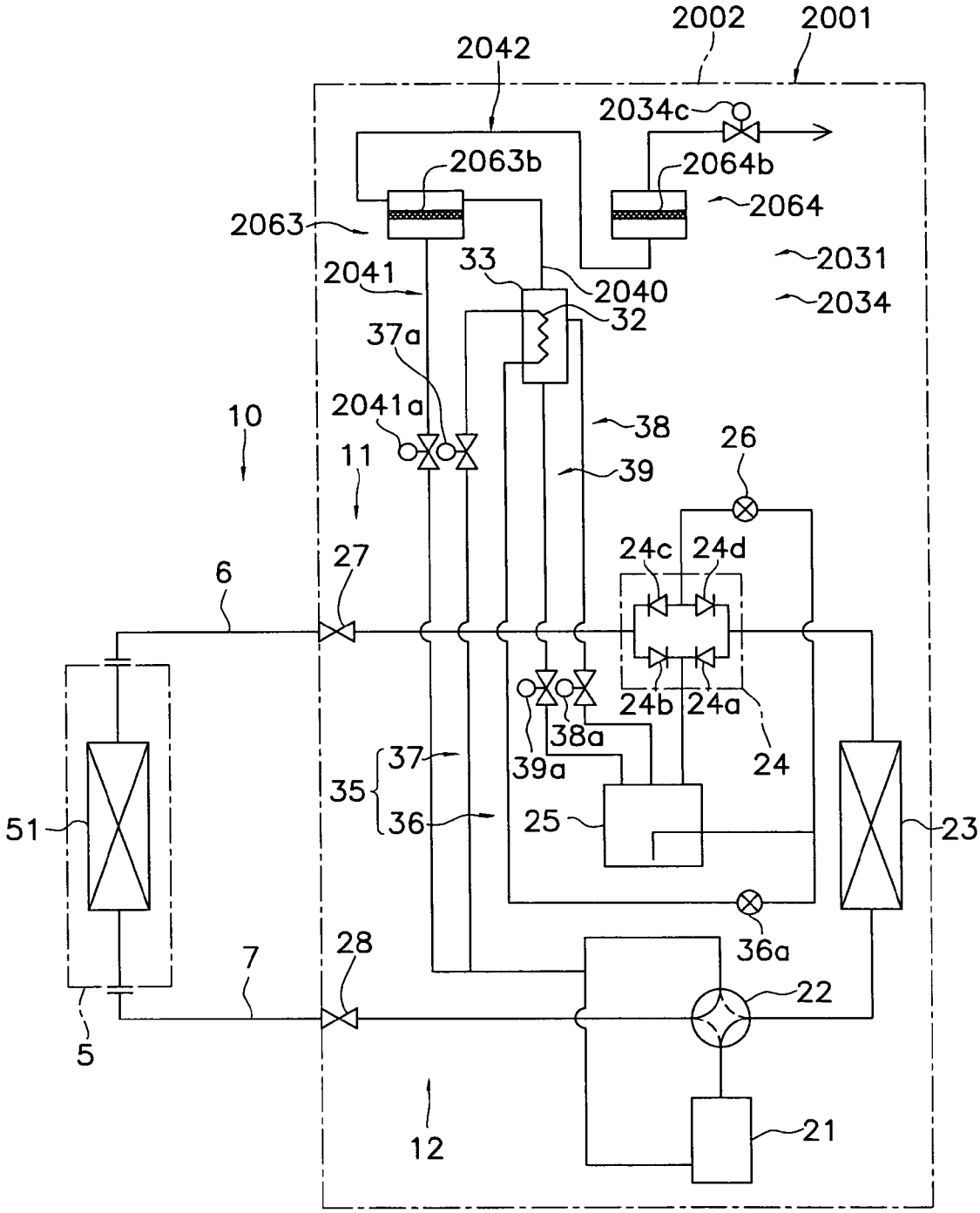
FIG. 20 is a schematic diagram of the refrigerant circuit of an air conditioning device as an example of a refrigeration device according to a fourth embodiment of the present invention.

FIG. 20 is a schematic diagram of the refrigerant circuit of the air conditioning device 2001 as an example of a refrigeration device according to a fourth embodiment of the present invention. The air conditioning device 2001 in the present embodiment is an air conditioning device capable of cooling operation and heating operation, the same as the air conditioning device 1 of the first embodiment, and is provided with a heat source unit 2002, a utilization unit 5, and a liquid refrigerant connection pipe 6 and gas refrigerant connection pipe 7 for connecting the heat source unit 2002 with the utilization unit 5. Since the structure of the air conditioning device 2001 of the present embodiment except for the gas separation device 2031 is the same as that of the air conditioning device 1 of the first embodiment, description thereof is omitted.

The gas separation device 2031 in the present embodiment is primarily composed of the cooler 32, the secondary receiver 33, and a separation membrane device 2034. Since the cooler 32 and secondary receiver 33 herein are the same as the cooler 32 and secondary receiver 33 constituting the gas separation device of the first embodiment, description thereof is omitted.

Figure 21:
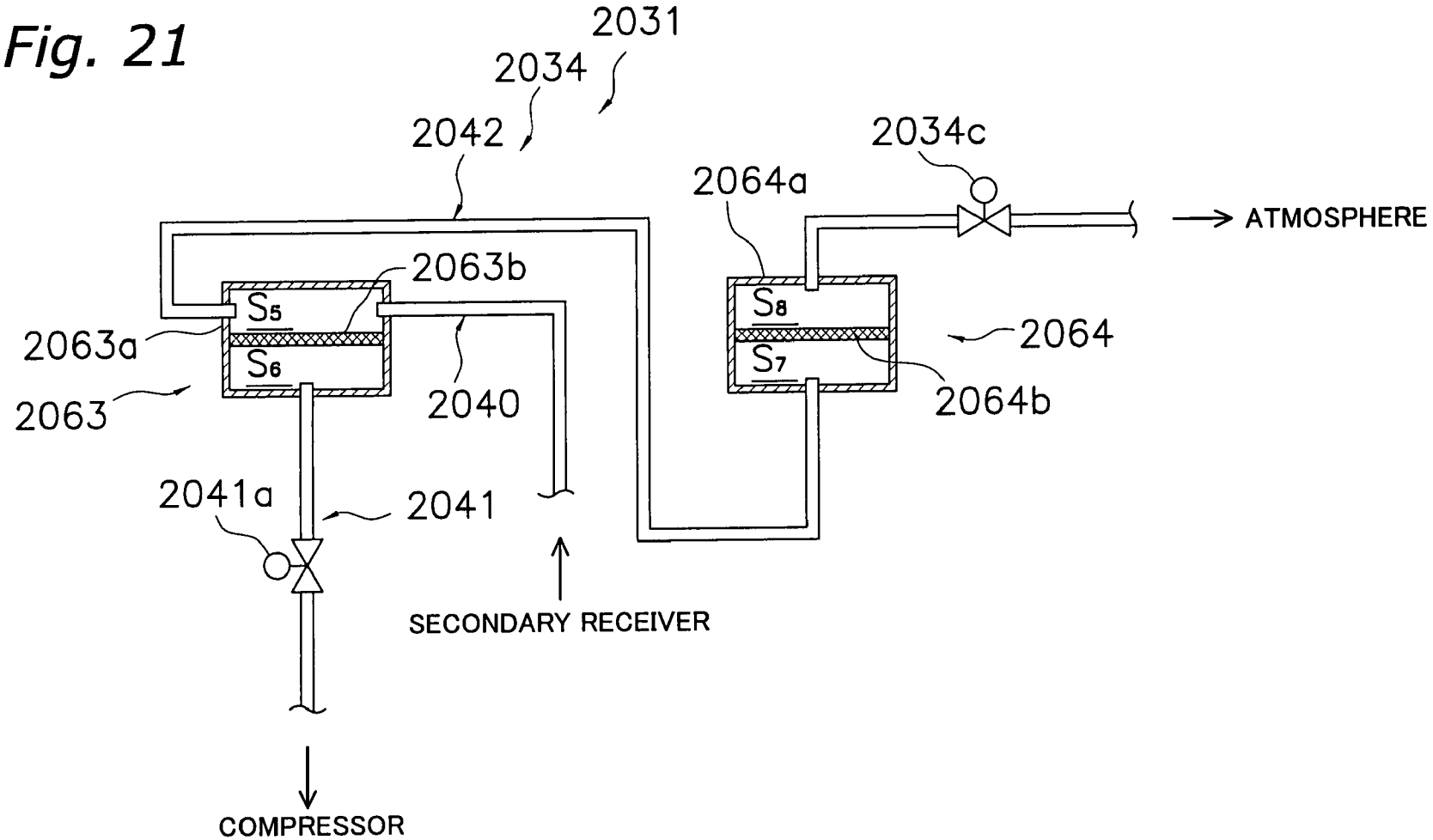
FIG. 21 is a diagram showing the overall structure of a separation membrane device of the air conditioning device according to the fourth embodiment.

The separation membrane device 2034 is a device for separating the non-condensable gas from the gas refrigerant obtained by gas-liquid separation using the secondary receiver 33, and discharging the separated non-condensable gas to the outside of the refrigerant circuit 10. This is the same as the separation membrane device 34 of the first embodiment, or the separation membrane device 1034 of the second embodiment. The separation membrane device 2034 is configured so that the gas refrigerant including the non-condensable gas collected in the top of the secondary receiver 33 is introduced via a first separation membrane introduction circuit 2040 connected to the top of the secondary receiver 33. As shown in FIG. 21, the separation membrane device 2034 has separation membranes provided in multiple stages (two stages in the present embodiment). The separation membrane device 2034 is primarily composed of a first separation membrane module 2063 the same as the separation membrane device 1034 of the second embodiment, and a second separation membrane module 2064 the same as the separation membrane device 34 of the first embodiment, connected to the downstream side of the first separation membrane module 2063.

The first separation membrane module 2063 has a first module main body 2063*a*, a first separation membrane 2063*b* disposed so as to divide the space inside the first module main body 2063*a* into a space $S_6$ (secondary side) and a space $S_5$ (secondary side) communicated with the first separation membrane introduction circuit 2040, and a gas refrigerant outflow circuit 2041 connected to the space $S_6$. The first separation membrane 2063*b* is a membrane that is capable of selectively transmitting the gas refrigerant from the gas refrigerant that includes the non-condensable gas, the same as the separation membrane 1034*b* constituting the separation membrane device 1034 of the second embodiment. The first separation membrane 2063*b* therefore selectively transmits the gas refrigerant from the gas refrigerant that includes the non-condensable gas (specifically, the fed gas that is a gas mixture of the gas refrigerant and non-condensable gas collected in the top of the secondary receiver 33), and the gas refrigerant can be caused to flow from the space $S_5$ to the space $S_6$. A gas refrigerant outflow circuit 2041 is provided so as to connect the space $S_6$ of the first separation membrane module 2063 and the intake side of the compressor 21, and has a gas refrigerant return valve 2041*a* for circulating/blocking the gas refrigerant transmitted through the first separation membrane 2063*b* and returned to the refrigerant circuit 10. Since the gas refrigerant outflow circuit 2041 is provided so that the gas refrigerant is returned to the intake side of the compressor 21 having the lowest refrigerant pressure in the refrigerant circuit 10, the pressure difference between the space $S_5$ and the space $S_6$ can be increased.

The second separation membrane module 2064 is connected to the first separation membrane module 2063 via a second separation membrane introduction circuit 2042, and has a second module main body 2064*a*, a second separation membrane 2064*b*, and a discharge valve 2034*c*. The second separation membrane 2064*b* is disposed so as to divide the space inside the second module main body 2064*a* into a space $S_8$ (secondary side) and a space $S_7$ (primary side) communicated with the second separation membrane introduction circuit 2042. The space $S_7$ is communicated with the space $S_5$ of the first separation membrane module 2063 via the second separation membrane introduction circuit 2042. The second separation membrane 2064*b* is a membrane that is capable of selectively transmitting the non-condensable gas from the gas refrigerant that includes the non-condensable gas, the same as the separation membrane 34*b* constituting the separation membrane device 34 of the first embodiment. The second separation membrane 2064*b* therefore selectively transmits the non-condensable gas from the gas refrigerant that includes the non-condensable gas (specifically, the impermeable gas that is a gas mixture of the non-condensable gas and gas refrigerant not transmitted by the first separation membrane 2063*b*), and the non-condensable gas can be caused to flow from the space $S_7$ to the space $S_8$. The discharge valve 2034*c* is connected to the space $S_8$ of the second separation membrane module 2064. The discharge valve 2034*c* is a valve for opening the space $S_8$ to the atmosphere, and is capable of releasing the non-condensable gas separated by the second separation membrane 2064*b* and influxed to the space $S_8$ into the atmosphere from the space $S_8$, and discharging the non-condensable gas to the outside of the refrigerant circuit 10.

The separation membrane device 2034 of the present embodiment thereby constitutes a multi-stage separation membrane device having a first separation membrane 2063*b* in a first stage composed of a membrane (specifically, a nonporous membrane) that is capable of selectively transmitting the gas refrigerant from gas refrigerant that includes non-condensable gas (specifically, the fed gas that is a gas mixture of the gas refrigerant and non-condensable gas collected in the top of the secondary receiver 33); and a second separation membrane 2064*b* in a later stage composed of a membrane (specifically, a porous membrane) that is capable of selectively transmitting the non-condensable gas from the gas refrigerant that includes the non-condensable gas (specifically, the impermeable gas that is a gas mixture of the non-condensable gas and gas refrigerant not transmitted by the first separation membrane 2063*b*).

2 Method for Installing the Air Conditioning Device

The method for installing the air conditioning device 2001 will next be described. Since the implementation procedure except for the non-condensable gas discharge step is the same as in the method for installing the air conditioning device 1 of the first embodiment, description thereof is omitted.

Non-Condensable Gas Discharge Step

After the seal gas is released, the liquid-side gate valve 27 and gas-side gate valve 28 of the heat source unit 2002 are opened, and a state is established in which the refrigerant circuit of the utilization unit 5 and the refrigerant circuit of the heat source unit 2002 are connected. The refrigerant charged in advance into the heat source unit 2002 is thereby fed to the entire refrigerant circuit 10. When the necessary refrigerant charge quantity is not obtained using only the quantity of refrigerant charged in advance into the heat source unit 2002, such as when the refrigerant connection pipes 6 and 7 are long, additional refrigerant is charged from the outside as needed. The entire necessary quantity of refrigerant is charged from the outside when refrigerant is not charged in advance into the heat source unit 2002. The seal gas (also including non-condensable gas remaining in the utilization unit 5 when the utilization unit 5 is tested for airtightness simultaneously) as the non-condensable gas remaining in the refrigerant connection pipes 6 and 7 following the seal gas releasing step is thereby mixed with the refrigerant inside the refrigerant circuit 10.

In this circuit structure, the compressor 21 is activated, and operation is performed for recirculating the refrigerant in the refrigerant circuit 10.

(Case in which the Non-Condensable Gas is Discharged During Cooling Operation)

A case will first be described in which the operation for recirculating refrigerant in the refrigerant circuit 10 is performed by the cooling operation. At this time, the four-way directional valve 22 is in the state indicated by the solid line in FIG. 20; specifically, a state in which the discharge side of the compressor 21 is connected to the gas side of the heat-source-side heat exchanger 23, and the intake side of the compressor 21 is connected to the gas-side gate valve 28. The heat-source side expansion valve 26 is in a state in which the degree of opening thereof is adjusted. A state is also established in which the cooling expansion valve 36*a*, cooling refrigerant return valve 37*a*, gas refrigerant introduction valve 38*a*, liquid refrigerant outflow valve 39*a*, gas refrigerant return valve 2041*a*, and discharge valve 2034*c* constituting the gas separation device 2031 are all closed, and the gas separation device 2031 is not in use.

When the compressor 21 is activated in this state of the refrigerant circuit 10 and gas separation device 2031, the same operation as the cooling operation is performed in the same manner as in the first embodiment. Since the operation of the refrigerant circuit 10 is the same as in the first embodiment, description thereof is omitted.

The operation for discharging the non-condensable gas from the refrigerant circuit 10 using the gas separation device 2031 will next be described. Since the operation for increasing the concentration of the non-condensable gas in the gas refrigerant in the top of the secondary receiver 33 is the same as in the first embodiment, description thereof is omitted. The operation in the separation membrane device 2034 is described below.

Following the operation described above, the gas refrigerant return valve 2041*a* of the separation membrane device 2034 is opened, and the refrigerant pressure inside the space $S_6$ of the first separation membrane module 2063 is equalized with the pressure of the refrigerant flowing through the intake side of the compressor 21. Since the space $S_5$ of the first separation membrane module 2063 is then communicated with the top of the secondary receiver 33, the gas refrigerant (fed gas) including the non-condensable gas collected in the top of the secondary receiver 33 is introduced into the space $S_5$, and a pressure difference corresponding to the difference between the condensation pressure of the refrigerant and the pressure of the intake side of the compressor 21 occurs between the space $S_5$ and the space $S_6$. The gas refrigerant included in the fed gas collected in the space $S_5$ is therefore forced through the first separation membrane 2063*b* by this pressure difference, is caused to flow toward the space $S_6$, and is returned to the intake side of the compressor 21 through the gas refrigerant return valve 2041*a*. The non-condensable gas (impermeable gas) remaining in the space $S_5$ after passing through the first separation membrane 2063*b* and flowing to the side of the space $S_6$ flows into the space $S_7$ of the second separation membrane module 2064 via the second separation membrane introduction circuit 2042. When the separation performance of the first separation membrane 2063*b* is low, gas refrigerant is still included in the impermeable gas remaining in the space $S_5$. Specifically, most of the gas refrigerant is removed by the first separation membrane 2063*b* from the impermeable gas collected in the space $S_5$, and the non-condensable gas is concentrated.

The discharge valve 2034*c* of the separation membrane device 2034 is then opened, and the space $S_8$ of the second separation membrane module 2064 is opened to the atmosphere. Since the space $S_7$ of the second separation membrane module 2064 is then communicated with the space $S_5$ of the first separation membrane module 2063, a pressure difference corresponding to the difference between the condensation pressure of the refrigerant and the atmospheric pressure occurs between the space $S_7$ and the space $S_8$. The non-condensable gas included in the impermeable gas remaining in the space $S_7$ is therefore forced through the second separation membrane 2064*b* by this pressure difference, is caused to flow toward the space $S_8$, and is released into the atmosphere through the discharge valve 2034*c*. Once this operation has been performed for a prescribed time, the non-condensable gas remaining in the liquid refrigerant connection pipe 6 and gas refrigerant connection pipe 7 is discharged from the refrigerant circuit 10. The non-condensable gas is discharged from the refrigerant circuit 10, and the cooling expansion valve 36*a*, cooling refrigerant return valve 37*a*, gas refrigerant introduction valve 38*a*, liquid refrigerant outflow valve 39*a*, gas refrigerant return valve 2041*a*, and discharge valve 2034*c* constituting the gas separation device 31 are then closed.

(Case in which the Non-Condensable Gas is Discharged During Heating Operation)

A case will next be described in which the operation for recirculating refrigerant in the refrigerant circuit 10 is performed by the heating operation. At this time, the four-way directional valve 22 is in the state indicated by the dashed line in FIG. 20; specifically, a state in which the discharge side of the compressor 21 is connected to the gas-side gate valve 28, and the intake side of the compressor 21 is connected to the gas side of the heat-source-side heat exchanger 23. The heat-source side expansion valve 26 is in a state in which the degree of opening thereof is adjusted. A state is also established in which the cooling expansion valve 36*a*, cooling refrigerant return valve 37*a*, gas refrigerant introduction valve 38*a*, liquid refrigerant outflow valve 39*a*, gas refrigerant return valve 2041*a*, and discharge valve 2034*c* constituting the gas separation device 1031 are all closed, and the gas separation device 2031 is not in use.

When the compressor 21 is activated in this state of the refrigerant circuit 10 and gas separation device 2031, the same operation as the heating operation is performed in the same manner as in the first embodiment. Since the operation of the refrigerant circuit 10 and the gas separation device 2031 is the same as the operation for discharging the non-condensable gas in the cooling operation, description thereof is omitted.

3 Features of the Air Conditioning Device and Installation Method Thereof

In the air conditioning device 2001 of the present embodiment, a multistage separation membrane device 2034 is employed that has a first separation membrane module 2063 for selectively transmitting the refrigerant from the refrigerant that includes the non-condensable gas (specifically, the fed gas that is a gas mixture of the gas refrigerant and non-condensable gas collected in the top of the secondary receiver 33), and a second separation membrane module 2064 for selectively transmitting the non-condensable gas from the gas refrigerant that includes the non-condensable gas (specifically, the impermeable gas that is a gas mixture of the non-condensable gas and gas refrigerant not transmitted by the first separation membrane 2063*b*).

It therefore becomes possible to separate the refrigerant from the gas refrigerant obtained by gas-liquid separation using the first separation membrane module 2063 having the first separation membrane 2063*b* for selectively transmitting the refrigerant from the fed gas that is separated into gas and liquid in the secondary receiver 33, to reduce the amount of gas refrigerant without reducing the pressure of the impermeable gas, and to increase the concentration of the non-condensable gas, even when the separation performance of the second separation membrane 2064*b* constituting the second separation membrane module 2064 is low, for example. Therefore, the separation efficiency of the non-condensable gas in the second separation membrane 2064*b* can be enhanced, and the non-condensable gas can be reliably separated from this impermeable gas using the second separation membrane module 2064 having the second separation membrane 2064*b*.

The air conditioning device 2001 and installation method thereof of the present embodiment thus has the same characteristics as the air conditioning device 1 and installation method thereof of the first embodiment, and the non-condensable gas can be reliably separated by the gas separation device 2031 having the multi-stage separation membrane device 2034.

4 Modification

Figure 22:
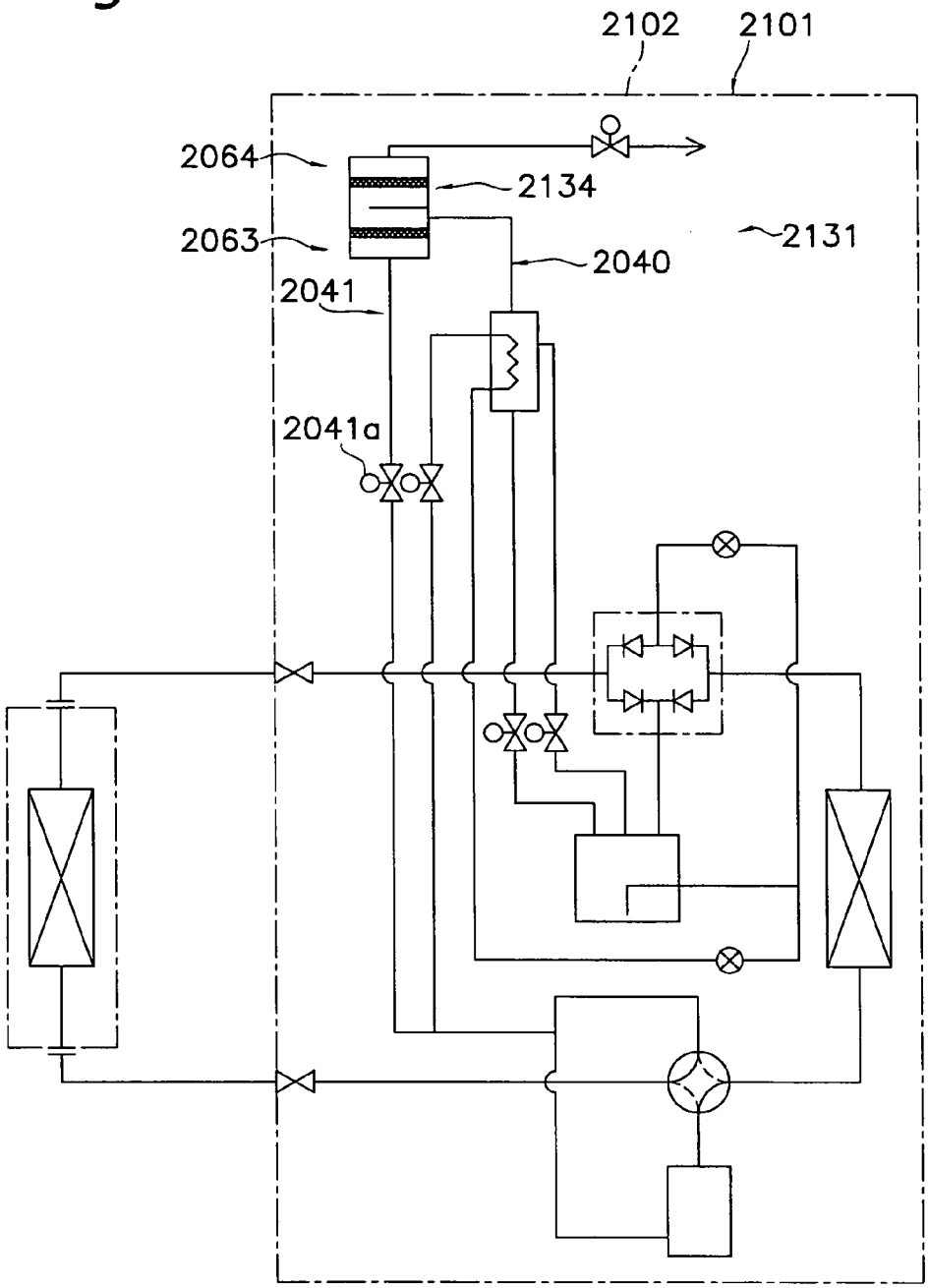
FIG. 22 is a schematic diagram of the refrigerant circuit of the air conditioning device according to a modification of the fourth embodiment.
Figure 23:
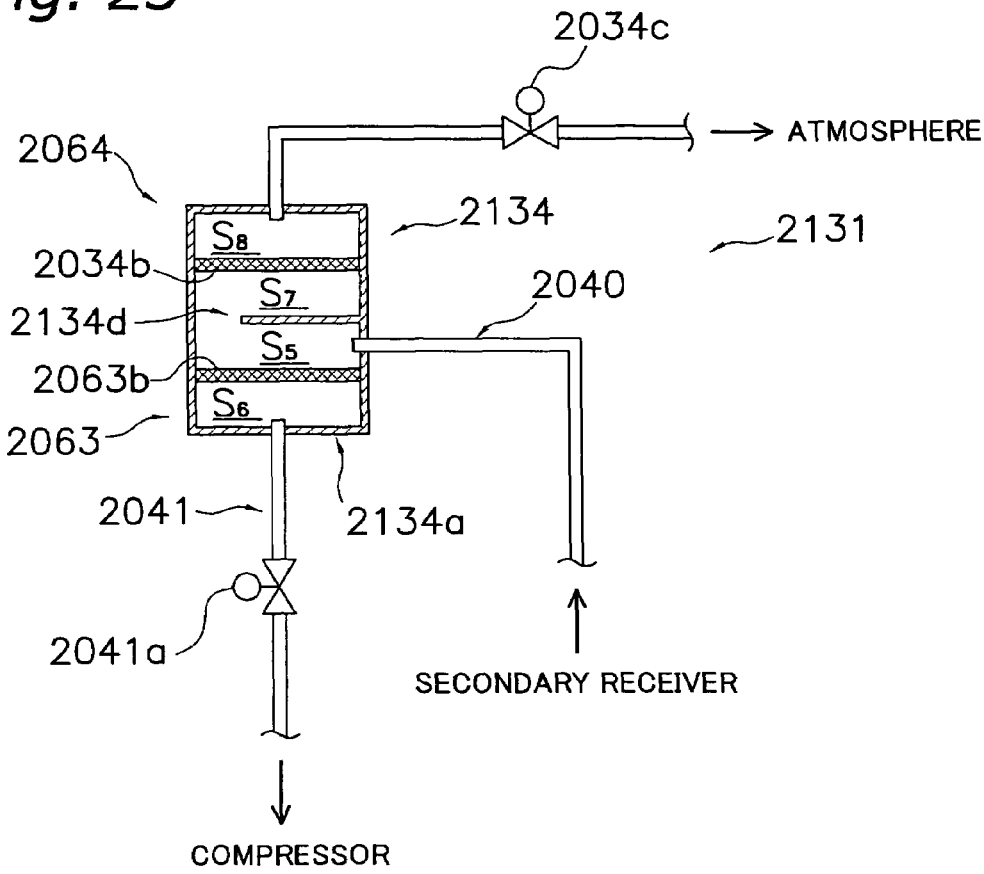
FIG. 23 is a diagram showing the overall structure of a separation membrane device of the air conditioning device according to a modification of the fourth embodiment.

In the abovementioned gas separation device 2031, the first separation membrane module 2063 and second separation membrane module 2064 constituting the separation membrane device 2034 are connected to each other via the second separation membrane introduction circuit 2042. However, the second separation membrane introduction circuit 2042 may be omitted by integrally forming the first separation membrane module 2063 having the first separation membrane 2063*b*, and the second separation membrane module 2064 having the second separation membrane 2064*b* inside the separation membrane module main body 2134*a*, and by providing a flow channel 2134*d* for communicating the space $S_5$ of the first separation membrane module 2063 with the space $S_7$ of the second separation membrane module 2064, as in the gas separation device 2131 incorporated into the heat source unit 2102 of the air conditioning device 2101 of the present modification shown in FIGS. 22 and 23. By this configuration, the number of separate components constituting the gas separation device 2131 is reduced, and the structure of the device is simplified.

5 Other Modifications

The same configurations as those of the cooler, the secondary receiver, the primary receiver, and peripheral circuits used in the gas separation devices 131, 231, 331, 431, 531, 631, 731, and 831 in the modifications of the first embodiment may be employed in the abovementioned gas separation devices 2031 and 2131.

The gas refrigerant outflow circuit 1141 applied in the gas separation device 1131 according to the modification of the second embodiment may also be employed in the abovementioned gas separation devices 2031 and 2131.

The oil scattering prevention devices 1561, 1661, and 1861 applied in the gas separation devices 1531, 1631, 1731, and 1831 according to the third embodiment and modifications thereof may also be employed in the abovementioned gas separation devices 2031 and 2131.

Fifth Embodiment

1 Structure and Features of the Air Conditioning Device

Figure 24:
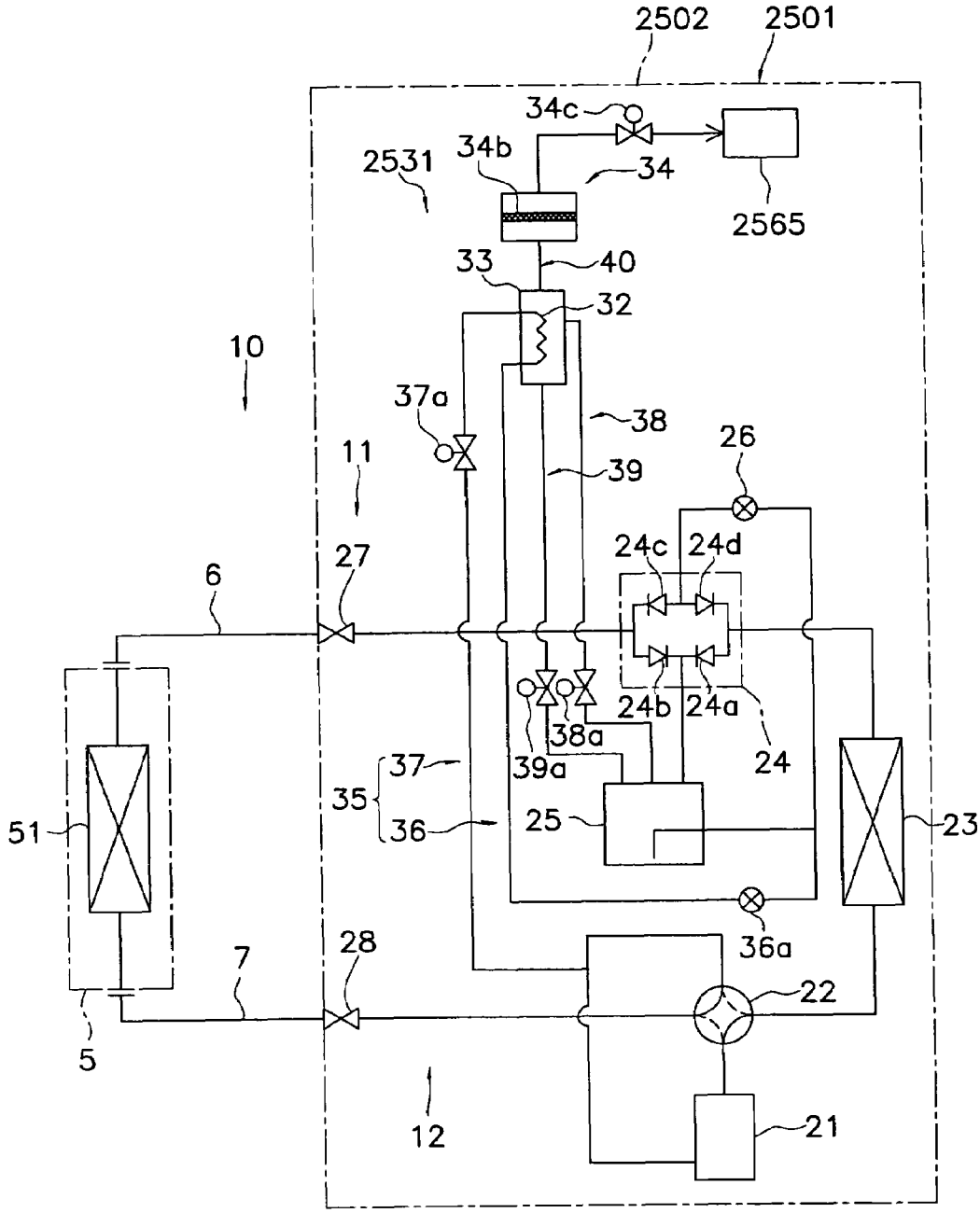
FIG. 24 is a schematic diagram of the refrigerant circuit of an air conditioning device as an example of the refrigeration device according to a fifth embodiment of the present invention.

FIG. 24 is a schematic diagram of the refrigerant circuit of the air conditioning device 2501 as an example of the refrigeration device according to a fifth embodiment of the present invention. The air conditioning device 2501 in the present embodiment is an air conditioning device capable of cooling operation and heating operation, the same as the air conditioning device 1 of the first embodiment, and is provided with a heat source unit 2502, a utilization unit 5, and a liquid refrigerant connection pipe 6 and gas refrigerant connection pipe 7 for connecting the heat source unit 2502 with the utilization unit 5. Since the structure of the air conditioning device 2501 of the present embodiment except for the gas separation device 2531 is the same as that of the air conditioning device 1 of the first embodiment, description thereof is omitted.

The gas separation device 2531 in the present embodiment is primarily composed of the cooler 32, the secondary receiver 33, the separation membrane device 34, and a refrigerant recovery mechanism 2565. Since the cooler 32, secondary receiver 33, and separation membrane device 34 herein are the same as the cooler 32, secondary receiver 33, and separation membrane device 34 constituting the gas separation device of the first embodiment, description thereof is omitted.

Figure 25:
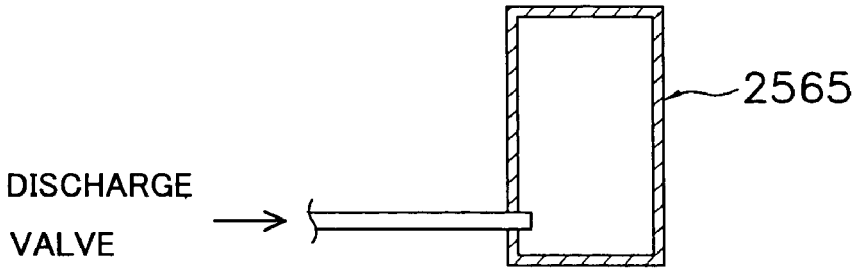
FIG. 25 is a diagram showing the overall structure of a refrigerant recovery mechanism of the air conditioning device according to the fifth embodiment.

The refrigerant recovery mechanism 2565 is a device for recovering the refrigerant including non-condensable gas that is separated in the separation membrane device 34, in a case in which the separation performance of the separation membrane 34*b* constituting the separation membrane device 34 is low and refrigerant is included in the non-condensable gas separated in the separation membrane device 34, for example. In the present embodiment, the refrigerant recovery mechanism 2565 is a collection vessel for collecting together with the non-condensable gas the refrigerant included in the non-condensable gas that flows in through the discharge valve 34*c* after being separated in the separation membrane device 34, as shown in FIG. 25. Refrigerant can be prevented from being released into the atmosphere by providing this type of refrigerant recovery mechanism 2565.

The air conditioning device 2501 of the present embodiment thereby has the same characteristics as the air conditioning device 1 and installation method thereof of the first embodiment, and refrigerant can be prevented from being released into the atmosphere even when the separation performance of the separation membrane 34*b* constituting the separation membrane device 34 is low and refrigerant is included in the non-condensable gas separated in the separation membrane device 34 during an operation for recirculating the refrigerant in the refrigerant circuit 10.

2 Modification 1

In the abovementioned gas separation device 2531, a collection vessel for collecting together with the non-condensable gas the refrigerant included in the non-condensable gas that flows in through the discharge valve 34*c* after being separated in the separation membrane device 34 is employed as the refrigerant recovery mechanism 2565. However, an absorption device having an absorbing agent for absorbing the refrigerant included in the non-condensable gas may be employed as the refrigerant recovery mechanism 2665, as in the gas separation device 2631 incorporated into the heat source unit 2602 of the air conditioning device 2601 of the present modification shown in FIGS. 26 and 27. Specifically, the refrigerant recovery mechanism 2665 has refrigerator oil or another absorbing agent 2665*a* for absorbing the gas refrigerant, an absorption device main body 2665*b* for storing the absorbing agent 2665*a*, and a discharge valve 2665*c* for discharging the non-condensable gas from the absorption device main body 2665*b*, and is configured so that the refrigerant-containing non-condensable gas separated in the separation membrane device 1034 is caused to flow into the absorbing agent 2665*a*. By providing this type of refrigerant recovery mechanism 2665, the non-condensable gas can be released into the atmosphere without releasing the refrigerant into the atmosphere.

Figure 26:
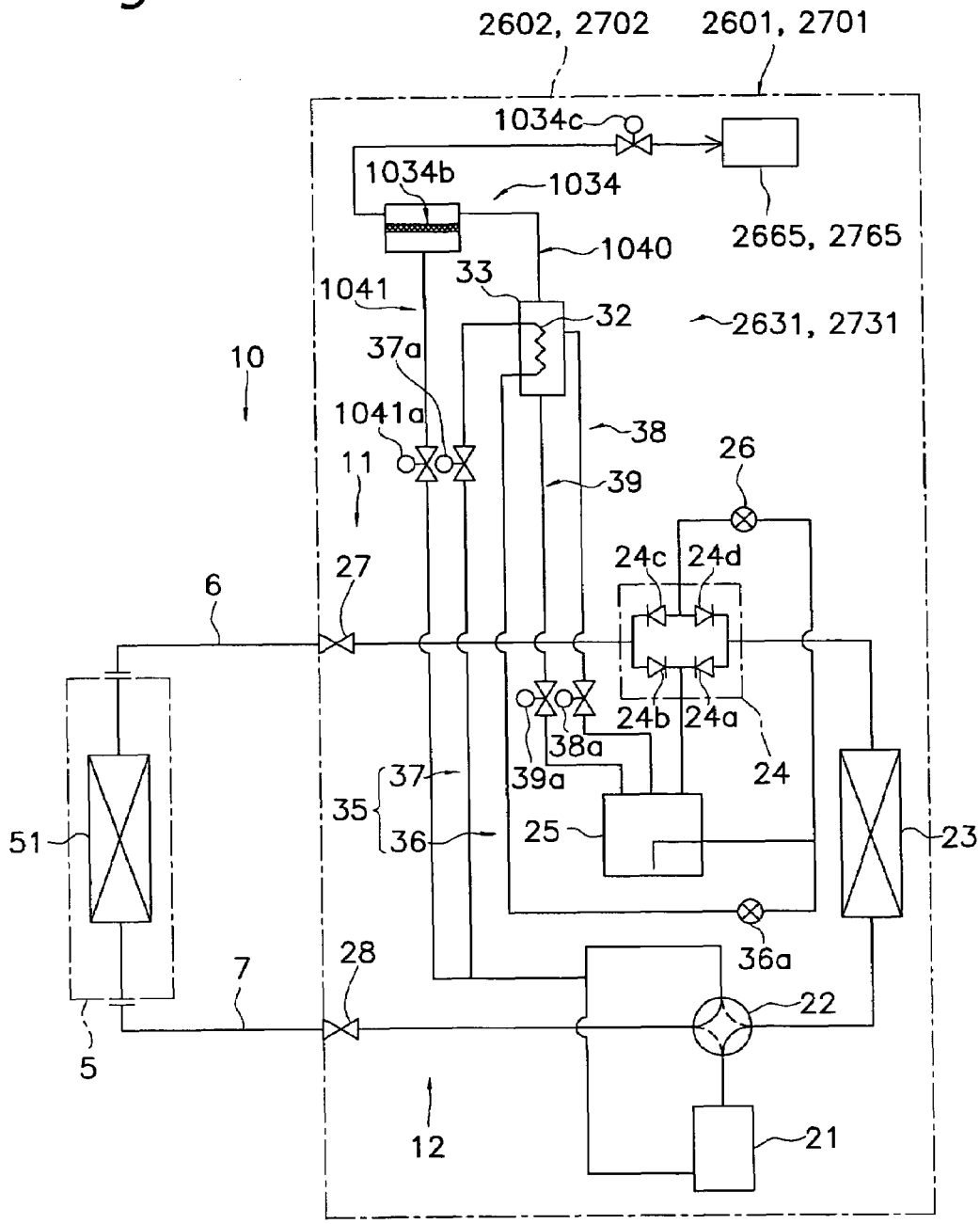
FIG. 26 is a schematic diagram of the refrigerant circuit of an air conditioning device as an example of a refrigeration device according to modifications 1 and 2 of the fifth embodiment of the present invention.
Figure 27:
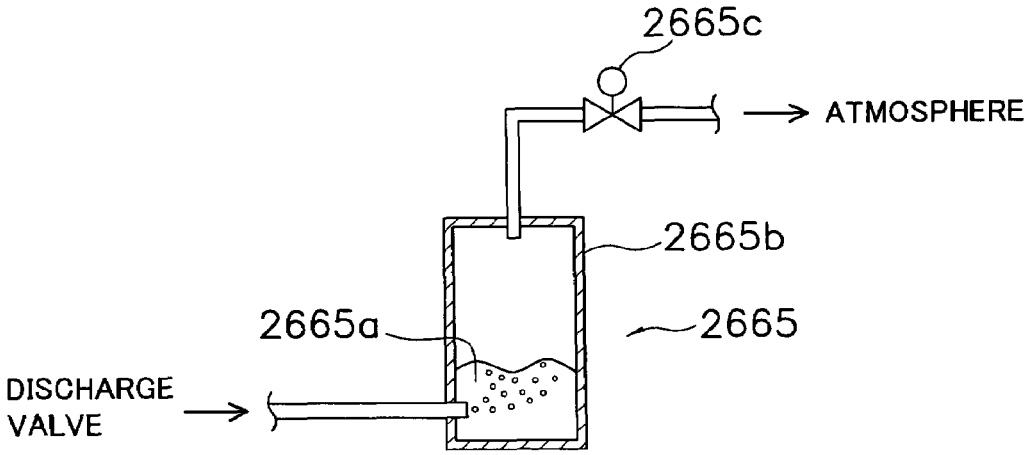
FIG. 27 is a diagram showing the overall structure of the refrigerant recovery mechanism of the air conditioning device according to modification 1 of the fifth embodiment.

When an absorption device is employed as the refrigerant recovery mechanism as in the present modification, the pressure of the non-condensable gas that flows into the absorption device is preferably as high as possible considering the absorption ability of the absorbing agent. Therefore, the same separation membrane device 1034 as in the second embodiment, having the separation membrane 1034*b* for selectively transmitting the refrigerant from the gas refrigerant that includes non-condensable gas, is employed as the separation membrane device constituting the gas separation device 2631 housed inside the heat source unit 2602 of the air conditioning device 2601, as shown in FIG. 26.

3 Modification 2

Figure 28:
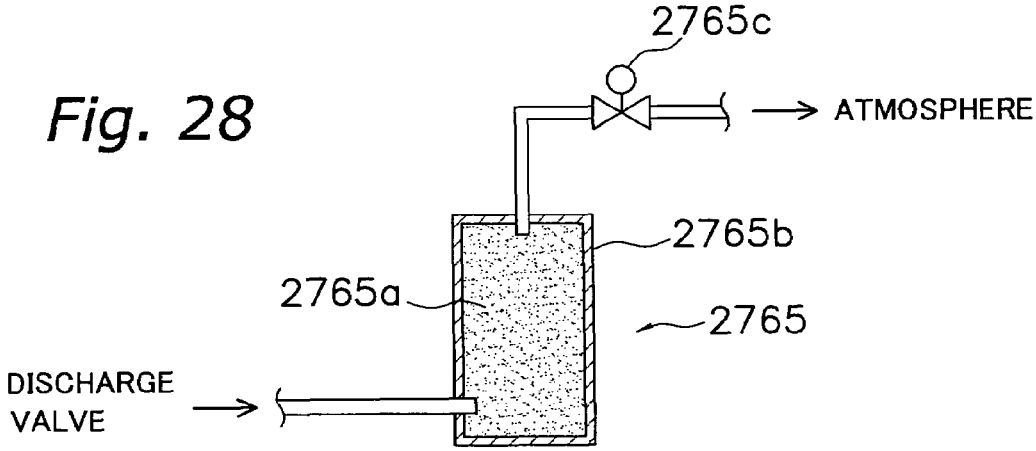
FIG. 28 is a diagram showing the overall structure of the refrigerant recovery mechanism of the air conditioning device according to modification 2 of the fifth embodiment.

In the abovementioned gas separation device 2631, an absorption device having an absorbing agent for absorbing the refrigerant included in the non-condensable gas is employed as the refrigerant recovery mechanism 2665. However, an adsorption device having an adsorption agent for adsorbing the refrigerant included in the non-condensable gas may be employed as the refrigerant recovery mechanism 2765, as in the gas separation device 2731 incorporated into the heat source unit 2702 of the air conditioning device 2701 of the present modification shown in FIGS. 26 and 28. Specifically, the refrigerant recovery mechanism 2765 has zeolite or another adsorbing agent 2765*a* for adsorbing the gas refrigerant, an adsorption device main body 2765*b* for storing the adsorbing agent 2765*a*, and a discharge valve 2765*c* for discharging the non-condensable gas from the adsorption device main body 2765*b*, and is configured so that the refrigerant-containing non-condensable gas separated in the separation membrane device 1034 is caused to pass through the inside of a layer of the adsorbing agent 2765*a*. By providing this type of refrigerant recovery mechanism 2765, the non-condensable gas can be released into the atmosphere without releasing the refrigerant into the atmosphere.

In the same manner as when an absorption device is employed as the refrigerant recovery mechanism, the pressure of the non-condensable gas that flows into the adsorption device is preferably kept as high as possible considering the adsorption ability of the adsorbing agent. Therefore, the same separation membrane device 1034 as in the second embodiment, having the separation membrane 1034*b* for selectively transmitting the refrigerant from the gas refrigerant that includes non-condensable gas, is employed as the separation membrane device constituting the gas separation device 2731 housed inside the heat source unit 2702 of the air conditioning device 2701, as shown in FIG. 26.

4 Other Modifications

The refrigerant recovery mechanism 2565 constituting the abovementioned gas separation device 2531 may be applied in the gas separation devices 1031 and 1131 according to the second embodiment and modifications thereof.

The refrigerant recovery mechanisms 2665 and 2765 constituting the abovementioned gas separation devices 2631 and 2731 may also be applied in the gas separation devices 31, 131, 231, 331, 431, 531, 631, 731, and 831 according to the first embodiment and modifications thereof.

The refrigerant recovery mechanisms 2565, 2665, and 2765 constituting the abovementioned gas separation devices 2531, 2631 and 2731 may also be applied in the gas separation devices 2031 and 2131 according to the fourth embodiment and modification thereof.

The refrigerant recovery mechanisms 2565, 2665, and 2765, as well as the oil scattering prevention devices 1561, 1661, and 1861 according to the third embodiment and modifications thereof, may also be applied in the gas separation devices 31, 131, 231, 331, 431, 531, 631, 731, 831, 1031, 1131, 2031, and 2131.

Furthermore, any two or more of the refrigerant recovery mechanisms 2565, 2665, and 2765 may be combined and used.

Sixth Embodiment

1 Structure, Installation Method, and Features of the Air Conditioning Device

A configuration may be adopted in the air conditioning device 1 (see FIG. 1) as an example of the refrigeration device according to the first embodiment of the present invention whereby the heat source unit 2 and the utilization unit 5 are connected to each other via the refrigerant connection pipes 6 and 7 in the refrigerant circuit formation step, after which the non-condensable gas primarily composed of oxygen gas, nitrogen gas, or another air component remaining in the refrigerant connection pipes 6 and 7 is substituted with helium gas in the gas substitution step, and the helium gas is then discharged to the outside of the refrigerant circuit 10 in the non-condensable gas discharge step.

The specific method for installing the air conditioning device 1 is described below. Since the device installation step (refrigerant circuit formation step), the airtightness testing step, and the seal gas releasing step are the same as in the first embodiment, description thereof is omitted.

Gas Substitution Step

After the seal gas is released, helium gas is fed to the airtightness-tested portion that includes the liquid refrigerant connection pipe 6 and gas refrigerant connection pipe 7 from a feeding vent (not shown) provided to the liquid refrigerant connection pipe 6, the gas refrigerant connection pipe 7, or another component. The operation for releasing the ambient gas (seal gas) in the airtightness-tested portion into the atmosphere is repeated, and the ambient gas (seal gas) in the airtightness-tested portion is substituted with helium gas.

Non-Condensable Gas Discharge Step

After the ambient gas (seal gas) in the airtightness-tested portion is replaced with helium gas, the liquid-side gate valve 27 and gas-side gate valve 28 of the heat source unit 2 are opened, and a state is established in which the refrigerant circuit of the utilization unit 5 and the refrigerant circuit of the heat source unit 2 are connected. The refrigerant charged in advance into the heat source unit 2 is thereby fed to the entire refrigerant circuit 10. When the necessary refrigerant charge quantity is not obtained using only the quantity of refrigerant charged in advance into the heat source unit 2, such as when the refrigerant connection pipes 6 and 7 are long, additional refrigerant is charged from the outside as needed. The entire necessary quantity of refrigerant is charged from the outside when refrigerant is not charged in advance into the heat source unit 2. The helium gas (also including non-condensable gas sealed in the utilization unit 5 when the utilization unit 5 is tested for airtightness simultaneously) as the non-condensable gas remaining in the refrigerant connection pipes 6 and 7 is thereby mixed with the refrigerant inside the refrigerant circuit 10.

In this circuit structure, the compressor 21 is activated, and operation is performed for recirculating the refrigerant in the refrigerant circuit 10, the same as in the first embodiment. Since helium gas has a small molecular diameter compared to nitrogen gas or oxygen gas, and easily passes through the separation membrane 34*b*, the separation efficiency in the separation membrane 34*b* is then enhanced. By this configuration, the refrigerant can be prevented from being released into the atmosphere even when the separation performance of the separation membrane 34*b* is low.

2 Modification

The non-condensable gas may also be substituted with helium gas in the air conditioning device 1001 (see FIG. 11) according to the second embodiment of the present invention. In this arrangement, the separation efficiency in the separation membrane 1034*b* is enhanced because the separation membrane 1034*b* used in the separation membrane device 1034 of the air conditioning device 1001 is a membrane that performs separation according to the difference in the rate at which gas permeates the membrane via the process of dissolution, diffusion, and desolubilization. Specifically, the membrane is permeable to high-boiling components having high solubility in the membrane, is impermeable to low-boiling components having little solubility in the membrane, and is relatively impermeable to helium gas compared to nitrogen gas or oxygen gas. The refrigerant can thereby be prevented from being released into the atmosphere even when the separation performance of the separation membrane 1034*b* is low.

3 Other Modifications

As described above, the operation for recirculating the refrigerant in the refrigerant circuit 10 may be performed after the non-condensable gas remaining in the refrigerant connection pipes 6 and 7 is substituted with helium in the air conditioning devices according to the various modifications of the first embodiment, the modification of the second embodiment, and the third through fifth embodiments and modifications thereof.

Seventh Embodiment

1 Structure and Features of the Air Conditioning Device

Figure 29:
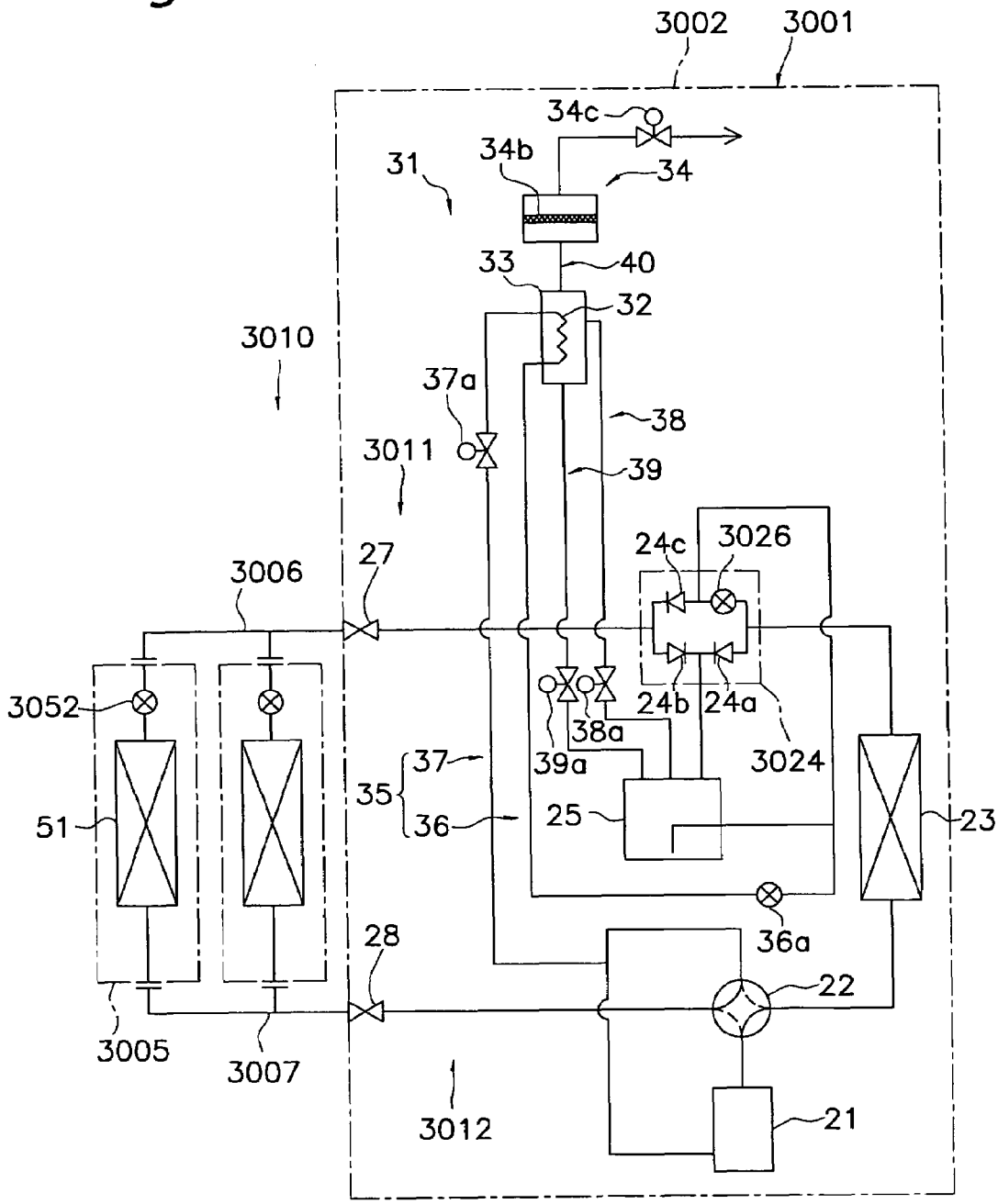
FIG. 29 is a schematic diagram of the refrigerant circuit of the air conditioning device as an example of the refrigeration device according to a seventh embodiment of the present invention.

FIG. 29 is a schematic diagram of the refrigerant circuit of the air conditioning device 3001 as an example of the refrigeration device according to a seventh embodiment of the present invention. The air conditioning device 3001 is an air conditioning device capable of cooling operation and heating operation; has a heat source unit 3002, a plurality of (in the present embodiment, two) utilization units 3005, and a liquid refrigerant connection pipe 3006 and gas refrigerant connection pipe 3007 for connecting the heat source unit 3002 and the plurality of utilization units 3005; and forms a so-called multi-type air conditioning device.

The utilization unit 3005 is primarily composed of a utilization-side heat exchanger 51 and a utilization-side expansion valve 3052. The utilization-side heat exchanger 51 in this arrangement is the same as the utilization-side heat exchanger 51 of the air conditioning device 1 of the first embodiment, so description thereof is omitted.

The utilization-side expansion valve 3052 is a valve connected to the liquid side of the utilization-side heat exchanger 51, for adjusting the refrigerant pressure or refrigerant flow rate. The utilization-side expansion valve 3052 in the present embodiment has the function of expanding the refrigerant particularly during cooling operation.

The heat source unit 3002 is primarily composed of a compressor 21, a four-way directional valve 22, a heat-source-side heat exchanger 23, a bridge circuit 3024, a main receiver 25, a heat-source side expansion valve 3026, a liquid-side gate valve 27, and a gas-side gate valve 28. Since the compressor 21, four-way directional valve 22, heat-source-side heat exchanger 23, main receiver 25, liquid-side gate valve 27, and gas-side gate valve 28 herein are the same as the compressor 21, four-way directional valve 22, heat-source-side heat exchanger 23, main receiver 25, liquid-side gate valve 27, and gas-side gate valve 28 of the air conditioning device 1 of the first embodiment, description thereof is omitted.

The bridge circuit 3024 in the present embodiment includes three non-return valves 24*a* through 24*c*, and a heat-source-side expansion valve 3026, and is connected between the heat-source-side heat exchanger 23 and the liquid-side gate valve 27. The non-return valve 24*a* in this arrangement is a valve for allowing refrigerant to pass only from the heat-source-side heat exchanger 23 to the main receiver 25. The non-return valve 24*b* is a valve for allowing refrigerant to pass only from the liquid-side gate valve 27 to the main receiver 25. The non-return valve 24*c* is a valve for allowing refrigerant to pass only from the main receiver 25 to the liquid-side gate valve 27. The heat-source-side expansion valve 3026 is a valve that is connected between the exit port of the main receiver 25 and the heat-source-side heat exchanger 23 in order to adjust the refrigerant pressure or refrigerant flow rate. The heat-source-side expansion valve 3026 in the present embodiment is fully closed during cooling operation, and functions so as to cause the refrigerant flowing towards the utilization-side heat exchanger 51 from the heat-source-side heat exchanger 23 to flow into the main receiver 25 via the entrance port of the main receiver 25. The degree of opening of this heat-source-side expansion valve is also adjusted during heating operation to cause expansion in the refrigerant flowing towards the heat-source-side heat exchanger 23 from the utilization-side heat exchanger 51 (specifically, the exit port of the main receiver 25). By this configuration, the bridge circuit 3024 causes refrigerant to flow into the main receiver 25 through the entrance port of the main receiver 25, and causes the refrigerant flowing out of the exit port of the main receiver 25 to flow towards the utilization-side heat exchanger 51 without being expanded in the heat-source-side expansion valve 3026 when refrigerant flows towards the utilization-side heat exchanger 51 from the heat-source-side heat exchanger 23, such as during cooling operation. The bridge circuit thus configured also causes refrigerant to flow into the main receiver 25 through the entrance port of the main receiver 25, and causes the refrigerant flowing out of the exit port of the main receiver 25 to flow towards the heat-source-side heat exchanger 23 after being expanded in the heat-source-side expansion valve 3026 when the refrigerant flows towards the heat-source-side heat exchanger 23 from the utilization-side heat exchanger 51, such as during heating operation.

The liquid refrigerant connection pipe 3006 connects the liquid sides of the utilization-side heat exchangers 51 of the plurality of utilization units 3005 and the liquid-side gate valve 27 of the heat source unit 3002. The gas refrigerant connection pipe 3007 connects the gas sides of the utilization-side heat exchangers 51 of the plurality of utilization units 3005 and the gas-side gate valve 28 of the heat source unit 3002. The liquid refrigerant connection pipe 3006 and the gas refrigerant connection pipe 3007 are refrigerant connection pipes constructed on site when the air conditioning device 3001 is newly installed, and are refrigerant connection pipes that are diverted from an existing air conditioning device when either one or both of the heat source unit 3002 and the utilization unit 3005 are upgraded.

The portion of the refrigerant circuit herein that extends from the utilization-side heat exchanger 51 to the heat-source-side heat exchanger 23 that includes the liquid refrigerant connection pipe 3006, the liquid-side gate valve 27, the bridge circuit 3024, the main receiver 25, and the heat-source side expansion valve 3026 constitutes the liquid-side refrigerant circuit 3011. The portion of the refrigerant circuit that extends from the utilization-side heat exchanger 51 to the heat-source-side heat exchanger 23 that includes the gas refrigerant connection pipe 3007, the gas-side gate valve 28, the four-way directional valve 22, and the compressor 21 constitutes the gas-side refrigerant circuit 3012. Specifically, the refrigerant circuit 3010 of the air conditioning device 3001 includes the liquid-side refrigerant circuit 3011 and the gas-side refrigerant circuit 3012.

The air conditioning device 3001 is further provided with a gas separation device 31 connected to the liquid-side refrigerant circuit 3011. The gas separation device 31 is a device capable of separating from the refrigerant the non-condensable gas remaining in the liquid refrigerant connection pipe 3006 and gas refrigerant connection pipe 3007, and discharging the non-condensable gas to the outside of the refrigerant circuit 3010 by operating the compressor 21 and recirculating the refrigerant in the refrigerant circuit 3010, and is housed in the heat source unit 3002 in the present embodiment. Since the gas separation device 31 in this arrangement is the same as the gas separation device 31 of the air conditioning device 1 of the first embodiment, description thereof is omitted.

In this type of air conditioning device 3001, the non-condensable gas remaining in the liquid refrigerant connection pipe 3006 and gas refrigerant connection pipe 3007 is discharged from the refrigerant circuit 3010 using the gas separation device 31 by recirculating the refrigerant in the refrigerant circuit 3010. This operation can be performed using the same installation method as that of the air conditioning device 1 of the first embodiment.

This installation method is particularly useful in the case of a multi-type air conditioning device such as the air conditioning device 3001 of the present embodiment, because the pipe length and diameter of the refrigerant connection pipes 3006 and 3007 thereof are large compared to the refrigerant connection pipes of a relatively small air conditioning device such as a room air conditioner or the like, and a large amount of non-condensable gas must be discharged from the refrigerant circuit 3010.

2 Modification

The gas separation devices 231, 331, 431, 531, 631, 731, and 831 according to the modifications of the first embodiment, the gas separation device 1031 according to the second embodiment, the gas separation devices 1531, 1631, 1731, and 1831 according to the third embodiment and modifications thereof, the gas separation devices 2031 and 2131 according to the fourth embodiment and modification thereof, or the gas separation devices 2531, 2631, and 2731 according to the fifth embodiment and modifications thereof may be employed as the gas separation device of the air conditioning device 3001.

A configuration may also be adopted whereby helium gas is discharged from the refrigerant circuit 3010 using the gas separation device 31 by recirculating the refrigerant in the refrigerant circuit 3010 after substituting the non-condensable gas with helium gas, as in the sixth embodiment.

Eighth Embodiment

1 Structure and Features of the Air Conditioning Device

Figure 30:
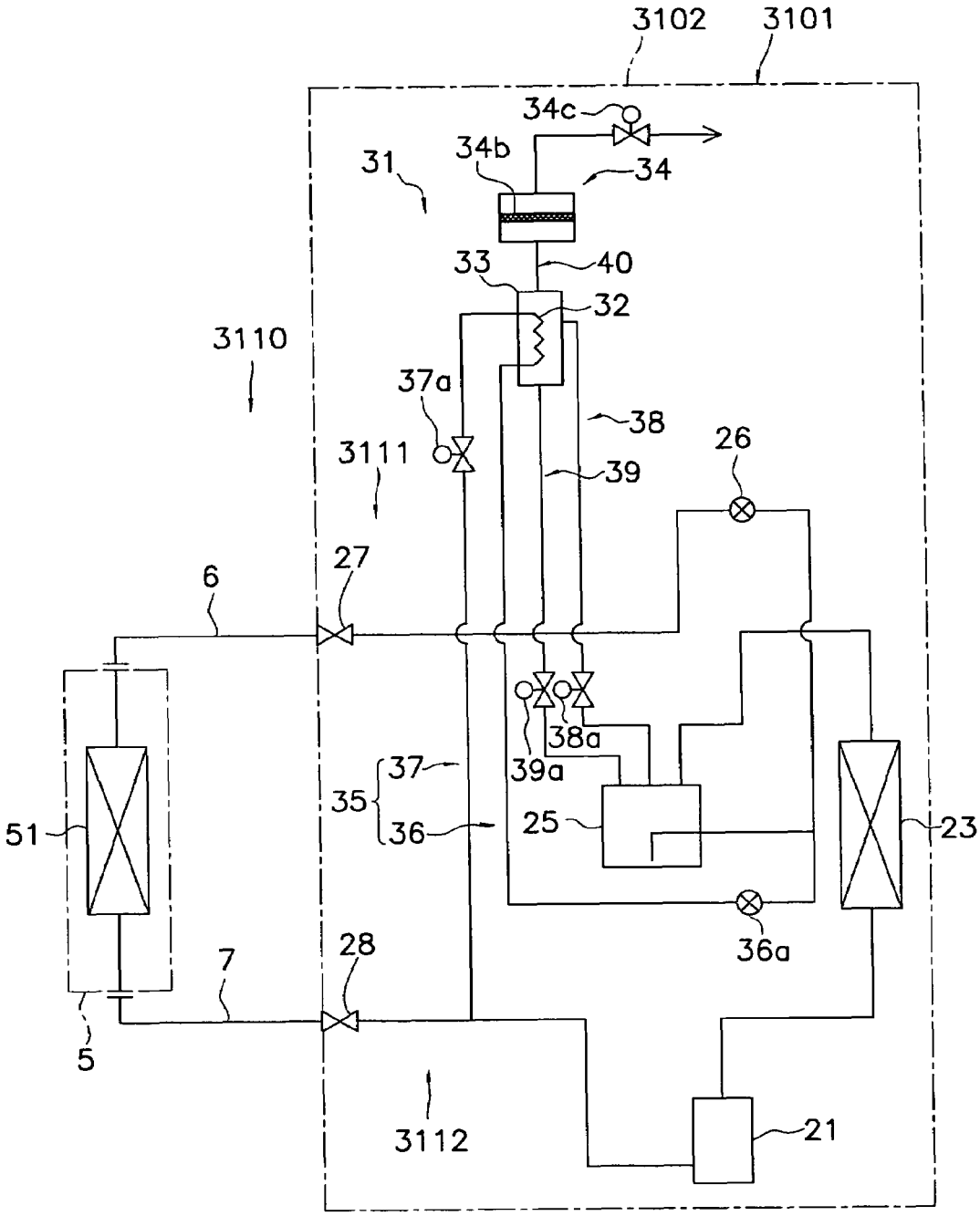
FIG. 30 is a schematic diagram of the refrigerant circuit of the air conditioning device as an example of the refrigeration device according to an eighth embodiment of the present invention.

FIG. 30 is a schematic diagram of the refrigerant circuit of the air conditioning device 3101 as an example of the refrigeration device according to an eighth embodiment of the present invention. The air conditioning device 3101 is used exclusively for cooling and is provided with a heat source unit 3102, a utilization unit 5, and a liquid refrigerant connection pipe 6 and gas refrigerant connection pipe 7 for connecting the heat source unit 3002 with the utilization unit 5. The utilization unit 5, the liquid refrigerant connection pipe 6, and the gas refrigerant connection pipe 7 are the same as the utilization unit 5, liquid refrigerant connection pipe 6, and gas refrigerant connection pipe 7 of the air conditioning device 1 of the first embodiment, and description thereof is therefore omitted.

The heat source unit 3102 is primarily composed of a compressor 21, a four-way directional valve 22, a heat-source-side heat exchanger 23, a main receiver 25, a heat-source side expansion valve 26, a liquid-side gate valve 27, and a gas-side gate valve 28. This air conditioning device is used exclusively for cooling, and therefore differs in that the four-way directional valve 22 and bridge circuit 24 provided to the heat source unit 2 of the first embodiment are omitted in the heat source unit 3102. However, the compressor 21, heat-source-side heat exchanger 23, main receiver 25, liquid-side gate valve 27, and gas-side gate valve 28 herein are the same as the compressor 21, heat-source-side heat exchanger 23, main receiver 25, liquid-side gate valve 27, and gas-side gate valve 28 of the air conditioning device 1 of the first embodiment, and description thereof is therefore omitted.

The portion of the refrigerant circuit that extends from the utilization-side heat exchanger 51 to the heat-source-side heat exchanger 23 that includes the liquid refrigerant connection pipe 6, the liquid-side gate valve 27, and the main receiver 25 constitutes the liquid-side refrigerant circuit 3111. The portion of the refrigerant circuit that extends from the utilization-side heat exchanger 51 to the heat-source-side heat exchanger 23 that includes the gas refrigerant connection pipe 7, the gas-side gate valve 28, and the compressor 21 constitutes the gas-side refrigerant circuit 3112. Specifically, the refrigerant circuit 3110 of the air conditioning device 3101 includes the liquid-side refrigerant circuit 3111 and the gas-side refrigerant circuit 3112.

The air conditioning device 3101 is further provided with a gas separation device 31 connected to the liquid-side refrigerant circuit 3111. The gas separation device 31 is a device capable of separating from the refrigerant the non-condensable gas remaining in the liquid refrigerant connection pipe 6 and gas refrigerant connection pipe 7, and discharging the non-condensable gas to the outside of the refrigerant circuit 3110 by operating the compressor 21 and recirculating the refrigerant in the refrigerant circuit 3110. The device is housed in the heat source unit 3102 in the present embodiment. Since the gas separation device 31 in this arrangement is the same as the gas separation device 31 of the air conditioning device 1 of the first embodiment, description thereof is omitted.

In this type of air conditioning device 3101, the non-condensable gas remaining in the liquid refrigerant connection pipe 6 and gas refrigerant connection pipe 7 is discharged from the refrigerant circuit 3110 using the gas separation device 31 by recirculating the refrigerant in the refrigerant circuit 3110. This operation can be performed using the same installation method as that of the air conditioning device 1 of the first embodiment.

2 Modification

The gas separation devices 131, 231, 331, 431, 531, 631, 731, and 831 according to the modifications of the first embodiment, the gas separation devices 1031 and 1131 according to the second embodiment and modification thereof, the gas separation devices 1531, 1631, 1731, and 1831 according to the third embodiment and modifications thereof, the gas separation devices 2031 and 2131 according to the fourth embodiment and modification thereof, or the gas separation devices 2531, 2631, and 2731 according to the fifth embodiment and modifications thereof may be employed as the gas separation device of the air conditioning device 3101.

A configuration may also be adopted whereby helium gas is discharged from the refrigerant circuit 3110 using the gas separation device 31 by recirculating the refrigerant in the refrigerant circuit 3110 after substituting the non-condensable gas with helium gas, as in the sixth embodiment.

Other Embodiments

Embodiments of the present invention were described above based on the drawings, but the specific structure of the present invention is in no way limited to these embodiments, and the present invention may be modified within a range that does not depart from the intent thereof.

For example, in the aforementioned embodiments, the present invention is applied to an air conditioning device capable of switching from cooling operation, an air conditioning device used exclusively for cooling, or a multi-type air conditioning device connected to a plurality of utilization units, but these examples are not limiting, and the present invention may also be applied to an ice-storage-type air conditioning device or other separate-type refrigeration device.

INDUSTRIAL APPLICABILITY

Using the present invention, the separation efficiency of non-condensable gas in the separation membrane can be enhanced in a refrigeration device provided with a configuration whereby non-condensable gas remaining in the refrigerant connection pipes at the time of on-site installation can be separated and removed from a state of mixture with the refrigerant in the refrigerant circuit using a separation membrane in order to obviate the evacuation operation.

What is claimed is:

1. A method for installing a refrigeration device comprising:

forming a refrigerant circuit by connecting a heat source unit having a compressor and a heat-source-side heat exchanger to a utilization unit having a utilization-side heat exchanger via a refrigerant connection pipe; and performing a non-condensable gas discharge operation comprising operating said compressor, recirculating refrigerant through said refrigerant circuit, cooling and separating at least a portion of the refrigerant that flows between said heat-source-side heat exchanger and said utilization-side heat exchanger into a liquid refrigerant and a gas refrigerant that includes a non-condensable gas remaining in said refrigerant connection pipe, separating said non-condensable gas using a separation membrane from said gas refrigerant obtained by gas-liquid separation, and discharging said non-condensable gas outside of said refrigerant circuit.

2. The method as recited in claim 1, wherein said non-condensable gas discharge operation is performed such that the refrigerant that flows between said heat-source-side heat exchanger and said utilization-side heat exchanger is separated into said liquid refrigerant and said gas refrigerant that includes said non-condensable gas, after which said gas refrigerant obtained by said gas-liquid separation is cooled.

3. The method as recited in claim 1, further comprising testing for airtightness of said refrigerant connection pipe prior to performing said non-condensable gas discharge operation; and releasing seal gas into atmosphere to reduce pressure inside said refrigerant connection pipe after performing said airtightness testing step.

4. A refrigeration device comprising a utilization unit having a utilization-side heat exchanger;

a heat source unit having a compressor and a heat-source-side heat exchanger connected via a refrigerant connection pipe to form a refrigerant circuit;

a cooler connected to a liquid-side refrigerant circuit of said refrigerant circuit that connects said heat-source-side heat exchanger to said utilization-side heat exchanger, and said cooler being configured to cool at least a portion of refrigerant that flows between said heat-source-side heat exchanger and said utilization-side heat exchanger when said compressor is operated and the refrigerant is recirculated in said refrigerant circuit;

a gas-liquid separator configured to separate the refrigerant cooled by said cooler, into a liquid refrigerant and a gas refrigerant that includes a non-condensable gas remaining in said refrigerant connection pipe; and a separation membrane device having a separation membrane configured to separate separating said non-condensable gas from the gas refrigerant obtained by gas-liquid separation using said gas-liquid separator, and configured to discharge said non-condensable gas separated by said separation membrane outside of the refrigerant circuit.

5. The refrigeration device as recited in claim 4, wherein said liquid-side refrigerant circuit further has a receiver configured to collect the refrigerant that flows between said heat-source-side heat exchanger and said utilization-side heat exchanger; and said cooler is configured to cool the gas refrigerant including said non-condensable gas that is separated into gas and liquid inside said receiver.

6. The refrigeration device as recited in claim 4, wherein said cooler includes a heat exchanger that uses the refrigerant that flows through said refrigerant circuit as a cooling source.

7. The refrigeration device as recited in claim 4, wherein said cooler includes a coiled heat transfer tube disposed inside said gas-liquid separator.

8. The refrigeration device as recited in claim 4, wherein said gas-liquid separator is connected so that the liquid refrigerant that is separated into gas and liquid in said gas-liquid separator is returned to said receiver.

9. The refrigeration device as recited in claim 8, wherein said gas-liquid separator is integrally formed with said receiver.

10. The refrigeration device as recited in claim 4, wherein said separation membrane device is integrally formed with said gas-liquid separator.

11. The refrigeration device as recited in claim 5, wherein said cooler includes a heat exchanger that uses the refrigerant that flows through said refrigerant circuit as a cooling source.

12. The refrigeration device as recited in claim 5, wherein said cooler includes a coiled heat transfer tube disposed inside said gas-liquid separator.

13. The refrigeration device as recited in claim 5, wherein said gas-liquid separator is connected so that the liquid refrigerant that is separated into gas and liquid in said gas-liquid separator is returned to said receiver.

14. The refrigeration device as recited in claim 13, wherein said gas-liquid separator is integrally formed with said receiver.

15. The refrigeration device as recited in claim 5, wherein said separation membrane device is integrally formed with said gas-liquid separator.

16. The refrigeration device as recited in claim 6, wherein said cooler includes a coiled heat transfer tube disposed inside said gas-liquid separator.

17. The refrigeration device as recited in claim 6, wherein said gas-liquid separator is connected so that the liquid refrigerant that is separated into gas and liquid in said gas-liquid separator is returned to said receiver.

18. The refrigeration device as recited in claim 17, wherein said gas-liquid separator is integrally formed with said receiver.

19. The refrigeration device as recited in claim 6, wherein said separation membrane device is integrally formed with said gas-liquid separator.

20. The method as recited in claim 2, further comprising testing for airtightness of said refrigerant connection pipe prior to performing said non-condensable gas discharge operation; and releasing seal gas into atmosphere to reduce pressure inside said refrigerant connection pipe after performing said airtightness testing step.

* * * * *

UNITED STATES PATENT AND TRADEMARK OFFICE

CERTIFICATE OF CORRECTION

PATENT NO. : 7,357,002 B2
APPLICATION NO. : 10/573984
DATED : April 15, 2008
INVENTOR(S) : Manabu Yoshimi et al.

It is certified that error appears in the above-identified patent and that said Letters Patent is hereby corrected as shown below:

Column 39,
Line 62, "to separate separating said non-condensable gas" should read -- to separate said non-condensable gas --.

Signed and Sealed this

First Day of July, 2008

JON W. DUDAS
*Director of the United States Patent and Trademark Office*